US009076400B2

(12) United States Patent
Matsuda et al.

(10) Patent No.: US 9,076,400 B2
(45) Date of Patent: Jul. 7, 2015

(54) LIQUID CRYSTAL DISPLAY DEVICE AND METHOD FOR DRIVING SAME

(75) Inventors: Eiji Matsuda, Osaka (JP); Yasushi Sasaki, Osaka (JP); Yuhichiroh Murakami, Osaka (JP); Seijirou Gyouten, Osaka (JP); Shuji Nishi, Osaka (JP); Makoto Yokoyama, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 252 days.

(21) Appl. No.: 13/993,922

(22) PCT Filed: Dec. 12, 2011

(86) PCT No.: PCT/JP2011/078644

§ 371 (c)(1),
(2), (4) Date: Jun. 13, 2013

(87) PCT Pub. No.: WO2012/081530

PCT Pub. Date: Jun. 21, 2012

(65) Prior Publication Data

US 2013/0257846 A1 Oct. 3, 2013

(30) Foreign Application Priority Data

Dec. 17, 2010 (JP) ..... 2010-282194

(51) Int. Cl.
*G09G 3/36* (2006.01)

(52) U.S. Cl.
CPC ..... *G09G 3/3618* (2013.01); *G09G 3/3648* (2013.01); *G09G 2300/0857* (2013.01); *G09G 2300/0852* (2013.01); *G09G 2300/0876* (2013.01)

(58) Field of Classification Search
CPC ..... G09G 3/3618; G09G 3/3648; G09G 2300/0852; G09G 2300/0857; G09G 2300/0876
USPC ..... 345/87–104, 205, 212
See application file for complete search history.

(56) References Cited

U.S. PATENT DOCUMENTS 5,712,652 A * 1/1998 Sato et al. ..... 345/90
6,778,162 B2 * 8/2004 Kimura et al. ..... 345/90

(Continued)

FOREIGN PATENT DOCUMENTS

JP 2002-229532 A 8/2002

OTHER PUBLICATIONS

International Search Report and Written Opinion corresponding to PCT/JP2011/078644, dated Jan. 24, 2012.

*Primary Examiner* — Amare Mengistu
*Assistant Examiner* — Stacy Khoo
(74) *Attorney, Agent, or Firm* — Lowe Hauptman & Ham LLP

(57) ABSTRACT

A memory-type liquid crystal display device includes transistors (N1, N2), retention electrodes (MRY), refresh output control sections (RS1), and capacitors (Cb1). In a data retention period, an electric potential of each of the retention electrodes (MRY) is changed via a corresponding one of the capacitors (Cb1) by changing an electric potential level of a retention capacitor wire signal that is supplied to a corresponding CS line (CSL(i)). Each of the refresh output control sections (RS1) receives the electric potential thus changed of a corresponding one of the retention electrodes (MRY) via the input section and controls an electric potential of a corresponding pixel electrode (PIX) in accordance with the electric potential thus changed.

13 Claims, 23 Drawing Sheets

(56) References Cited

U.S. PATENT DOCUMENTS 7,230,597 B2 * 6/2007 Edwards et al. ..... 345/87
2001/0024187 A1 * 9/2001 Sato et al. ..... 345/98
2002/0075205 A1 6/2002 Kimura et al.
2009/0303168 A1 * 12/2009 Nagata ..... 345/90

* cited by examiner

FIG. 21

| Pch Transistor Characteristics | Nch Transistor Characteristics | Inversion Electric Potential | | Input Electric Potential | Output Electric Potential | Inversion Operation |
|---|---|---|---|---|---|---|
| High Capability (Large In On Electric Current) (Low In Threshold Voltage) | Low Capability (Small In On Electric Current) (High In Threshold Voltage) | Closer To H Level Than Electric Potential That Is In Center Of Range From L-Level Power Supply To H-Level Power Supply →The Greater The Capability Difference, The Higher | High | H Input>Inversion Electric Potential | L | OK |
| | | | | H Input<Inversion Electric Potential | H | NG |
| | | | | L Input<Inversion Electric Potential | H | OK |
| Pch Transistor And Nch Transistor Are Equal In Capability | | Electric Potential That Is In Center Of Range From L-Level Power Supply To H-Level Power Supply | Center | H Input>Inversion Electric Potential | L | OK |
| | | | | L Input<Inversion Electric Potential | H | OK |
| Low Capability (Small In On Electric Current) (High In Threshold Voltage) | High Capability (Large In On Electric Current) (Low In Threshold Voltage) | Closer To L Level Than Electric Potential That Is In Center Of Range From L-Level Power Supply To H-Level Power Supply →The Greater The Capability Difference, The Lower | Low | H Input>Inversion Electric Potential | L | OK |
| | | | | L Input>Inversion Electric Potential | L | NG |
| | | | | L Input<Inversion Electric Potential | H | OK |

LIQUID CRYSTAL DISPLAY DEVICE AND METHOD FOR DRIVING SAME

RELATED APPLICATIONS

The present application is a National Phase of International Application Number PCT/JP2011/078644, filed Dec. 12, 2011, and claims priority from, Japanese Application Number 2010-282194, filed Dec. 17, 2010.

TECHNICAL FIELD

The present invention relates to a memory-type liquid crystal display device.

BACKGROUND ART

A liquid crystal display device including pixel memories (i.e., a memory-type liquid crystal device) carries out a display (memory operation mode) by temporarily retaining image data written to each pixel and carrying out a refresh operation while inverting the polarity of the image data. In a normal operation (normal operation mode, multi-color display mode) of carrying out a multi-color (multi-tone) display, new image data is written to each pixel via a data signal line every single frame. In the memory operation mode, on the other hand, image data retained in each memory circuit (pixel memory) is used, which makes it unnecessary to supply the data signal line with image data for rewriting while carrying out the refresh operation (i.e., during the time that a still image is being displayed).

This makes it possible to, in the memory operation, stop the operation of a circuit that drives the data signal lines (and, in some cases, scanning signal lines, too), thus making it possible to cut electric power consumption, and also makes it possible to reduce electric power consumption through a reduction in the number of times the large-capacity data signal lines are charged and discharged and through the elimination of the need to transmit, to a controller, image data corresponding to a memory operation period. Therefore, the memory operation mode is often used for still-image displays of which a reduction in electric power consumption is strongly required, e.g., for standby screen displays for mobile phones.

Patent Literature 1 discloses a memory-type liquid crystal display device including an inverter circuit in each pixel and two switching elements each constituted by a thin-film transistor (hereinafter abbreviated as "TFT").

CITATION LIST

Patent Literature 1

Japanese Patent Application Publication, Tokukai, No. 2002-229532 A (Publication Date: Aug. 16, 2002)

SUMMARY OF INVENTION

Technical Problem

However, the conventional memory-type liquid crystal display device suffers from a malfunction of a pixel memory circuit due to the transistor characteristics of the switching elements. This problem will be explained below.

FIG. 17 is a circuit diagram showing a configuration of each pixel 100 in a conventional memory-type liquid crystal display device. Connected to the pixel 100 are a signal line

101, a scanning line 102, and two memory control signal lines 103 and 104. The pixel 100 includes a first switching element 105, a second switching element 106, a third switching element 107, a first capacitor element 108, a second capacitor element 109, a liquid crystal layer 110, and an inverter circuit 111. Each of the first to third switching elements 105 to 107 is constituted by a TFT. The liquid crystal layer 110 is sandwiched between a pixel electrode 112 and a counter electrode 113. The inverter circuit 111 is connected to an input terminal 114 and an output terminal 115. In a memory operation mode, this memory-type liquid crystal display device carries out a refresh operation while inverting the polarity of image data stored in the second capacitor element 109.

FIG. 18 is a signal chart showing how the pixel memory shown in FIG. 17 operates in the memory operation mode. In a still-image writing frame, binary image data (High (H) or Low (L)) is written to each pixel. In a still-image display period that follows, the refresh operation is carried out while the polarities (H, L) of the pixel electrode 112 and the counter electrode 113 are being inverted, so that a still image continues to be displayed.

Let it be assumed that immediately after the still-image writing frame, the pixel electrode 112, the input terminal 114, and the counter electrode 113 have their electric potentials at H, H, and L, respectively. Then, the inverter circuit 111 causes the output terminal 115 to have its electric potential at L when the input terminal 114 has its electric potential at H, or causes the output terminal 115 to have its electric potential at H when the input terminal 114 has its electric potential at L.

A case where the pixel memory ideally operates in the memory operation mode is described below. At a time point tp1, the third switching element 107 is turned on, so that the pixel electrode 112 comes to have its electric potential at the same electric potential as the electric potential L of the output terminal 115. At the same time, the counter electrode 113 has its electric potential inverted to be H. Next, at a time point tp2, the third switching element 107 is turned off. After that, at a time point tp3, the second switching element 106 is turned on, so that the electric potential L of the pixel electrode 112 is written to the input terminal 114. This causes the input terminal 114 to have its electric potential at L. After that, at a time point tp4, the second switching element 106 is turned off. The pixel memory repeats this refresh operation, so that a still image is displayed.

The operation described above is an ideal operation. In actuality, however, a deviation in electric potential of the input terminal 114 from the ideal occurs due to the first and second capacitor elements 108 and 109 when the electric potential of the pixel electrode 112 is written to the input terminal 114 by turning on the second switching element 106.

(a) of FIG. 19 is a diagram showing the first and second capacitor elements 108 and 109 in a simple model. In (a) of FIG. 19, the second switching element 106, to which each of the first and second capacitor elements 108 and 109 has one end connected, is off. Each of the first and second capacitor elements 108 and 109 has the other end connected to a retention capacitor wire CS (whose electric potential is 0 V, for example). In this state, C1 is the capacitance of the first capacitor element 108, Q1 is the charge of the first capacitor element 108, C2 is the capacitance of the second capacitor element 109, Q2 is the charge of the second capacitor element 109, V1 is the electric potential of the pixel electrode 112, and V2 is the electric potential of the input terminal 114. C1, Q1, C2, Q2, V1, and V2 have a relationship represented by the following expressions:

$$Q1=C1\times V1 \quad (1)$$

$$Q2=C2\times V2 \quad (2).$$

(b) of FIG. 19 is a diagram showing a state in which the second switching element 106 of (a) of FIG. 19 is on, and (c) of FIG. 19 is a diagram showing, as a single composite capacitor element 120, the two capacitor elements shown in (b) of FIG. 19. C is the capacitor of the composite capacitor element 120, and Q is the charge of the composite capacitor element 120. Vx is the electric potential (=electric potential of the input terminal 114) of the pixel electrode 112 as obtained as a result of turning on the second switching element 106. C, Q, and Vx have a relationship represented by the following expressions:

$$Q=C\times Vx \quad (3)$$

$$C=C1+C2 \quad (4)$$

Further, the total amount of charge before the second switching element 106 is turned on is conserved after the second switching element 106 has been turned on.

$$Q=Q1+Q2 \quad (5).$$

It should be noted here that according the expressions (1) to (5), Vx is expressed as follows:

$$Vx=(C1/(C1+C2))V1+(C2/(C1+C2))V2 \quad (6).$$

That is, the electric potential (electric potential of the input terminal 114) Vx of the pixel electrode 112 as obtained after the second switching element 106 has been turned on depends on the ratio between the capacitance C1 of the first capacitor element 108 and the capacitance C2 of the second capacitor element 109.

For example, let it be assumed that C1=300 fF and C2=50 fF. If V1=0 V and V2=5 V before the second switching element 106 is turned on, then Vx=0.71 V after the second switching element 106 has been turned on. Also, if V1=5 V and V2=0 V before the second switching element 106 is turned on, then Vx=4.29 V after the second switching element 106 has been turned on.

That is, even writing the electric potential V1 of the pixel electrode 112 to the input terminal 114 by turning on the second switching element 106 ends up causing the electric potential Vx of the input terminal 114 to have its value shifted from V1 toward V2. If the capacitance C1 is greater in comparison with the capacitance C2, the amount of shift will be smaller but still cannot be 0. It should be noted that although there are liquid crystal capacitances, wiring capacitances, etc. in addition to the capacitances C1 and C2, such capacitances are omitted here. This shift in electric potential may cause a problem.

FIG. 20 is a circuit diagram showing a circuit equivalent to the inverter circuit 111 of FIG. 17. The inverter circuit 111 is constituted by a P-channel (Pch) transistor 121, an N-channel (Nch) transistor 122, a H-level power supply wire 123, and a L-level power supply wire 124. The inverter circuit 111 outputs an electric potential H of the H-level power supply wire 123 as the electric potential of the output terminal 115 if the electric potential of the input terminal 114 is lower than a predetermined electric potential (inversion electric potential). The inverter circuit 111 outputs an electric potential L of the L-level power supply wire 124 as the electric potential of the output terminal 115 if the electric potential of the input terminal 114 is higher than the inversion electric potential. Moreover, the value of the inversion electric potential of the inverter circuit 111 depends on the characteristics of the P-channel and N-channel transistors 121 and 122, and does not necessarily fall in the center (middle) of the range from the L level to the H level.

FIG. 21 is a table showing variations in characteristic of the inverter circuit 111. In a case where the P-channel transistor 121 has a high capability (i.e., is large in ON electric current or low in threshold voltage) or in a case where the N-channel transistor 122 has a low capability (i.e., is small in ON electric current or high in threshold voltage), the inverter circuit 111 has its inversion electric potential closer to the H level than the electric potential that is in the center of the range from the L level to the H level. In this case, even supplying a H input as an input electric potential to the input terminal 114 ends up causing the output terminal 115 to have its output electric potential at the H level, if the aforementioned shift in electric potential causes the H input to be lower than the inversion electric potential. This means that the inverter circuit 111 has not carried out the desired inversion operation.

Alternatively, in a case where the P-channel transistor 121 has a low capability (i.e., is small in ON electric current or high in threshold voltage) or in a case where the N-channel transistor 122 has a high capability (i.e., is large in ON electric current or low in threshold voltage), the inverter circuit 111 has its inversion electric potential closer to the L level than the electric potential that is in the center of the range from the L level to the H level. In this case, similarly, even supplying a L input as an input electric potential to the input terminal 114 ends up causing the output terminal 115 to have its output electric potential at the L level, if the aforementioned shift in electric potential causes the L input to be higher than the inversion electric potential. This means that the inverter circuit 111 has not carried out the desired inversion operation.

An example of actual operation of the pixel memory in the memory operation mode in view of (a) a shift in input electric potential due to the capacitance ratio (C1/C2) and (b) the characteristics of the inverter circuit 111 is described with reference to FIG. 18.

Example 1 of Actual Operation shown in FIG. 18 is described. In Example 1 of Operation, it is assumed that the inverter circuit 111 has its inversion electric potential Vr in the center of the range from the L level to the H level. At the time point tp3, the second switching element 106 is turned on, so that the electric potential L of the pixel electrode 112 is written to the input terminal 114. However, the electric potential of the input terminal 114 (and the electric potential of the pixel electrode 112) shift(s) upward from the electric potential L due to the capacitance ratio between the first capacitor element 108 and the second capacitor element 109. Each of the arrows shown in FIG. 18 indicates the direction of a shift from the H level or the L level. At the time point tp3 and after, the input terminal 114 has its electric potential shifted upward, but the electric potential is still lower than the inversion electric potential Vr. Therefore, at the time point tp3 and after, the output terminal 115 has its electric potential at the H level. Consequently, in the subsequent interval between a time point tp5 and a time point tp6, during which the third switching element 107 is on, the pixel electrode 112 has its electric potential at the same H level as the electric potential of the output terminal 115.

After this, at a time point tp7, the second switching element 106 is turned on, so that the electric potential H of the pixel electrode 112 is written to the input terminal 114. In this case, the electric potential of the input terminal 114 (and the electric potential of the pixel electrode 112) shift(s) downward from the electric potential H due to the capacitance ratio between the first capacitor element 108 and the second capacitor element 109. At the time point tp7 and after, the input terminal 114 has its electric potential shifted downward, but the electric potential is still higher than the inversion electric potential Vr. Therefore, at the time point tp7 and after, the output terminal 115 has its electric potential at the L level. In Example 1 of Actual Operation, the electric potential of the input terminal 114 shifts from the H level or the L level, but not to the extent that it exceeds the inversion electric potential Vr, which allows the pixel memory to normally carry out the refresh operation.

Next, Example 2 of Actual Operation shown in FIG. 18 is described. In Example 2 of Operation, it is assumed that the inverter circuit 111 has its inversion electric potential Vr lower than the electric potential that is in the center of the range from the L level to the H level. At the time point tp3, the second switching element 106 is turned on, so that the electric potential L of the pixel electrode 112 is written to the input terminal 114. However, as in Example 1 of Operation, the electric potential of the input terminal 114 (and the electric potential of the pixel electrode 112) shift(s) upward from the electric potential L due to the capacitance ratio between the first capacitor element 108 and the second capacitor element 109. In Example 2 of Operation, the inversion electric potential Vr is lower than the electric potential that is in the center of the range from the L level to the H level; therefore, at the time point tp3 and after, the input terminal 114 has its potential shifted to a higher level than the inversion electric potential Vr. Therefore, at the time point tp3 and after, the inverter circuit 111 outputs a L-level electric potential to the output terminal 115. Consequently, at the time point tp3 and after, the output terminal 115 has its potential different from that which the output terminal 115 is supposed to have in an ideal operation, with the result that the inverter circuit 111 does not carry out the desired inversion operation. After that, at the time point tp5, the third switching element 107 is turned on, so that the pixel electrode 112 has its electric potential at the same L level as the electric potential of the output terminal 115. This causes the cycle of inversion of the electric potential of the counter electrode 113 and the cycle of inversion of the electric potential of the pixel electrode 112 to be out of phase with each other. This disables the pixel memory to normally display image data.

Next, Example 3 of Actual Operation shown in FIG. 18 is described. In Example 3 of Operation, it is assumed that the inverter circuit 111 has its inversion electric potential Vr higher than the electric potential that is in the center of the range from the L level to the H level. At the time point tp3, the second switching element 106 is turned on, so that the electric potential L of the pixel electrode 112 is written to the input terminal 114. However, as in Example 1 of Operation, the electric potential of the input terminal 114 (and the electric potential of the pixel electrode 112) shift(s) upward from the electric potential L due to the capacitance ratio between the first capacitor element 108 and the second capacitor element 109. In Example 3 of Operation, the inversion electric potential Vr is higher than the electric potential that is in the center of the range from the L level to the H level; therefore, at the time point tp3 and after, the input potential 114 has its electric potential lower than the inversion electric potential Vr. Therefore, at the time point tp3 and after, the inverter circuit 111 outputs a H-level electric potential to the output terminal 115. After that, at the time point tp5, the third switching element 107 is turned on, so that the pixel electrode 112 has its electric potential at the same H level as the electric potential of the output terminal 115.

After this, at a time point tp7, the second switching element 106 is turned on, so that the electric potential H of the pixel electrode 112 is written to the input terminal 114. In this case, the electric potential of the input terminal 114 (and the electric potential of the pixel electrode 112) shift(s) downward from the electric potential H due to the capacitance ratio between the first capacitor element 108 and the second capacitor element 109. In Example 3 of Operation, the inversion electric potential Vr is higher than the electric potential that is in the center of the range from the L level to the H level; therefore, at the time point tp7 and after, the input terminal 114 has its potential shifted to a lower level than the inversion electric potential Vr. Therefore, at the time point tp7 and after, the inverter circuit 111 continues to output a L-level electric potential to the output terminal 115. Consequently, at the time point tp7 and after, the output terminal 115 has its potential different from that which the output terminal 115 is supposed to have in an ideal operation, with the result that the inverter circuit 111 does not carry out the desired inversion operation. After that, at the time point tp9, the third switching element 107 is turned on, so that the pixel electrode 112 has its electric potential at the same H level as the electric potential of the output terminal 115. This causes the cycle of inversion of the electric potential of the counter electrode 113 and the cycle of inversion of the electric potential of the pixel electrode 112 to be out of phase with each other. This disables the pixel memory to normally display image data.

The transistor characteristics of pixel memories manufactured are distributed over a certain degree of width (vary) due to a process of manufacturing a memory-type liquid crystal display device. Further, in actual operation, the input terminal of a refresh output control section (in FIG. 17, the inverter circuit 111) has its electric potential shifted from the H level or the L level in accordance with the ratio between the capacitances of the two capacitor elements. Therefore, depending on the transistor characteristics of the pixel memory, the operation of the transistor becomes unsteady, so that a malfunction may occur in the pixel memory.

In view of the foregoing problems, the present invention proposes a configuration of a memory-type liquid crystal display device in which a malfunction of a pixel memory can be prevented even in a case where there occur variations in transistor characteristic.

Solution to Problem

In order to solve the foregoing problems, a liquid crystal display device of the present invention is a liquid crystal display device including data signal lines, scanning signal lines, retention capacitor wires, data transfer lines, and pixel electrodes, the liquid crystal display device being a memory-type liquid crystal display device that carries out a refresh operation during a data retention period after writing of a data signal potential, the liquid crystal display device including: first transistors each having its control terminal connected to a corresponding one of the scanning signal lines, having one conducting terminal connected to a corresponding one of the data signal lines, and having the other conducting terminal connected to a corresponding one of the pixel electrodes; second transistors each having its control terminal connected to a corresponding one of the data transfer lines and having one conducting terminal connected to a corresponding one of the pixel electrodes; retention electrodes each connected to the other conducting terminal of a corresponding one of the second transistors; refresh output control sections each having its input section connected to a corresponding one of the retention electrodes and having its output section connected to a corresponding one of the pixel electrodes; and retention capacitors each formed between a corresponding one of the retention electrodes and a corresponding one of the retention capacitor wires, in the data retention period, an electric potential of each of the retention electrodes being changed via a corresponding one of the retention capacitors by changing an electric potential level of a retention capacitor wire signal that is supplied to a corresponding one of the retention capacitor wires, the refresh output control sections each receiving the electric potential thus changed of a corresponding one of the retention electrodes via the input section and controlling an electric potential of a corresponding one of the pixel electrodes in accordance with the electric potential thus changed.

The foregoing configuration makes it possible to, in the data retention period, raise (or drop) the electric potential of the retention electrode by changing the electric potential level of the retention capacitor wire signal. This allows the refresh output control section to supply the pixel electrode with an output signal adjusted to an appropriate electric potential level, thus making it possible to prevent a malfunction of the pixel memory from occurring due to variations in transistor characteristic.

In order to solve the foregoing problems, a method of the present invention for driving a liquid crystal display device is a method for driving a liquid crystal display device including data signal lines, scanning signal lines, retention capacitor wires, data transfer lines, refresh lines, and pixel electrodes, the liquid crystal display device being a memory-type liquid crystal display device that carries out a refresh operation during a data retention period after writing of a data signal potential, the liquid crystal display device including: first transistors each having its control terminal connected to a corresponding one of the scanning signal lines, having one conducting terminal connected to a corresponding one of the data signal lines, and having the other conducting terminal connected to a corresponding one of the pixel electrodes; second transistors each having its control terminal connected to a corresponding one of the data transfer lines and having one conducting terminal connected to a corresponding one of the pixel electrodes; retention electrodes each connected to the other conducting terminal of a corresponding one of the second transistors; refresh output control sections each having its input section connected to a corresponding one of the retention electrodes and having its output section connected to a corresponding one of the pixel electrodes; and retention capacitors each formed between a corresponding one of the retention electrodes and a corresponding one of the retention capacitor wires, the method including the steps of: (a) in a period of writing of a data signal potential, selecting the scanning signal lines in sequence while outputting a data signal potential to each of the data signal lines, with the data transfer lines made active in advance; (b) in the data retention period, changing an electric potential of each of the retention electrodes via a corresponding one of the retention capacitors by changing an electric potential level of a retention capacitor wire signal that is supplied to a corresponding one of the retention capacitor wires; and (c) carrying out the refresh operation by the refresh output control sections each receiving the electric potential thus changed of a corresponding one of the retention electrodes via the input section and controlling an electric potential of a corresponding one of the pixel electrodes in accordance with the electric potential thus changed.

The foregoing method brings about effects that are similar to those brought about by the foregoing liquid crystal display device.

Advantageous Effects of Invention

As described above, a liquid crystal display device of the present invention and a method of the present invention for driving a liquid crystal display device are arranged such that in the data retention period, an electric potential of each of the retention electrodes being changed via a corresponding one of the retention capacitors by changing an electric potential level of a retention capacitor wire signal that is supplied to a corresponding one of the retention capacitor wires, and that the refresh output control sections each receiving the electric potential thus changed of a corresponding one of the retention electrodes via the input section and controlling an electric potential of a corresponding one of the pixel electrodes in accordance with the electric potential thus changed.

This makes it possible to prevent a malfunction of a pixel memory from occurring in a memory-type liquid crystal display device even in a case where there are variations in transistor characteristic.

BRIEF DESCRIPTION OF DRAWINGS

FIG. 21 is a table showing variations in characteristic of the inverter circuit of FIG. 17.

DESCRIPTION OF EMBODIMENTS

The following description takes a normally black case as an example. In this case, a white display is carried out when the liquid crystals are on (voltage is applied to the liquid crystals), and a black display is carried out when the liquid crystals are off (zero voltage is applied to the liquid crystal).

[Embodiment 1]

Figure 1:
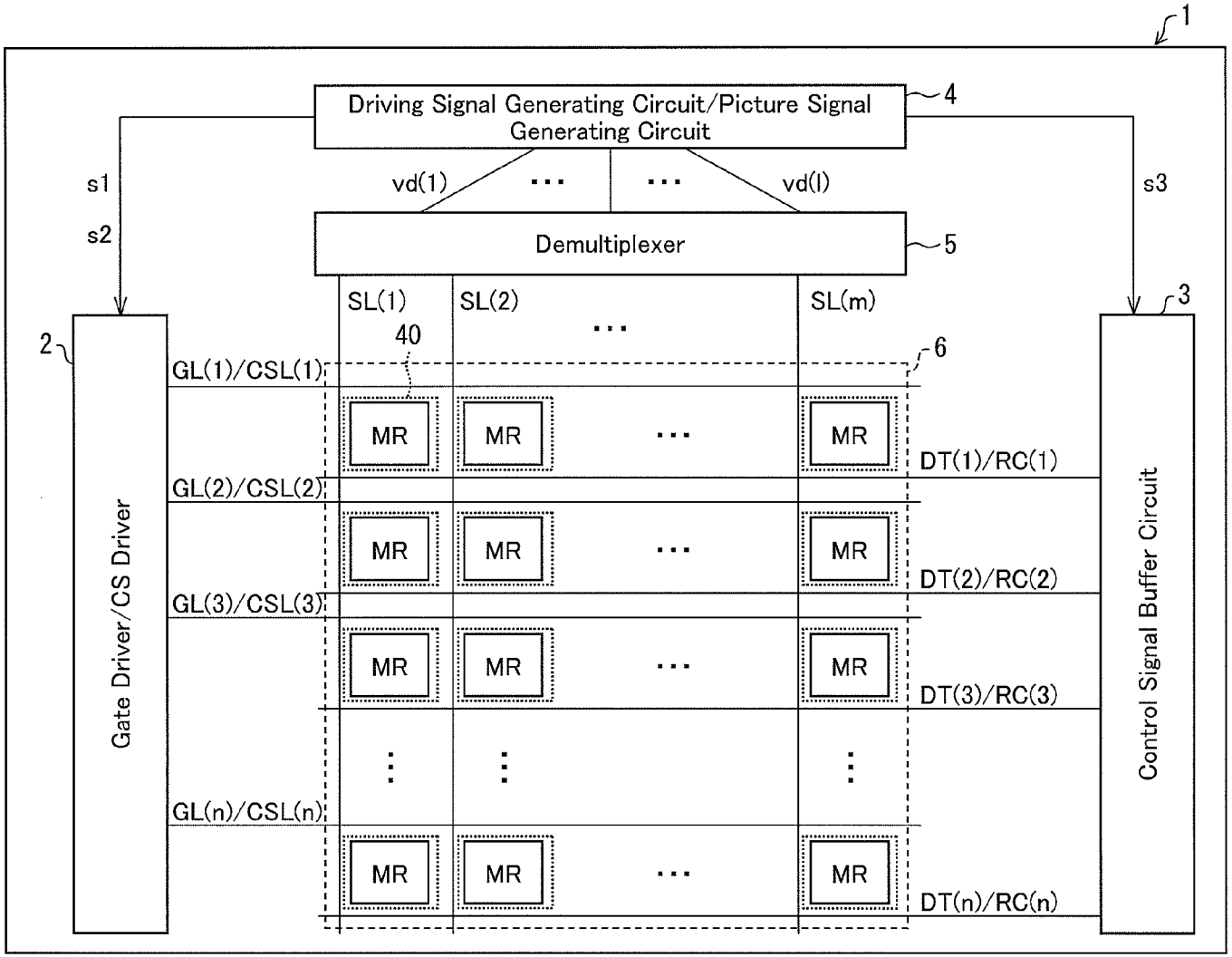
FIG. 1 is a block diagram showing a configuration of a liquid crystal display device according to an embodiment of the present invention.

An embodiment of the present invention is described with reference to the drawings. FIG. 1 shows a configuration of a liquid crystal display device according to the present embodiment. The present liquid crystal display device 1, which includes a liquid crystal panel provided with memory circuits (pixel memories MR), is a memory-type liquid crystal display device that carries out a refresh operation during a data retention period after writing of a data signal potential, and switchably operates in either of the following two modes: (1) a multi-color (multi-tone) display mode (normal operation mode), which is used, for example, for displaying images during operation of mobile phones; and (2) a memory operation mode, which is used, for example, for standby screen displays for mobile phones.

The liquid crystal display device 1 includes a gate driver/CS driver 2 (scanning signal line driving circuit/retention capacitor wire driving circuit), a control signal buffer circuit 3, a driving signal generating circuit/picture signal generating circuit 4 (display control circuit), a demultiplexer 5, and a pixel array 6. Further, the liquid crystal display device 1 includes gate lines (scanning signal lines) GL(i), CS lines (retention capacitor wires) CSL(i), data transfer control lines (data transfer lines) DT(i), refresh output control lines (refresh lines) RC(i), source lines (data signal lines) SL(j), and output signal lines vd(k). Note, however, that i is an integer of $1 \le i \le n$, j is an integer of $1 \le j \le m$, and k is an integer of $1 \le k \le l < m$.

The pixel array 6 has pixels 40 arranged in a matrix manner, i.e., n rows and m columns, and each of the pixels 40 includes a pixel memory MR (memory circuit). The pixel memories each independently retain image data. Disposed in correspondence with a pixel memory MR located at a point of intersection between the ith row and the jth column are a gate line GL(i), a data transfer control line DT(i), a refresh output control line RC(i), a CS line CSL(i), and a source line SL(j).

The gate driver/CS driver 2 is a driving circuit that drives the n rows of pixels 40 via the gate lines GL(i) and the CS lines CSL(i). Each of the gate lines GL(i) and each of the CS lines CSL(i) are connected to each of the pixels 40 of the ith row.

The control signal buffer circuit 3 is a driving circuit that drives the n rows of pixels 40 via the data transfer control lines DT(i) and the refresh output control lines RC(i).

The driving signal generating circuit/picture signal generating circuit 4 is a control driving circuit for displaying images and carrying out a memory operation. The driving signal generating circuit/picture signal generating circuit 4 can also serve as a circuit that generates timing signals, such as gate start pulse signals, gate clock signals, source start pulse signals, and source clock signals, as well as timing signals, which are used for the memory operation, as well as timings that are used for the display operation.

During the multi-color display mode (when the memory circuits are not operating), the driving signal generating circuit/picture signal generating circuit 4 outputs multi-tone video signals via a video output terminal to drive the source lines SL(j) via the output signal lines vd(k) and the demultiplexer 5. At the same time, the driving signal generating circuit/picture signal generating circuit 4 also outputs a signal s1 to drive and control the gate driver/CS driver 2, thereby writing display data to each of the pixels 40 so that a multi-tone display is carried out.

Alternatively, during the memory circuit operation mode, the driving signal generating circuit/picture signal generating circuit 4 outputs, via the video output terminal, data that is to be retained in the pixels 40, and sends the data to the source lines SL(j) via the output signal lines vd(k) (where k is an integer of $1 \le k \le l < m$) and the demultiplexer 5. Also, the memory circuit operation mode, the driving signal generating circuit/picture signal generating circuit 4 outputs a signal s2 to drive and control the gate driver/CS driver 2 and a signal s3 to drive and control the control signal buffer circuit 3, thereby writing the data to the pixels 40 for display and retention and reading out the data retained in the pixels 40.

It should be noted, however, that since the data written to the pixels 40 for retention in the memory circuits may only be used for display, it is not always necessary to carry out the operation of reading out the data from the pixels 40. For the data that the driving signal generating circuit/picture signal generating circuit 4 outputs to the output signal lines vd(k) via the video output terminal during the memory circuit operation, there exist a binary logic level expressed by either a first electric potential level or a second electric potential level. In a case where the pixels 40 correspond to each separate pixel of a color display, it is possible to carry out the display with the number of colors obtained by raising 2 to the power of the number of colors of the pixels. For example, in a case where each of the pixels has three colors, e.g., RGB, it is possible to carry out a display in a display mode with eight colors obtained by raising 2 to the power of 3 ($2^3=8$).

The demultiplexer 5 separates the data outputted to the output signal lines vd(k) and outputs it to each separate corresponding source line SL(j).

Figure 2:
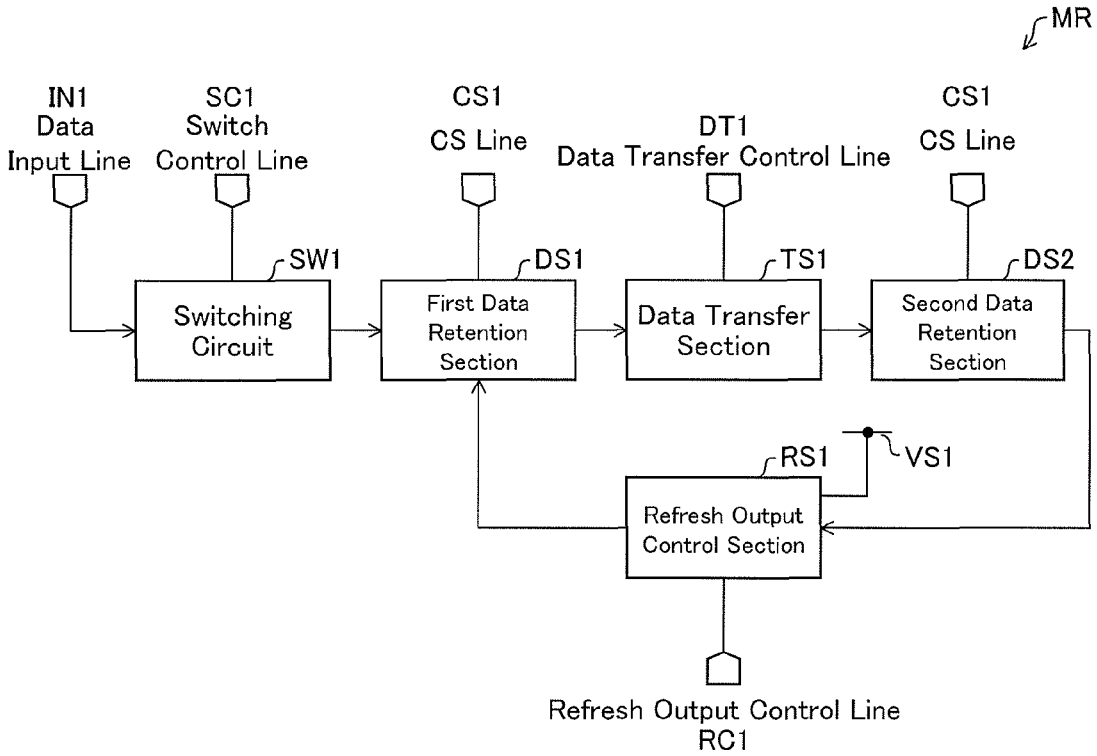
FIG. 2 is a block diagram showing a configuration of a pixel memory in the liquid crystal display device.

FIG. 2 shows the concept of a configuration of each pixel memory MR.

The pixel memory MR includes a switching circuit SW1, a first data retention section DS1, a data transfer section TS1, a second data retention section DS2, a refresh output control section RS1, and a supply source VS1.

Further, the pixel memory MR is provided with: a data input line IN1, which corresponds to the source line SL(1); a switching control line SC1, which corresponds to the gate line GL(1); a retention capacitor wire CS1, which corresponds to the CS line (1); a data transfer control line DT1; and a refresh output control line RC1.

The switching circuit SW1 is driven by the gate driver/CS driver 2 via the switch control lines SC1, thereby selectively making or breaking the conduction between the data input line IN1 and the first data retention section DS1.

The first data retention section DS1 retains a binary logic level that is inputted to the first data retention section DS1. Further, an electric potential retained in the first data retention section DS1 varies according to a signal (retention capacitor wire signal) that is supplied to the retention capacitor wire CS1. It should be noted that the retention capacitor line CS1 is driven on the basis of an output from the gate driver/CS driver 2.

The data transfer section TS1 is driven by the control signal buffer circuit 3 via the data transfer control line DT1, thereby selectively carrying out a transfer operation of transferring the binary logic level being retained in the first data retention section DS1 to the second data retention section DS2 while the first data retention section DS1 is retaining the binary logic level and a non-transfer operation of not carrying out the transfer operation. It should be noted that since the signal that is supplied to the data transfer control line DT1 is common to all pixel memories MR, the data transfer control line DT1 does not always need to be provided for each row to be driven by the control signal buffer circuit 3, but may be driven by the driving signal generating circuit/picture signal generating circuit 4 or another circuit.

The second data retention section DS2 retains a binary logic level that is inputted to the second data retention section DS2. Further, an electric potential retained in the second data retention section DS2 varies according to a signal (retention capacitor wire signal) that is supplied to the retention capacitor wire CS1.

The refresh output control section RS1 is driven by the control signal buffer circuit 3 via the refresh output control line RC1, thereby being selectively controlled to be in a state in which to carry out a first operation or in a state in which to carry out a second operation. It should be noted that since the signal that is supplied to the refresh output control line RC1 is common to all pixel memories MR, the refresh output control line RC1 does not always need to be provided for each row to be driven by the control signal buffer circuit 3, but may be driven by the driving signal generating circuit/picture signal generating circuit 4 or another circuit.

The first operation is an operation of choosing, in accordance with control information indicating whether the binary logic level being retained in the second data retention section DS2 is the first electric potential level or the second electric potential level, between an active state in which an input to the refresh output control section RS1 is loaded and supplied to the first data retention section DS1 as an output from the refresh output control section RS1 and a non-active state in which the refresh output control section RS1 is stopped from producing an output.

The second operation is an operation of, regardless of the control information, stopping the refresh output control section RS1 from producing an output.

The supply source VS1 supplies a set electric potential as an input to the refresh output control section RS1.

Next, transitions in state of the pixel memory MR are described with reference to (a) through (h) of FIG. 3, in each of which the first electric potential level is indicated by "H" as meaning High and the second electric potential level is indicated by "L" as meaning Low. Further, as for the arrangements of "H" and "L", one above the other, the upper letter indicates a state of transition of electric potential in a case where "H" is written to the pixel memory MR and the lower letter indicates a state of transition of electric potential in a case where "L" is written to the pixel memory MR.

In a data writing mode, first, a data writing period T1 is provided.

Figure 3:
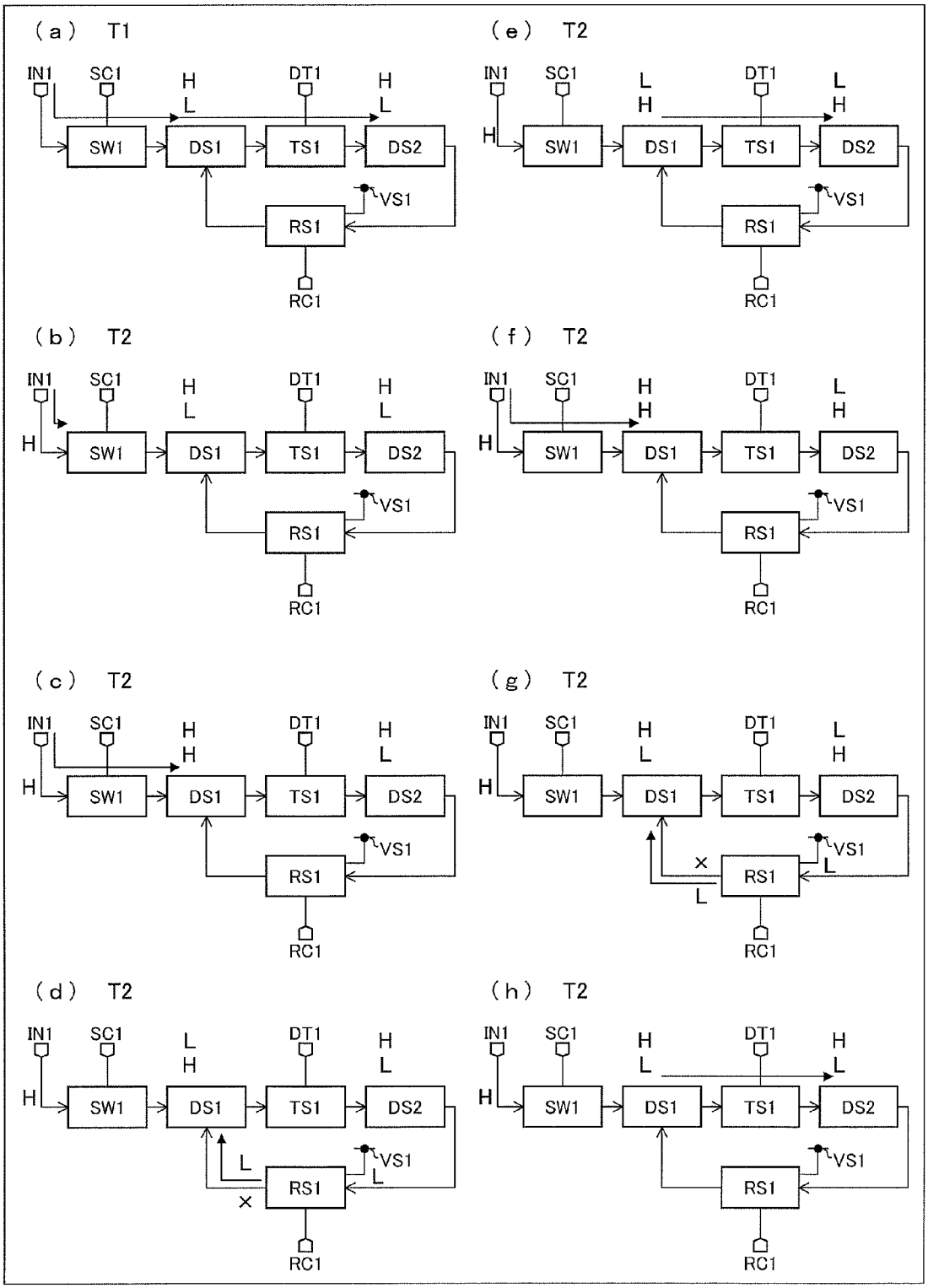
FIG. 3 is a set of diagrams (a) to (h) showing how the pixel memory of FIG. 2 operates.

In the writing period T1, as shown in (a) of FIG. 3, the switching circuit SW1 is brought into an ON state by the switching control line SC1, so that a binary logic level which corresponds to the data, which is expressed by the first or second electric potential level, and which is a target to be retained is inputted from the data input line IN1 via the switching circuit SW1 to the first data retention section DS1.

Once the binary logic level is inputted to the first data retention section DS1, the switching circuit SW1 is brought into an OFF state by the switching control line SC1. Further, in this case, the data transfer section TS1 is brought into an ON state, i.e., a state in which to carry out the transfer operation, so that the binary logic level inputted to the first data retention section DS1 is transferred from the first data retention section DS1 via the data transfer section TS1 to the second data retention section DS2 while being retained. Once the binary logic level is transferred to the second data retention section DS2, the data transfer section TS1 is brought into an OFF state, i.e., a state in which to carry out the non-transfer operation.

Further, a refresh period T2 (data retention period) is provided in succession to the writing period T1.

In the refresh period T2, as shown in (b) of FIG. 3, first, the demultiplexer 15 outputs the first electric potential level to the data input line IN1 in advance.

Then, as shown in (c) of FIG. 3, the switching circuit SW1 is brought into an ON state by the switching control line SC1, so that the first electric potential level is inputted from the data input line IN1 via the switching circuit SW1 to the first data retention section DS1. Once the first electric potential level is inputted to the first data retention section DS1, the switching circuit SW1 is brought into an OFF state by the switching control line SC1.

Next, as shown in (d) of FIG. 3, the refresh output control section RS1 is controlled by the refresh output control line RC1 to be in a state in which to carry out the first operation. The first operation of the refresh output control section RS1 varies according to the control information indicating whether the first or second electric potential level is retained as the binary logic level in the second data retention section DS2 in this case.

That is, in a case where the first electric potential level is being retained in the second data retention section DS2, the refresh output control section RS1 is brought into the active state by the transmission of first control information from the second data retention section DS2 to the refresh output control section RS1, the first control information indicating that the first electric potential level is being retained in the second data retention section DS2, thus carrying out an operation in which an input to the refresh output control section RS1 is loaded and supplied to the first data retention section DS1 as an output from the refresh output control section RS1. When the refresh output control section RS1 carries out this first operation, the supply source VS1 has its electric potential set so that the second electric potential level can be supplied as an input to the refresh output control section RS1 at least finally in the period during which the first control information is being transmitted to the refresh output control section RS1. In this case, the first data retention section DS1 retains the second electric potential level supplied from the refresh output control section RS1, in such a way that the second electric potential level is written over the binary logic level that has been retained until then.

Meanwhile, in a case where the second electric potential level is being retained in the second data retention section DS2, the refresh output control section RS1 is brought into the non-active state by the transmission of second control information from the second data retention section DS2 to the refresh output control section RS1, the second control information indicating that the second electric potential level is being retained in the second data retention section DS2, thus coming into a state (indicated by "x" in the drawing) in which to stop producing an output. In this case, the first data retention section DS1 continues to retain the first electric potential level that has been retained until then.

After that, the refresh output control section RS1 is controlled by the refresh output control line RC1 to be in a state in which to carry out the second operation.

Next, in the refresh period T2, as shown in (e) of FIG. 3, the data transfer section TS1 is brought by the data transfer control line DT1 into a state in which to carry out the transfer operation, so that the binary logic data that has been retained in the first data retention section DS1 until then is transferred from the first data retention section DS1 via the data transfer section TS1 to the second data retention section DS2 while being retained in the first data retention section DS1. Once the data is transferred from the first data retention section DS1 to the second data retention section DS2, the data transfer section TS1 is brought into an OFF state, i.e., a state in which to carry out the non-transfer operation.

Next, as shown in (f) of FIG. 3, the switching circuit SW1 is brought into an ON state by the switching control line SC1, so that the first electric potential level is inputted from the data input line IN1 via the switching circuit SW1 to the first data retention section DS1. Once the first electric potential level is inputted to the first data retention section DS1, the switching circuit SW1 is brought into an OFF state by the switching control line SC1.

Next, as shown in (g) of FIG. 3, the refresh output control section RS1 is controlled by the refresh output control line RC1 to be in a state in which to carry out the first operation. In a case where the first electric potential level is being retained in the second data retention section DS2, the refresh output control section RS1 is brought into the active state, thus carrying out an operation in which the second electric potential level that is supplied from the supply source VS1 is supplied to the first data retention section DS1. In this case, the first data retention section DS1 retains the second electric potential level supplied from the refresh output control section RS1, in such a way that the second electric potential level is written over the binary logic level that has been retained until then. Meanwhile, in a case where the second electric potential level is being retained in the second data retention section DS2, the refresh output control section RS1 is brought into the non-active state, thus coming into a state in which to stop producing an output. In this case, the first data retention section DS1 continues to retain the first electric potential level that has been retained until then. After that, the refresh output control section RS1 is controlled by the refresh output control line RC1 to be in a state in which to carry out the second operation, thus coming into a state in which to stop producing an output.

Next, as shown in (h) of FIG. 3, the data transfer section TS1 is brought by the data transfer control line DT1 into a state in which to carry out the transfer operation, so that the binary logic data that has been retained in the first data retention section DS1 until then is transferred from the first data retention section DS1 via the data transfer section TS1 to the second data retention section DS2 while being retained in the first data retention section DS1. Once the binary logic level is transferred from the first data retention section DS1 to the second data retention section DS2, the data transfer section TS1 is brought into an OFF state, i.e., a state in which to carry out the non-transfer operation.

The series of actions above allows the binary logic level written in the writing period T1 of (a) of FIG. 3 to be restored in the first and second data retention sections DS1 and DS2 in (h) of FIG. 3. Therefore, the data written in the writing period T1 is similarly restored even when the actions (a) through (h) of FIG. 3 any number of times after (h) of FIG. 3.

It should be noted here that in a case where the first electric potential level (which is High here) is written in the writing period T1, the first electric potential level is refreshed by being inverted once in each of (d) and (f) of FIG. 3, so that the first electric potential level is restored, and that in a case where the second electric potential level (which is Low here) is written in the writing period T1, the second electric potential level is refreshed by being inverted once in each of (c) and (g) of FIG. 3, so that the second electric potential level is restored.

It should be noted that in a case where the first electric potential level is Low and the second electric potential level is High, it is only necessary to invert the aforementioned operation logic.

The foregoing configuration, in which in the refresh period T2, the first electric potential level is supplied from the data input line IN1 to the first data retention section DS1 as shown in (c) and (f) of FIG. 3 and the second electric potential level is supplied by the refresh output control section RS1 from the supply source VS1 to the first data retention section DS1 as shown in (d) and (g) of FIG. 3, makes it unnecessary to provide an inverter, for example, to carry out the refresh operation.

Next, how such a pixel memory MR is configured and operates is described in concrete terms.

Figure 4:
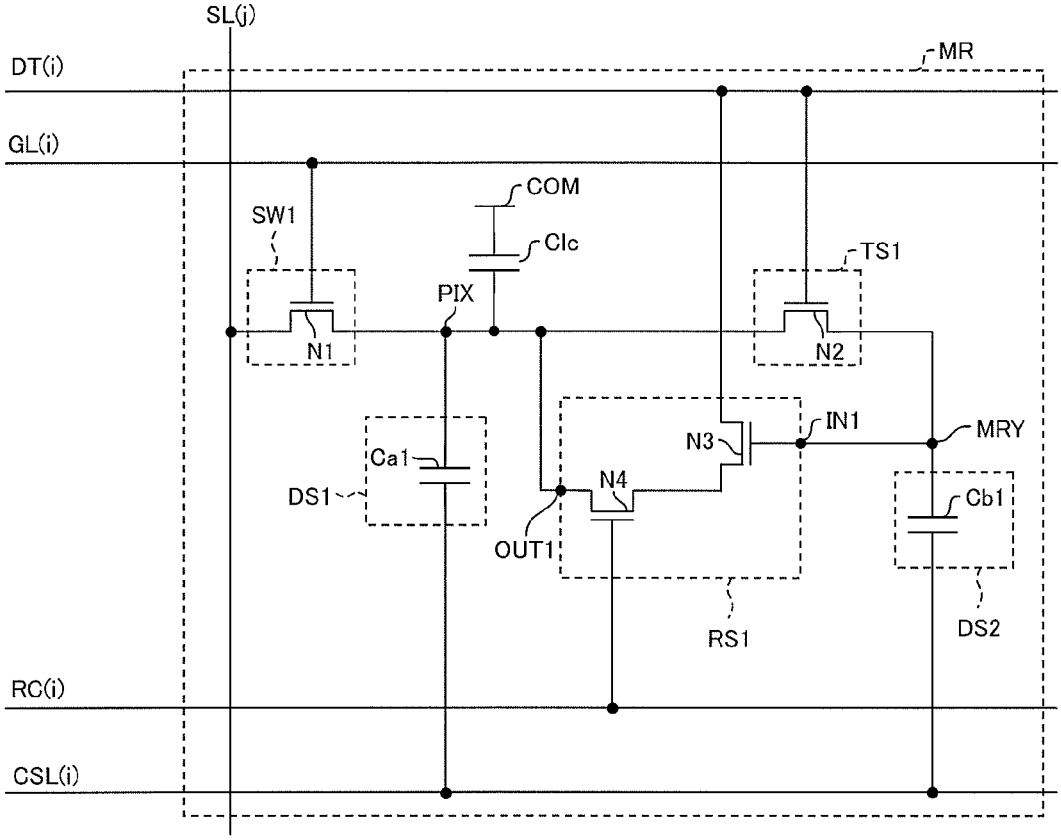
FIG. 4 is a circuit diagram showing a configuration of a pixel memory of a liquid crystal display device in Embodiment 1.

FIG. 4 shows, as an equivalent circuit, a configuration of a pixel memory MR (memory circuit) according to the present embodiment.

As mentioned above, the pixel memory MR includes a switching circuit SW1, a first data retention section DS1, a data transfer section TS1, a second data retention section DS2, and a refresh output control section RS1.

The switching circuit SW1 is constituted by a transistor N1 (first transistor), which is an N-channel TFT. The first data retention section DS1 is constituted by a capacitor Ca1 (second retention capacitor). The data transfer section TS1 is constituted by a transistor N2 (second transistor), which is an N-channel TFT serving as a transfer element. The second data retention section DS2 is constituted by a capacitor Cb1 (first retention capacitor). The refresh output control section RS1 is constituted by a transistor N3 (third transistor), which is an N-channel TFT, and a transistor N4 (fourth transistor), which is an N-channel TFT. The capacitor Ca1 is greater in capacitance value than the capacitor Cb1.

That is, in FIG. 4, it is preferable that each of the transistors that constitute the pixel memory MR be constituted by an N-channel TFT (field-effect transistor). This makes it easier for the pixel memory MR to be fabricated into amorphous silicon. It should be noted that the present pixel memory MR may alternatively be constituted by P-channel TFTs.

Further, as signal lines via which each pixel memory MR is driven, the aforementioned gate lines GL(i), data transfer control lines DT(i), refresh output control lines RC(i), source lines SL(j), and CS lines CSL(i) are provided in the liquid crystal display device 1.

It should be noted that one drain/source terminal (one conducting terminal) of such a field-effect transistor as those described above is referred to as "first drain/source terminal, and the other drain/source terminal (other conducting terminal) thereof is referred to as "second drain/source terminal". The same applies to the other embodiments. It should also be noted that a voltage that brings a transistor into an ON state when applied to the gate terminal (control terminal) is referred to as "ON voltage (ON level), and a voltage that brings a transistor into an OFF state when applied to the gate terminal is referred to as "OFF voltage (OFF level). In the case of an N-channel transistor, the high voltage serves as an ON voltage (that is, the high level serves as an ON level), and the low voltage serves as an OFF voltage (that is, the low level serves as an OFF level). In the case of a P-channel transistor, the reverse is true.

The transistor N1 has its gate terminal (control terminal) connected to a gate line GL(i), its first source/drain terminal connected to a source line SL(j), and its second source/drain terminal connected to a node PIX (pixel electrode), which is one end of the capacitor Ca1. The other of the capacitor Ca1 is connected to a CS line CSL(i). When the transistor N1 is in an ON state, the switching circuit SW1 is in a conductive state, and when the transistor N1 is in an OFF state, the switching circuit SW1 is in a disconnected state.

The transistor N2 has its gate terminal connected to a data transfer control line DT(i), its first source/drain terminal connected to the node PIX, and its second source/drain terminal connected to a node MRY (retention electrode), which is one end of the capacitor Cb1. The other of the capacitor Cb1 is connected to the CS line CSL(i). When the transistor N2 is in an ON state, the data transfer section TS1 is in a state in which to carry out the transfer operation, and when the transistor N2 is in an OFF state, the data transfer section TS1 is in a state in which to carry out the non-transfer operation.

The transistor N3 has its gate terminal connected to the node MRY as an input section IN1 of the refresh output control section RS1, its first drain/source terminal connected to the data transfer control line DT(i), and its second drain/source terminal connected to the first drain/source terminal of the transistor N4. The transistor N4 has its gate terminal connected to a refresh output control line RC(i) and its second drain/source terminal connected to the node PIX as an output section OUT1 of the refresh output control section RS1. That is, the transistors N3 and N4 are connected in series to each other so that the transistor N3 is located between the data transfer control line DT(i) and the output of the refresh output control section RS1 so as to be closer to the data transfer control line DT(i). It should be noted that the transistors N3 and N4 may swap their connecting locations with each other, and need only be connected in series to each other between the data transfer control line DT(i) and the output of the refresh output control section RS1.

When the transistor N4 is in an ON state, the refresh output control section RS1 is controlled to be in a state in which to carry out the first operation, and when the transistor N4 is in an OFF state, the refresh output control section RS1 is controlled to be in a state in which to carry out the second operation. Since the transistor N3 is an N-channel TFT, the control information in accordance with which the refresh output control section RS1 comes into the active state when carrying out the first operation, i.e., the active level is High, and the control information in accordance with which the refresh output control section RS1 comes into the non-active state when carrying out the first operation, i.e., the non-active level is Low.

It should be noted that a liquid crystal capacitor Clc via which a display is carried out is connected between the node PIX (pixel electrode) and a counter electrode (common electrode) COM.

Next, how a pixel memory MR thus configured operates is described.

EXAMPLES OF REFERENCE OPERATION

Figure 5:
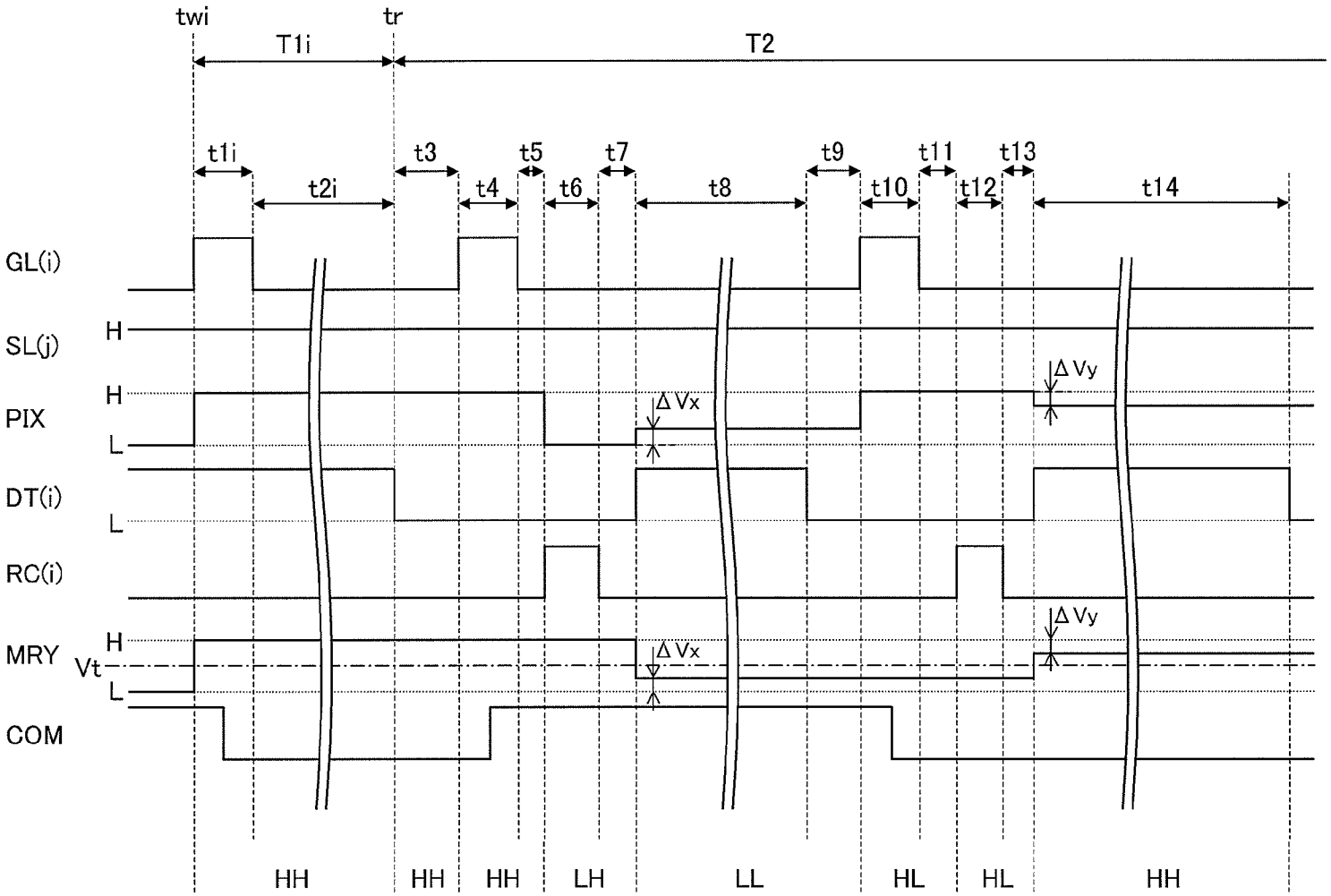
FIG. 5 is a signal chart for explaining how the pixel memory of FIG. 4 operates in a case where there is no change in CS electric potential.
Figure 6:
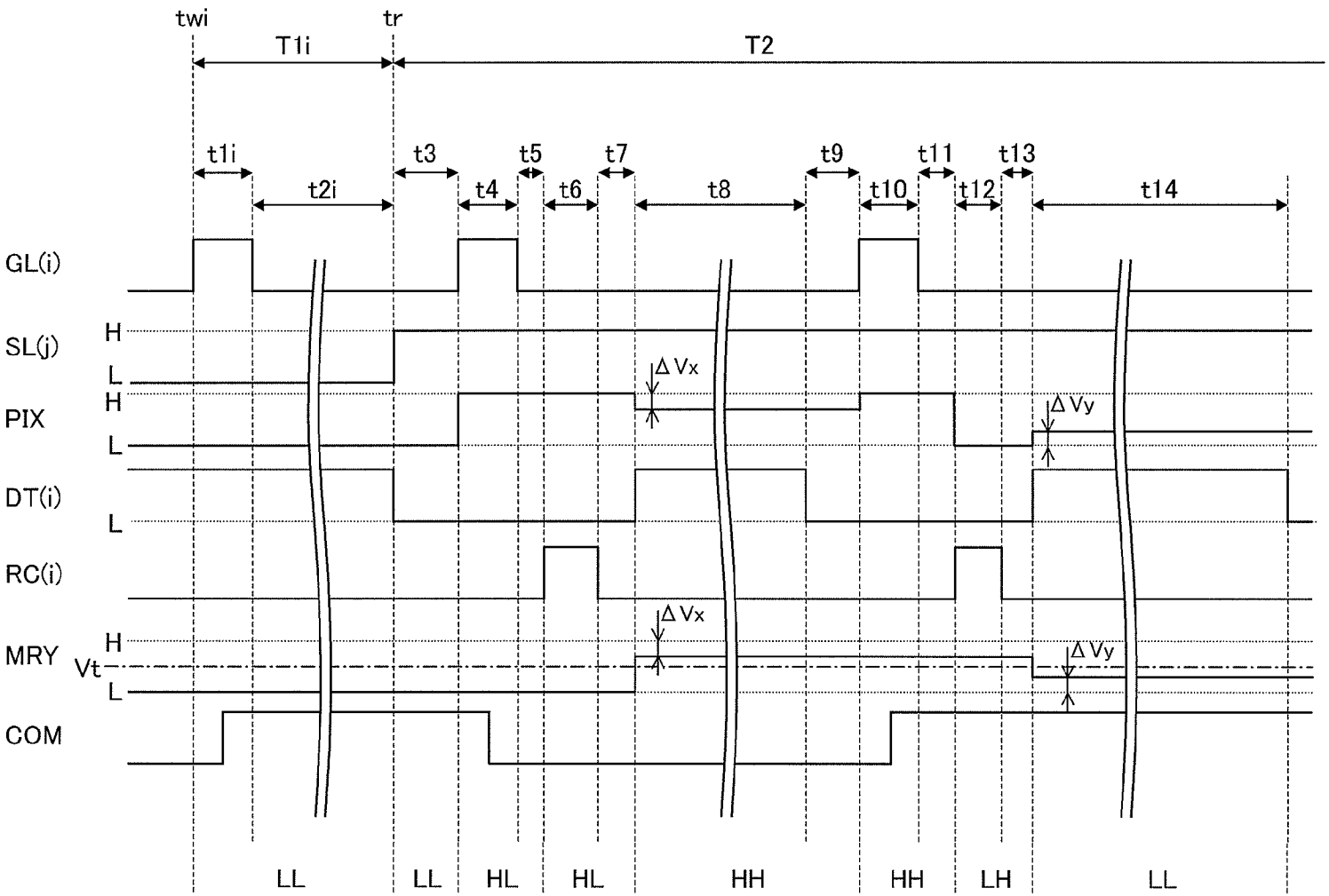
FIG. 6 is a signal chart for explaining how the pixel memory of FIG. 4 operates in a case where there is no change in CS electric potential.

FIGS. 5 and 6 show, for reference, how a pixel memory MR in the memory operation mode operates in a case where there is no change in CS electric potential. In the liquid crystal display device 1, each of the rows of the pixel array 6 is driven (scanned) in a line-sequential manner. Therefore, the writing period T1 is determined for each row, and the writing period T1 for the ith row is denoted by T1*i*. FIG. 5 shows a case where "1"=High is written as first data in the writing period T1*i*, and FIG. 6 shows a case where "0"=Low is written as second data in the writing period T1*i*. In the lower part of each of FIGS. 5 and 6, the electric potential at the node PIX (on the left side) and the electric potential at the node MRY (on the right side) are written side-by-side for each of the periods that correspond to (a) through (h) of FIG. 3.

In FIG. 5, a binary-level electric potential composed of High (active level) and Low (non-active level) is applied to the gate line GL(i), the data transfer control line DT(i), and the refresh output control line RC(i) from the gate driver/CS driver 2 or the control signal buffer circuit 13. The High and Low electric potentials of the binary level may be individually set for each separate one of the lines. A binary logic level composed of High that is lower than the High electric potential of the gate line GL(i) and Low is outputted to the source line SL(j) from the driving signal generating circuit/picture signal generating circuit 4 via the demultiplexer 5. The High electric potential of the data transfer control line DT(i) is equal to either the High electric potential of the source line SL(j) or the High electric potential of the gate line GL(i), and the Low electric potential of the data transfer control line DT(i) is equal to the Low electric potential of the binary logic level. It is assumed that the High electric potential of the source line SL(j) is a H level and the Low electric potential of the data transfer control line DT(i) is a L level. Further, in the reference operations of FIGS. 5 and 6, an electric potential (CS electric potential) that is supplied by the CS line CSL(i) is constant. It should be noted that it is assumed, in FIGS. 5 and 6, that a threshold level (threshold voltage) Vt at which the transistor N3 is turned on is an electric potential that falls in the center of the range from the H level to the L level.

For the memory operation mode, there exist the writing period T1*i* and the refresh period T2. The writing period T1*i* starts at a time point twi determined for each row. The refresh period T2 starts at a time point tr for all rows together after completion of writing of data to the pixel memories MR of all rows. The writing period T1 is a period during which to write data that is to be retained in each pixel memory MR, and is composed of periods t1*i* and t2*i* that come one after the other in succession. The refresh period T2 is a period during which to retain the data written to each pixel memory MR, while refreshing the data, and has periods t3 to t14 that come one after the other in succession.

In the period t1*i* of the writing period T1*i*, both the gate line GL(i) and the data transfer control line DT(i) have their electric potentials at High, with the refresh output control line RC(i) having its electric potential at Low. This brings the transistors N1 and N2 into an ON state, thus bringing the switching circuit SW1 into a conductive state and the data transfer section TS1 into a state in which to carry out the transfer operation, so that the first electric potential level (which is High here) supplied to the source line SL(j) is written to the node PIX. In the period t2*i*, the gate line GL(i) has its electric potential changed to Low, while the data transfer control line DT(i) has its electric potential kept at High, with the refresh output control line RC(i) having its electric potential at Low. This brings the transistor N1 into an OFF state, thus bringing the switching circuit SW1 into a disconnected state. Further, since the transistor N2 continues to be in an ON state, the data transfer section TS1 continues to be in a state in which to carry out the transfer operation. Therefore, the first electric potential level is transferred from the node PIX to the node MRY, and the nodes PIX and MRY are disconnected from the source line SL(j). This process corresponds to the state shown in (a) of FIG. 3.

Next, the refresh period T2 starts. In the refresh period T2, the source line SL(j) has its electric potential (Vsig) at High, which is the first electric potential level. Further, the driving to be described below is carried out for all of those gate lines GL(i), data transfer control lines DT(i), and refresh output control lines RC(i) which fall in the range of $1 \leq i \leq n$. That is, the refresh operation is carried out for all pixel memories MR together (such a refresh operation being hereinafter referred to as "total refresh operation").

In the period t3 of the refresh period T2, the gate line GL(i), the data transfer control line DT(i), and the refresh output control line RC(i) have their electric potentials at Low. This brings the transistor N2 into an OFF state, thus bringing the data transfer section TS1 into a state in which to carry out the non-transfer operation, so that the nodes PIX and MRY get disconnected from each other. Both the nodes PIX and MRY retain High. This process corresponds to the state shown in (b) of FIG. 3.

In the period t4, the gate line GL(i) has its electric potential changed to High, and the data transfer control line DT(i) and the refresh output control line RC(i) have their electric potentials kept at Low. This brings the transistor N1 into an ON state, thus bringing the switching circuit SW1 into a conductive state, so that the High electric potential is written again to the node PIX from the source line SL(j).

In the period t5, the gate line GL(i) has its electric potential changed to Low, and the data transfer control line DT(i) and the refresh output control line RC(i) have their electric potentials kept at Low. This brings the transistor N1 into an OFF state, thus bringing the switching circuit SW1 into a disconnected state, so that the node PIX gets disconnected from the source line SL(j) and retains High.

The processes from the period t4 to the period t5 correspond to the state shown in (c) of FIG. 3.

In the period t6, the gate line GL(i) and the data transfer control line DT(i) have their electric potentials kept at Low, and the refresh output control line RC(i) has its electric potential changed to High. This brings the transistor N4 into an ON state, so that the refresh output control section RS1 carries out the first operation. Further, since the electric potential of the node MRY is High, the transistor N3 is in an ON state. This brings the refresh output control section RS1 into the active state, so that the Low electric potential is supplied to the node PIX from the data transfer control line DT(i) via the transistors N3 and N4. The data transfer control line DT(i) also serves as the supply source VS1 in FIG. 2.

In the period t7, the gate line GL(i) and the data transfer control line DT(i) have their electric potentials kept at Low, and the refresh output control line RC(i) has its electric potential changed to Low. This brings the transistor N4 into an OFF state, thus bringing the refresh output control section RS1 into a state in which to carry out the second operation, so that the node PIX gets disconnected from the data transfer control line DT(i) and retains Low.

The processes from the period t6 to the period t7 correspond to the state shown in (d) of FIG. 3.

In the period t8, the gate line GL(i) and the refresh output control line RC(i) have their electric potentials kept at Low, and the data transfer control line DT(i) has its electric potential changed to High. This brings the transistor N2 into an ON state, thus bringing the data transfer section TS1 into a state in which to carry out the transfer operation. In this case, a charge transfer occurs between the capacitors Ca1 and Cb1, so that both the nodes PIX and MRY come to have their electric potentials at Low. The electric potential of the node PIX rises by a slight voltage $\Delta Vx$ from the L level due to the transfer of positive charge from the capacitor Cb1 to the capacitor Ca1 via the transistor N2, but is still lower than the electric potential that is in the center of the range from the L level to the H level. Further, the electric potential of the node MRY becomes $(L+\Delta Vx)$, which is equal to the electric potential of the node PIX.

The period t8 is a period during which refreshed binary logic data is retained by both the first and second data retention sections DS1 and DS2 connected to each other via the data transfer section TS1, and can be set long. The same applies to the subsequent embodiments.

In the period t9, the gate line GL(i) and the refresh output control line RC(i) have their electric potentials kept at Low, and the data transfer control line DT(i) has its electric potential changed to Low. This brings the transistor N2 into an OFF state, thus bringing the data transfer section TS1 into a state in which to carry out the non-transfer operation, so that the nodes PIX and MRY get disconnected from each other. Both the nodes PIX and MRY retain Low $(L+\Delta Vx)$.

The processes from the period t8 to the period t9 correspond to the state shown in (e) of FIG. 3.

In the period t10, the gate line GL(i) has its electric potential changed to High, and the data transfer control line DT(i) and the refresh output control line RC(i) have their electric potentials kept at Low. This brings the transistor N1 into an ON state, thus bringing the switching circuit SW1 into a conductive state, so that the High potential is written again to the node PIX from the source line SL(j).

In the period t11, the gate line GL(i) has its electric potential changed to Low, and the data transfer control line DT(i) and the refresh output control line RC(i) have their electric potentials kept at Low. This brings the transistor N1 into an OFF state, thus bringing the switching circuit SW1 into a disconnected state, so that the node PIX gets disconnected from the source line SL(j) and retains High.

The processes from the period t10 to the period t11 correspond to the state shown in (f) of FIG. 3.

In the period t12, the gate line GL(i) and the data transfer control line DT(i) have their electric potentials kept at Low, and the refresh output control line RC(i) has its electric potential changed to High. This brings the transistor N4 into an ON state, thus bringing the refresh output control section RS1 into a state in which to carry out the first operation. Further, since the electric potential of the node MRY is Low, the transistor N3 is in an OFF state. This brings the refresh output control section RS1 into the non-active state, in which the refresh output control section RS1 stops producing an output. Therefore, the node PIX keeps retaining High.

In the period t13, the gate line GL(i) and the data transfer control line DT(i) have their electric potentials kept at Low, and the refresh output control line RC(i) has its electric potential changed to Low. This brings the transistor N4 into an OFF state, thus bringing the refresh output control section RS1 into a state in which to carry out the second operation, so that the node PIX retains High.

The processes from the period t12 to the period t13 correspond to the state shown in (g) of FIG. 3.

In the period t14, the gate line GL(i) and the refresh output control line RC(i) have their electric potentials kept at Low, and the data transfer control line DT(i) has its electric potential changed to High. This brings the transistor N2 into an ON state, thus bringing the data transfer section TS1 into a state in which to carry out the transfer operation. In this case, a charge transfer occurs between the capacitors Ca1 and Cb1, so that both the nodes PIX and MRY come to have their electric potentials at High. The electric potential of the node PIX drops by a slight voltage ΔVy from the H level due to the transfer of positive charge from the capacitor Ca1 to the capacitor Cb1 via the transistor N2, but is still higher than the electric potential that is in the center of the range from the L level to the H level. Further, the electric potential of the node MRY becomes (H−ΔVy), which is equal to the electric potential of the node PIX.

The process during the period t14 corresponds to the state shown in (h) of FIG. 3.

The period t14 is a period during which refreshed binary logic data is retained by both the first and second data retention sections DS1 and DS2 connected to each other via the data transfer section TS1, and can be set long. The same applies to the subsequent embodiments.

With these actions, the electric potential of the node PIX is High during the periods t1*i* to t5 and the periods t10 to t14 and Low during the periods t6 to t9, and the electric potential of the node MRY is High during the periods t1*i* to t7 and the period t14 and Low during the periods t8 to t13.

After this, in a case where the refresh period T2 continues, the actions from the periods t3 to t14 are repeated. In a case where new data is written, the total refresh operation mode is canceled by finishing the refresh period T2.

It should be noted that it is also possible to set the periods t7 and t13 long, instead of the periods t8 and t14.

This is the end of the explanation given with reference to FIG. 5.

It should be noted that a command to carry out the total refresh operation may produced in accordance with clock signals internally generated by an oscillator or the like, instead of signals from an outside source. This eliminates the need for an external system to input a refresh command at regular time intervals, thus bringing about an advantage of making flexible system architecture possible. Dynamic memory circuits achieved by using the pixel memories MR eliminates the need for the total refresh operation to be carried out by executing the scan for each gate line GL(i), and allows the total refresh operation to be carried out for the whole array. This makes it possible to reduce peripheral circuitry that is needed for commonly-used conventional dynamic memory circuits to refresh the electric potentials of the source lines SL(j) while reading them out destructively.

The following gives an explanation with reference to FIG. 6.

In FIG. 6, where Low is written to each pixel memory MR as the second electric potential level in the writing period T1*i*, changes in electric potential of the gate line GL(i), the data transfer control line DT(i), and the refresh output control lines RC(i) from one period to another are the same as those of FIG. 5, except that the electric potential of the source line SL(j) during the writing period T1*i* is Low.

With this, the electric potential of the node PIX is Low during the periods t1*i* to t3 and the periods t12 to t14 and High during the periods t4 to t11, and the electric potential of the node MRY is Low during the periods t1*i* to t7 and the period t14 and High during the periods t8 to t13.

It should be noted that while (a) through (h) of FIG. 3 show transitions in state of a pixel memory MR, the steps of operation of a pixel memory MR in FIGS. 5 and 6 can be classified as follows:

(1) First Step (Periods t1*i* to t2*i* (Writing Period T1*i*))

In the first step, a binary logic level corresponding to data is written to each pixel memory MR by causing the switching circuit SW1 to be conductive with the binary logic level supplied from the driving signal generating circuit/picture signal generating circuit 4 to the source line SL(j) and with the refresh output control section RS1 caused to carry out the second operation, and the transfer operation is carried out by the data transfer section TS1 with the binary logic level written to the pixel memory MR and with the refresh output control section RS1 caused to carry out the second operation.

(2) Second Step (Each of the Periods t3 to t4 and t9 to t10)

In the second step, which follows the first step, a binary logic level identical to a level corresponding to the control information that brings the refresh output control section RS1 into the active state is inputted to the first data retention section DS1 via the source line SL(j) with the refresh output control section RS1 caused to carry out the second operation and with the data transfer section TS1 caused to carry out the non-transfer operation.

(3) Third Step (Each of the Periods t5 to t6 and t11 to t12)

In the third step, which follows the second step, the first operation is carried out by the refresh output control section RS1 with the switching circuit SW1 disconnected and with the data transfer section TS1 caused to carry out the non-transfer operation, and on completion of the first operation, a binary logic level that is an inversion of a level corresponding to the control information that brings the refresh output control section 51 into the active level has been supplied as an input from the supply source VS1 to the refresh output control section RS1.

(4) Fourth Step (Each of the Periods t7 to t8 and t13 to t14)

In the fourth step, which follows the third step, the transfer operation is carried out by the data transfer section TS1 with the switching circuit SW1 disconnected and with the refresh output control section RS1 caused to carry out the second operation.

Moreover, the writing operation, as a whole, is an operation of first executing the first step and then executing, in succession to the first step, a series of actions (periods t3 to t8) from the start of the second step to the completion of the fourth step one or more times.

It should be noted here that the liquid crystal capacitor Clc of FIG. 4 is a capacitor formed by placing a liquid crystal layer between the node PIX and the common electrode COM. That is, the node PIX is connected to the pixel electrode. In this case, the capacitor Ca1 also functions as a retention capacitor of the pixel 40. Further, the transistor N1, which constitutes the switching circuit SW1, also functions as a selection element of the pixel 40. The common electrode (counter electrode) COM is provided on a common electrode substrate facing a matrix substrate on which the circuit of FIG. 4 is formed. However, the common electrode COM may be on the same substrate as the matrix substrate.

With the pixel memory MR in the multi-tone display mode (normal operation mode), it is only necessary to carry out a display by supplying the pixel 40 with a data signal that is larger in number of electric potential levels than a binary level, with the refresh output control section RS1 prevented from carrying out the first operation, in which the refresh output control section RS1 is in the active state. In the multi-tone display mode, only the capacitor Ca1 may be allowed to function as a retention capacitor by fixing the electric potential of the data transfer control line DT(i) at Low, the capacitors Ca1 and Cb1 may be allowed to function together as a retention capacitor by fixing the electric potential of the data transfer control line DT(i) at High. Further, either by holding the transistor N4 in an OFF state by fixing the electric potential of the refresh output control section RC(i) at Low, or by setting the electric potential of the data transfer control line DT(i) so high that the transistor N3 is brought into an OFF state, the electric potential of the data transfer control line DT(i) can be prevented from affecting the display tone of the liquid crystal capacitor Clc as determined by the change stored in the first data retention section DS1. This makes it possible to achieve display performance identical to that of a liquid crystal display device that does not have a memory function.

In the memory operation mode, on the other hand, a display according to the electric potential of the first data retention section can be carried out. Liquid crystals cause burn-in and/or deteriorate unless their polarity is inverted in an AC manner. This makes it necessary to invert the polarity while equalizing the absolute values of voltages to be applied to the liquid crystals, regardless of whether the liquid crystals are on (white display) or off (black display). For this reason, the electric potential Vcom of the counter electrode COM is set so that the potential difference between the electric potential of the pixel during positive polarity driving and the counter electric potential Vcom and the potential difference between the electric potential of the pixel during negative polarity driving and the counter electric potential Vcom are equal (optimum counter electric potential).

It should be noted that in FIGS. 5 and 6, the driving is carried out such that the potential of the common electrode COM is inverted from High to Low or vice versa every time the transistor N1 is brought into an ON state. Let it be assumed here that the High electric potential of the common electrode COM is equal to the High electric potential of the binary logic level and the Low electric potential of the common electrode COM is equal to the Low electric potential of the binary logic level. Then, when the electric potential of the common electrode COM is Low, a black display of a positive polarity results if the electric potential of the node PIX is Low or a white display of a positive polarity results if the electric potential of the node PIX is High; and when the electric potential of the common electrode COM is High, a white display of a negative polarity results if the electric potential of the node PIX is Low or a black display of a negative polarity results if the electric potential of the node PIX is High. Therefore, every time the electric potential of the node PIX is refreshed, the liquid crystals are driven so that the orientation of the voltage that is applied to the liquid crystals is inverted while the display tone is substantially maintained. This allows such AC driving of the liquid crystals that the positive and negative effective values of the voltage that is applied to the liquid crystals are uniform. Alternatively, such a configuration is also possible that the electric potentials (binary values) of the common electrode COM are both larger than the minimum value of the data signal potential and smaller than the maximum value of the data signal potential.

However, in the cases of reference operation where the CS electric potential is constant, as shown in FIGS. 5 and 6, the threshold level Vt at which the transistor N3 is turned on must satisfy a characteristic condition ($L+\Delta Vx<Vt<H-\Delta Vx$) so that the operation is just normal regardless of whether High is written to the pixel (FIG. 5) or Low is written to the pixel (FIG. 6). It should be noted that $\Delta Vy$ is smaller than $\Delta Vx$. For this reason, in a case where there are variations in characteristic of the transistor N3 so that the threshold level Vt of the transistor N3 of each of some of the pixel memories MR does not satisfy the characteristic condition, the transistor N3 does not carry out the desired operation in the period t6 or t12, so that the electric potentials of the nodes PIX and MRY are no longer inverted normally.

Figure 7:
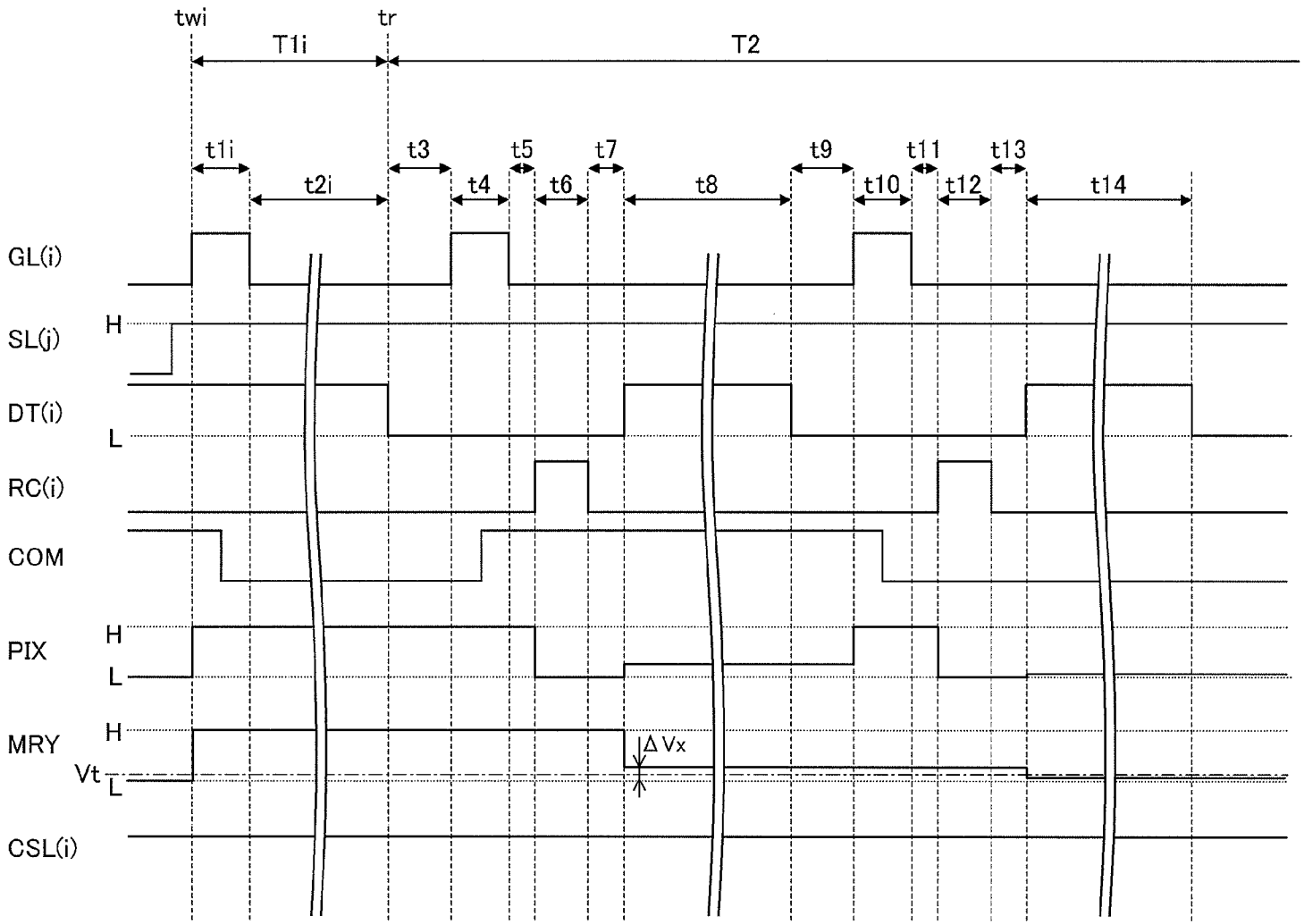
FIG. 7 is a signal chart for explaining how the pixel memory of FIG. 4 operates in a case where there occurs a malfunction.

FIG. 7 is a signal chart corresponding to FIG. 5, and shows, for reference, the occurrence of a malfunction in a pixel memory MR in a case where the CS electric potential is constant and the threshold level Vt of the transistor N3 is low. Actions that are similar to those explained in FIG. 5 are not explained here.

In the period t8, the gate line GL(i) and the refresh output control line RC(i) have their electric potentials kept at Low, and the data transfer control line DT(i) has its electric potential changed to High. This brings the transistor N2 into an ON state, thus bringing the data transfer section TS1 into a state in which to carry out the transfer operation. In this case, a charge transfer occurs between the capacitors Ca1 and Cb1, so that the electric potential of the node MRY drops. The electric potential of the node PIX rises by a slight voltage $\Delta Vx$ from the L level due to the transfer of positive charge from the capacitor Cb1 to the capacitor Ca1 via the transistor N2. Further, the electric potential of the node MRY becomes ($L+\Delta Vx$), which is equal to the electric potential of the node PIX. In a case where the threshold level Vt of the transistor N3 is low, the electric potential ($L+\Delta Vx$) of the node MRY undesirably exceeds the threshold level Vt of the transistor N3.

In the period t12, the gate line GL(i) and the data transfer control line DT(i) have their electric potentials kept at Low, and the refresh output control line RC(i) has its electric potential changed to High. This brings the transistor N4 into an ON state, thus bringing the refresh output control section RS1 into a state in which to carry out the first operation. Further, since the electric potential ($L+\Delta Vx$) of the node MRY is higher than the threshold level Vt of the transistor N3, the transistor N3 is in an ON state. This brings the refresh output control section RS1 into the active state, so that the Low potential is supplied from the data transfer control line DT(i) via the transistors N3 and N4 to the node PIX. In this case, the electric potential of the node PIX is undesirably inverted at an unexpected timing, which results in a deterioration of the display in the subsequent pixels.

Figure 8:
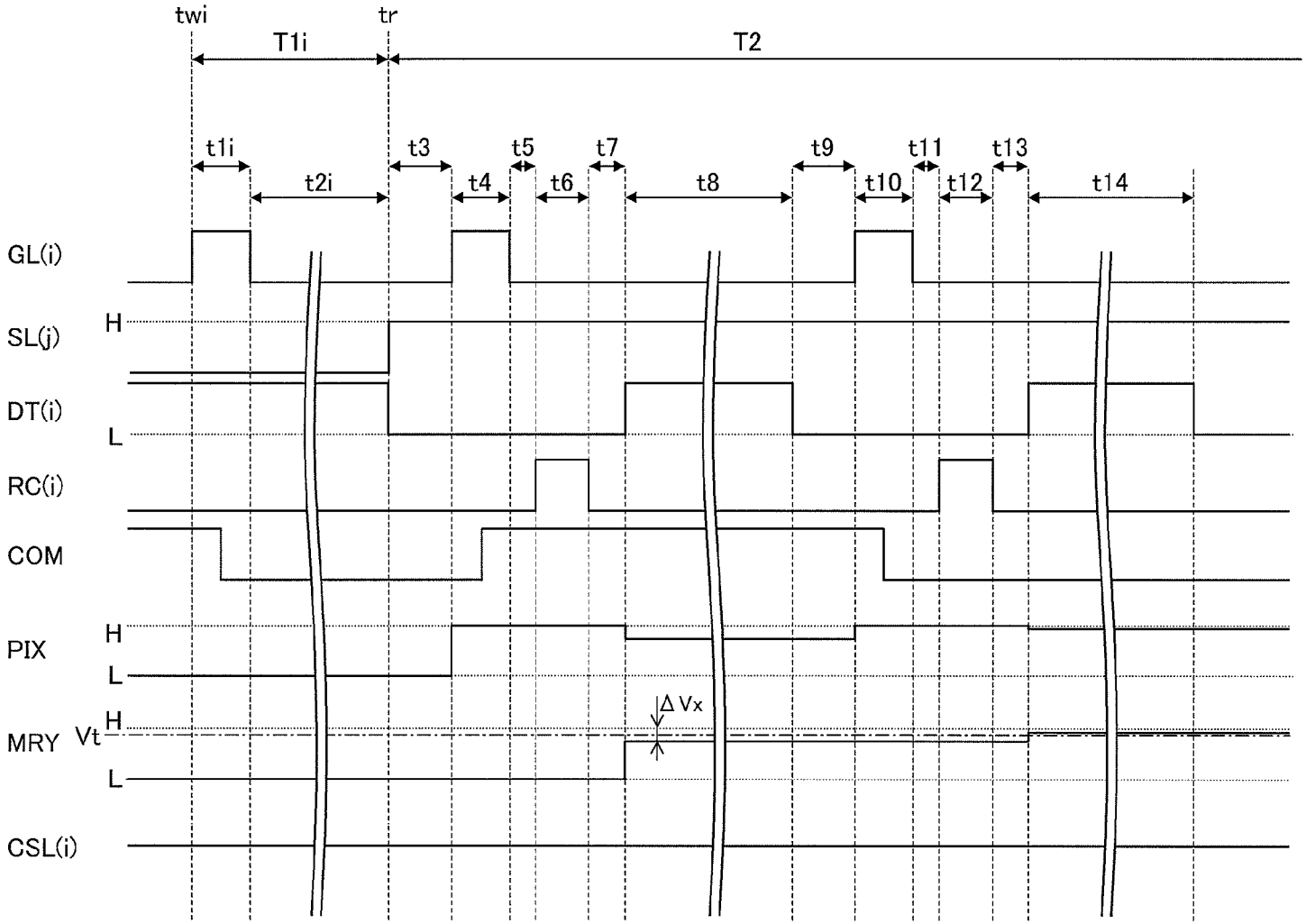
FIG. 8 is a signal chart for explaining how the pixel memory of FIG. 4 operates in a case where there occurs a malfunction.

FIG. 8 is a signal chart corresponding to FIG. 6, and shows, for reference, the occurrence of a malfunction in a pixel memory MR in a case where the CS electric potential is constant and the threshold level Vt of the transistor N3 is high. Actions that are similar to those explained in FIG. 6 are not explained here.

In the period t8, the gate line GL(i) and the refresh output control line RC(i) have their electric potentials kept at Low, and the data transfer control line DT(i) has its electric potential changed to High. This brings the transistor N2 into an ON state, thus bringing the data transfer section TS1 into a state in which to carry out the transfer operation. In this case, a charge transfer occurs between the capacitors Ca1 and Cb1, so that the electric potential of the node MRY rises. The electric potential of the node PIX drops by a slight voltage $\Delta Vx$ from the H level due to the transfer of positive charge from the capacitor Cb1 to the capacitor Ca1 via the transistor N2. Further, the electric potential of the node MRY becomes ($H-\Delta Vx$), which is equal to the electric potential of the node PIX. In a case where the threshold level Vt of the transistor N3 is high, the electric potential ($H-\Delta Vx$) of the node MRY undesirably falls short of the threshold level Vt of the transistor N3.

In the period t12, the gate line GL(i) and the data transfer control line DT(i) have their electric potentials kept at Low, and the refresh output control line RC(i) has its electric potential changed to High. This brings the transistor N4 into an ON state, thus bringing the refresh output control section RS1 into a state in which to carry out the first operation. Further, since the electric potential ($H-\Delta Vx$) of the node MRY is lower than the threshold level Vt of the transistor N3, the transistor N3 is in an OFF state. This brings the refresh output control section RS1 into the non-active state, in which the refresh output control section RS1 stops producing an output. Therefore, the node PIX keeps retaining High. In this case, the electric potential of the node PIX is not inverted at the desired timing, which results in a deterioration of the display in the subsequent pixels.

Example 1 of Operation of Embodiment 1

In order to prevent such a malfunction of a pixel memory MR, the liquid crystal display device of the present embodiment, in addition to the foregoing configuration, corrects the electric potential of the node MRY by adjusting (controlling) the electric potential (CS electric potential) that is supplied to the CS line CSL(i). This enlarges the range of threshold levels Vt in which the transistor N3 normally operates, thus preventing a malfunction of the pixel memory MR.

Figure 9:
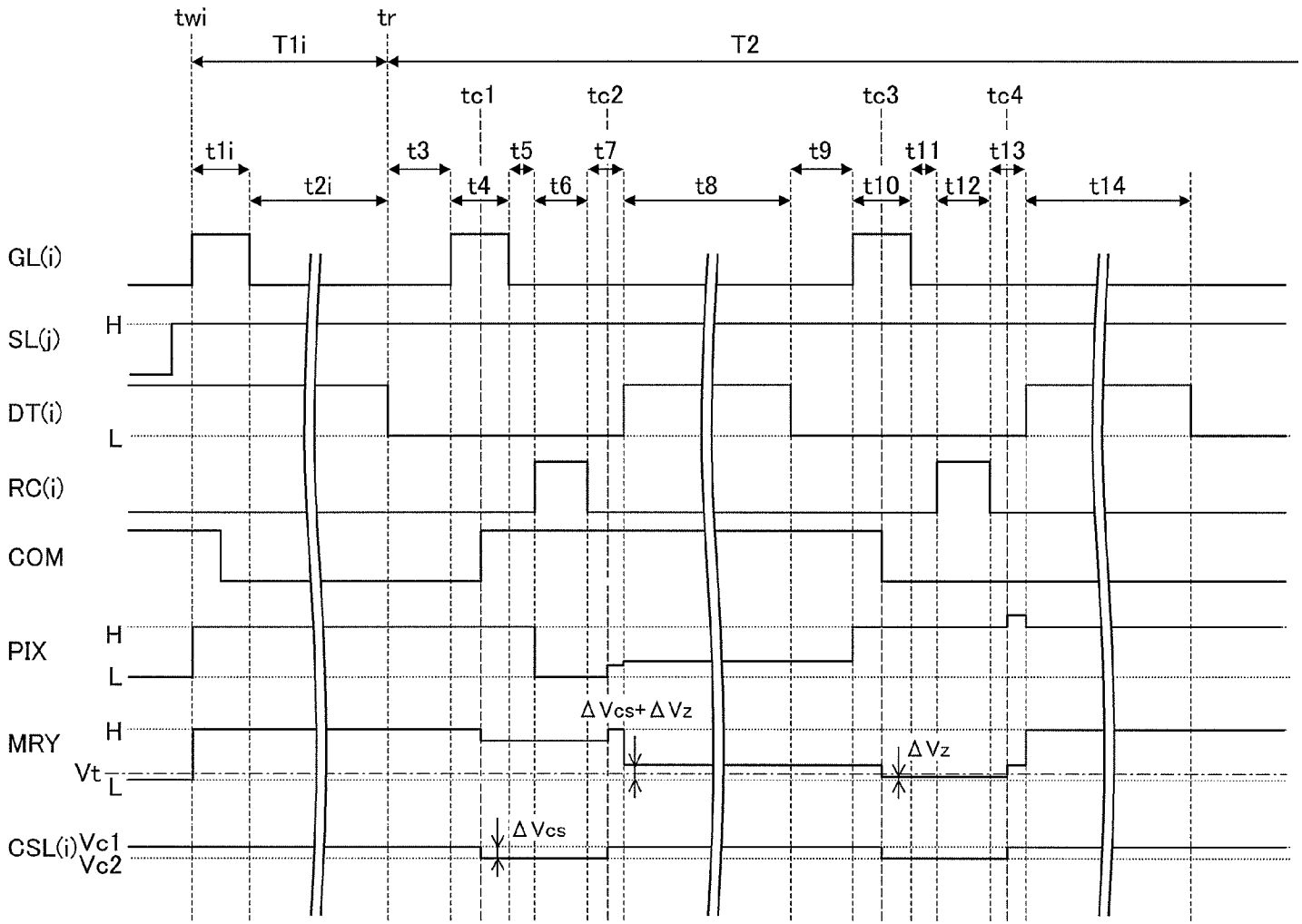
FIG. 9 is a signal chart for explaining the operation of Example 1 of Operation, which corresponds to a pixel memory of the liquid crystal display device of Embodiment 1.

FIG. 9 is a signal chart showing an operation that corresponds to a pixel memory (see FIG. 4) of the liquid crystal display device 1 of the present embodiment. In the liquid crystal display device 1, each of the rows of the pixel array 6 is driven (scanned) in a line-sequential manner. FIG. 9 shows a case where "1"=High is written as first data in the writing period T1*i*.

In the liquid crystal display device 1 of the present embodiment, a binary-level electric potential composed of High (active level) and Low (non-active level) is applied to the gate line GL(i), the data transfer control line DT(i), and the refresh output control line RC(i) from the gate driver/CS driver 2 or the control signal buffer circuit 13. The High and Low electric potentials of the binary level may be individually set for each separate one of the lines. A binary logic level composed of High that is lower than the High electric potential of the gate line GL(i) and Low is outputted to the source line SL(j) from the driving signal generating circuit/picture signal generating circuit 4 via the demultiplexer 5. The High electric potential of the data transfer control line DT(i) is equal to either the High electric potential of the source line SL(j) or the High electric potential of the gate line GL(i), and the Low electric potential of the data transfer control line DT(i) is equal to the Low electric potential of the binary logic level. It is assumed that the High electric potential of the source line SL(j) is a H level and the Low electric potential of the data transfer control line DT(i) is a L level. Further, in the operation of FIG. 9, the CS line CSL(i) selectively supplies a first level (Vc1; H level) or a second level (Vc2; L level) as the CS electric potential. It should be noted that it is assumed, in FIG. 9, that a threshold level Vt at which the transistor N3 is turned on is lower than an electric potential that falls in the center of the range from the H level to the L level.

The operation during the writing period T1*i* is the same as that shown in FIG. 5, and therefore is not described here. The electric potential of the CS line CSL(i) during the writing period T1*i* is the first level (Vc1). Further, the operation of the source line SL(j), the gate line GL(i), the data transfer control line DT(i), and the refresh output control line RC(i) during the refresh period T2 is the same as that shown in FIG. 5.

In the period t3 of the refresh period T2, the gate line GL(i), the data transfer control line DT(i), and the refresh output control line RC(i) have their electric potentials at Low. This brings the transistor N2 into an OFF state, thus bringing the data transfer section TS1 into a state in which to carry out the non-transfer operation, so that the nodes PIX and MRY get disconnected from each other. Both the nodes PIX and MRY have their electric potentials retained at the H level. It should be noted that the CS line CSL(i) has its electric potential at the first level (Vc1).

This process during the period t3 corresponds to the state shown in (b) of FIG. 3.

In the period t4, the gate line GL(i) has its electric potential changed to High, the data transfer control line DT(i) and the refresh output control line RC(i) have their electric potentials kept at Low. This brings the transistor N1 into an ON state, thus bringing the switching circuit SW1 into a conductive state, so that the High electric potential (H level) is written again to the node PIX from the source line SL(j).

Further, at a time point tc1 in the period t4, the electric potential of the CS line CSL(i) changes to the second level (Vc2), which is lower than the first level. The following equality holds: $|Vc1-Vc2|=\Delta Vcs$. This causes the electric potential of the node MRY to drop by ΔVcs from the H level. However, the electric potential of the node MRY (H−ΔVcs) is still higher than the threshold level Vt of the transistor N3. It should be noted that since the transistor N1 is in an ON state, the electric potential of the node PIX remains at the H level.

In the period t5, the gate line GL(i) has its electric potential changed to Low, and the data transfer control line DT(i) and the refresh output control line RC(i) have their electric potentials kept at Low. This brings the transistor N1 into an OFF state, thus bringing the switching circuit SW1 into a disconnected state, so that the node PIX gets disconnected from the source line SL(j) and retains the High level.

The processes from the period t4 to the period t5 correspond to the state shown in (c) of FIG. 3.

In the period t6 (first active period), the gate line GL(i) and the data transfer control line DT(i) have their electric potentials kept at Low, and the refresh output control line RC(i) has its electric potential changed to High. This brings the transistor N4 into an ON state, so that the refresh output control section RS1 carries out the first operation. Further, since the electric potential (H−ΔVcs) of the node MRY is higher than the threshold level Vt of the transistor N3, the transistor N3 is in an ON state. This brings the refresh output control section RS1 into the active state, so that the Low electric potential (L level) is supplied to the node PIX from the data transfer control line DT(i) via the transistors N3 and N4. The data transfer control line DT(i) also serves as the supply source VS1 in FIG. 2.

In the period t7, the gate line GL(i) and the data transfer control line DT(i) have their electric potentials kept at Low, and the refresh output control line RC(i) has its electric potential changed to Low. This brings the transistor N4 into an OFF state, thus bringing the refresh output control section RS1 into a state in which to carry out the second operation, so that the node PIX gets disconnected from the data transfer control line DT(i) and retains the L level.

Further, at a time point tc2 in the period t7, the electric potential of the CS line CSL(i) changes from the second level to the first level. This causes the electric potential of the node MRY to return to the H level. Further, since the transistor N1 is in an OFF state, the electric potential of the node PIX rises by ΔVcs from the L level.

The processes from the period t6 to the period t7 correspond to the state shown in (d) of FIG. 3.

During the period t8, the gate line GL(i) and the refresh output control line RC(i) have their electric potentials kept at Low, and the data transfer control line DT(i) has its electric potential changed to High. This brings the transistor N2 into an ON state, thus bringing the data transfer section TS1 into a state in which to carry out the transfer operation. In this case, a charge transfer occurs between the capacitors Ca1 and Cb1, so that the electric potential of the node MRY drops. The electric potential of the node PIX rises by a slight voltage ΔVz from L+ΔVcs due to the transfer of positive charge from the capacitor Cb1 to the capacitor Ca1 via the transistor N2. Further, the electric potential of the node MRY becomes (L+ΔVcs+ΔVz), which is equal to the electric potential of the node PIX. In a case where the threshold level Vt of the transistor N3 is low, the electric potential (L+ΔVcs+ΔVz) of the node MRY exceeds the threshold level Vt of the transistor N3.

In the period t9, the gate line GL(i) and the refresh output control line RC(i) have their electric potentials kept at Low, and the data transfer control line DT(i) has its electric potential changed to Low. This brings the transistor N2 into an OFF state, thus bringing the data transfer section TS1 into a state in which to carry out the non-transfer operation, so that the nodes PIX and MRY get disconnected from each other. Both the nodes PIX and MRY retain (L+ΔVcs+ΔVz).

The processes from the period t8 to the period t9 correspond to the state shown in (e) of FIG. 3.

In the period t10, the gate line GL(i) has its electric potential changed to High, and the data transfer control line DT(i) and the refresh output control line RC(i) have their electric potentials kept at Low. This brings the transistor N1 into an ON state, thus bringing the switching circuit SW1 into a conductive state, so that the H-level electric potential is written again to the node PIX from the source line SL(j).

Further, at a time point tc3 in the period t10, the electric potential of the CS line CSL(i) changes from the first level to the second level. This causes the electric potential of the node MRY to be (L+ΔVz). It should be noted that immediately before the time point tc2 in the period t7, the potential difference between the node PIX and the node MRY is (H−L−ΔVcs), which is smaller than the potential difference (H−L) between the node PIX and the node MRY during the period t7 shown in FIG. 7. Accordingly, the voltage ΔVz by which the electric potential of the node PIX rose due to the transfer of positive charge from the capacitor Cb1 to the capacitor Ca1 via the transistor N2 is smaller than ΔVx shown in FIG. 7. Consequently, the electric potential (L+ΔVz) of the node MRY after the time point tc3 is lower than the electric potential (L+ΔVx) of the node MRY shown in FIG. 7. Therefore, the electric potential (L+ΔVz) of the node MRY is lower than the threshold level Vt. This causes the transistor N3 to be supplied with an OFF voltage via its gate terminal, so that the transistor N3 comes into an OFF state. It should be noted that since the transistor N1 is in an ON state, the electric potential of the node PIX remains at the H level.

In the period t11, the gate line GL(i) has its electric potential changed to Low, and the data transfer control line DT(i) and the refresh output control line RC(i) have their electric potentials kept at Low. This brings the transistor N1 into an OFF state, thus bringing the switching circuit SW1 into a disconnected state, so that the node PIX gets disconnected from the source line SL(j) and retains the H level.

The processes from the period t10 to the period t11 correspond to the state shown in (f) of FIG. 3.

In the period t12 (second active period), the gate line GL(i) and the data transfer control line DT(i) have their electric potentials kept at Low, and the refresh output control line RC(i) has its electric potential changed to High. This brings the transistor N4 into an ON state, thus bringing the refresh output control section RS1 into a state in which to carry out the first operation. Further, since the electric potential (L+ΔVz) of the node MRY is lower than the threshold level Vt of the transistor N3, the transistor N3 is in an OFF state. This brings the refresh output control section RS1 into the non-active state, in which the refresh output control section RS1 stops producing an output. Therefore, the node PIX keeps retaining the H level.

In the period t13, the gate line GL(i) and the data transfer control line DT(i) have their electric potentials kept at Low, and the refresh output control line RC(i) has its electric potential changed to Low. This brings the transistor N4 into an OFF state, thus bringing the refresh output control section RS1 into a state in which to carry out the second operation, so that the node PIX retains the H level.

Further, at a time point tc4 in the period t13, the electric potential of the CS line CSL(i) changes from the second level to the first level. This causes the electric potential of the node MRY to rise by ΔVcs to become (L+ΔVcs+ΔVz). Further, since the transistor N1 is in an OFF state, the electric potential of the node PIX rises by ΔVcs from the H level.

In the period t14, the gate line GL(i) and the refresh output control line RC(i) have their electric potentials kept at Low, and the data transfer control line DT(i) has its electric potential changed to High. This brings the transistor N2 into an ON state, thus bringing the data transfer section TS1 into a state in which to carry out the transfer operation. In this case, a charge transfer occurs between the capacitors Ca1 and Cb1, so that both the nodes PIX and MRY come to have their electric potentials at High (substantially at the H level).

The process during the period t14 corresponds to the state shown in (h) of FIG. 3.

With these actions, the electric potential of the node PIX is High during the periods t1*i* to t5 and the periods t10 to t14 and Low during the periods t6 to t9, and the electric potential of the node MRY is High during the periods t1*i* to t7 and the period t14 and Low during the periods t8 to t13.

In the example of operation of the present embodiment as shown in FIG. 9, the electric potential of the CS line CSL(i) switches between the first level and the second level. At least while the refresh output control line RC(i) is at High (that is, the transistor N4 is in an ON state), the CS line CSL(i) supplies an electric potential at the second level, which is lower than the first level. This causes the electric potential of the node MRY to be corrected so that it is low while the transistor N4 is in an ON state. Therefore, even in a case where the threshold level of the transistor N3 is low, the transistor N3 is supplied with an OFF voltage via its gate terminal (period t12). This makes it possible to surely bring the transistor N3 into an OFF state, thus allowing the pixel memory MR to normally carry out the refresh operation. Therefore, the example of operation shown in FIG. 9 of the present embodiment makes it possible to enlarge the range of thresholds of the transistor N3 (on the lower-limit side) in which the pixel memory can normally operate, thus preventing a malfunction of the circuit from occurring due to variations in transistor characteristic.

Figure 22:
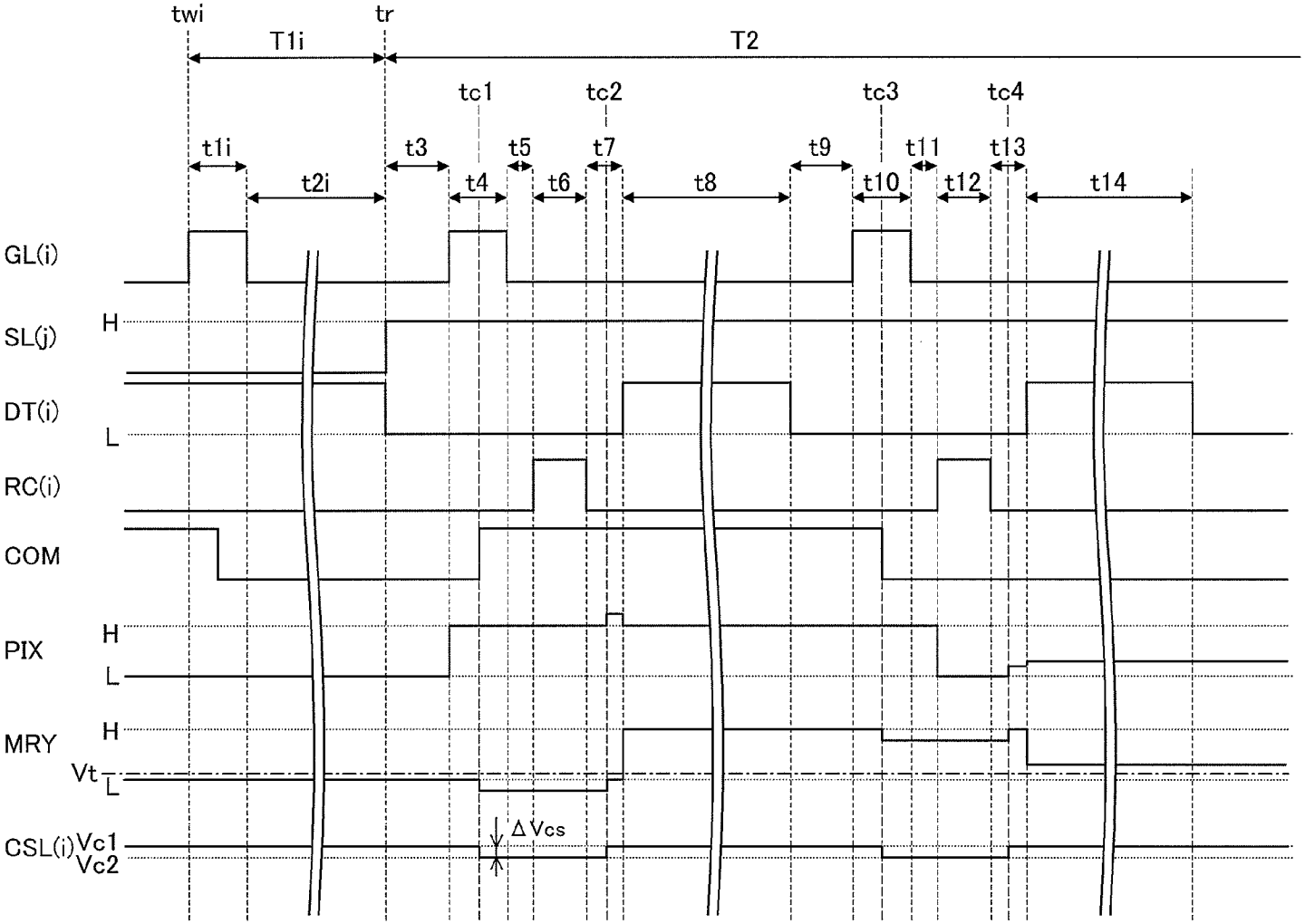
FIG. 22 is a signal chart for explaining the operation of Example 1 of Operation, which corresponds to a pixel memory of the liquid crystal display device of Embodiment 1.

It should be noted that FIG. 22 shows a case where "0"=Low is written as second data in the writing period T1*i* in a case where the CS line CSL(i) carries out the operation shown in FIG. 9.

In the example shown in FIG. 22, while the electric potential of the refresh output control line RC(i) during the period t6 is High, the electric potential of the node MRY is lower than the threshold level Vt. Further, while the electric potential of the refresh output control line RC(i) during the period t12 is High, the electric potential of the node MRY is higher than the threshold level Vt. The state of the pixel during the period t14 as shown in FIG. 22 corresponds to the state of the pixel during the period t8 as shown in FIG. 9, and the refresh operation continues normally during and after the period t14 shown in FIG. 22.

Example 2 of Operation of Embodiment 1

Another example of operation of the pixel memory shown in FIG. 4 of the present embodiment is described below. It should be noted that actions that are similar to those of Example 1 of Operation are not explained here.

Figure 10:
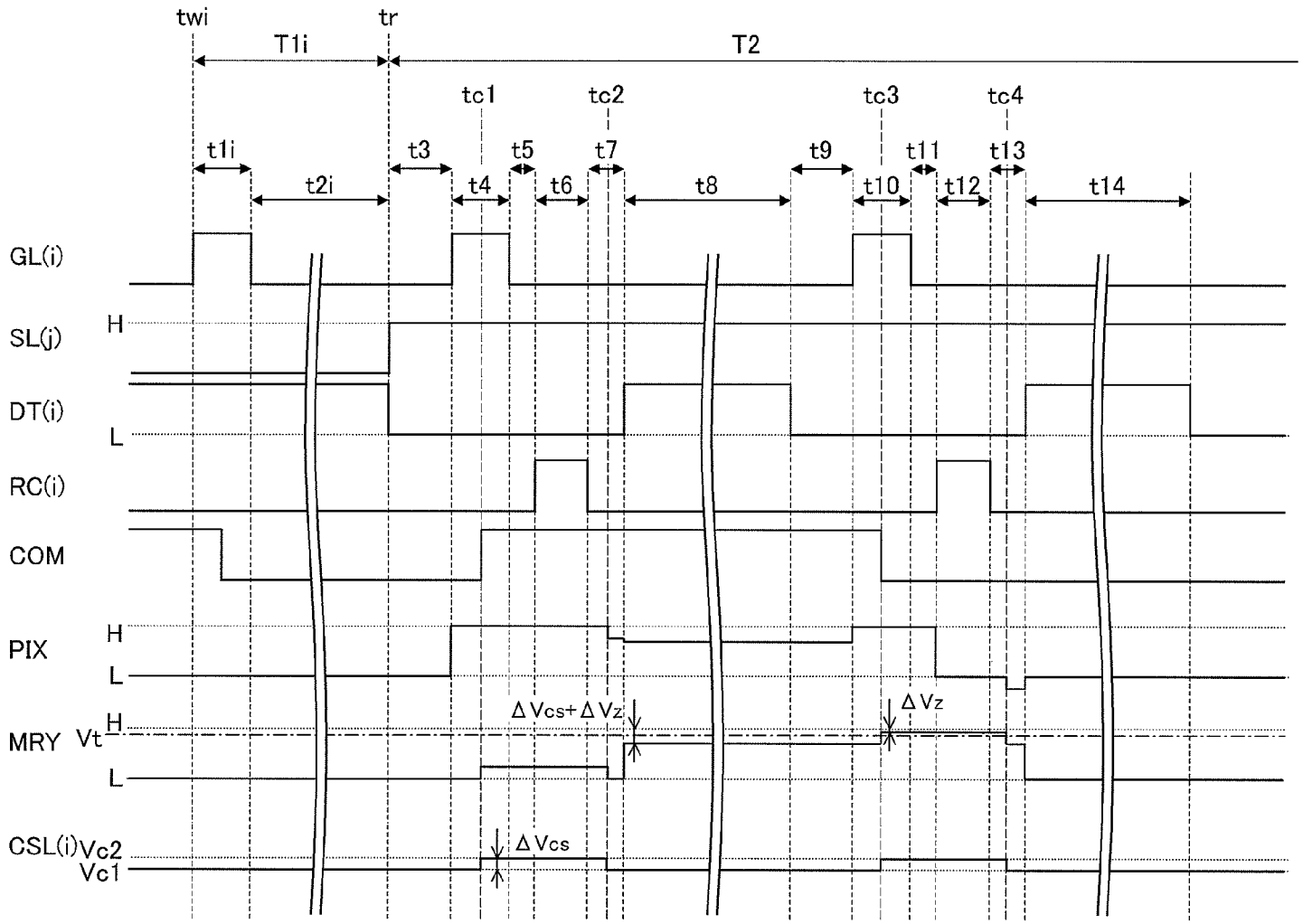
FIG. 10 is a signal chart for explaining the operation of Example 2 of Operation, which corresponds to a pixel memory of the liquid crystal display device of Embodiment 1.

FIG. 10 is a signal chart showing an operation that corresponds to a pixel memory (see FIG. 4) of the liquid crystal display device 1 of the present embodiment. It should be noted that it is assumed, in FIG. 10, that a threshold level Vt at which the transistor N3 is turned on is higher than an electric potential that falls in the center of the range from the H level to the L level. FIG. 10 shows a case where "0"=Low is written as second data in the writing period T1*i*.

The operation during the writing period T1*i* is the same as that shown in FIG. 6, and therefore is not described here. The operation of the source line SL(j), the gate line GL(i), the data transfer control line DT(i), and the refresh output control line RC(i) during the refresh period T2 is the same as that shown in FIG. 6.

In the period t3 of the refresh period T2, the gate line GL(i), the data transfer control line DT(i), and the refresh output control line RC(i) have their electric potentials at Low. This brings the transistor N2 into an OFF state, thus bringing the data transfer section TS1 into a state in which to carry out the non-transfer operation, so that the nodes PIX and MRY get disconnected from each other. Both the nodes PIX and MRY have their electric potentials retained at the L level. It should be noted that the CS line CSL(i) has its electric potential at the first level (Vc1; L level).

In the period t4, the gate line GL(i) has its electric potential changed to High, and the data transfer control line DT(i) and the refresh output control line RC(i) have their electric potentials kept at Low. This brings the transistor N1 into an ON state, thus bringing the switching circuit SW1 into a conductive state, so that the High electric potential (H level) is written to the node PIX from the source line SL(j).

Further, at a time point tc1 in the period t4, the electric potential of the CS line CSL(i) changes to the second level (Vc2; H level), which is higher than the first level. The following equality holds: $|Vc2-Vc1|=\Delta Vcs$. This causes the electric potential of the node MRY to rise by ΔVcs from the L level. However, the electric potential of the node MRY (L+ΔVcs) is still lower than the threshold level Vt of the transistor N3. It should be noted that since the transistor N1 is in an ON state, the electric potential of the node PIX remains at the H level.

In the period t5, the gate line GL(i) has its electric potential changed to Low, the data transfer control line DT(i) and the refresh output control line RC(i) have their electric potentials kept at Low. This brings the transistor N1 into an OFF state, thus bringing the switching circuit SW1 into a disconnected state, so that the node PIX gets disconnected from the source line SL(j) and retains the High level.

In the period t6, the gate line GL(i) and the data transfer control line DT(i) have their electric potentials kept at Low, and the refresh output control line RC(i) has its electric potential changed to High. This brings the transistor N4 into an ON state, so that the refresh output control section RS1 carries out the first operation. Further, since the electric potential (L+ΔVcs) of the node MRY is lower than the threshold level Vt of the transistor N3, the transistor N3 is in an OFF state. This brings the refresh output control section RS1 into the non-active state, so that the node PIX and the data transfer control line DT(i) get disconnected from each other.

In the period t7, the gate line GL(i) and the data transfer control line DT(i) have their electric potentials kept at Low, and the refresh output control line RC(i) has its electric potential changed to Low. This brings the transistor N4 into an OFF state, thus bringing the refresh output control section RS1 into a state in which to carry out the second operation, so that the node PIX gets disconnected from the data transfer control line DT(i) and retains the H level.

Further, at a time point tc2 in the period t7, the electric potential of the CS line CSL(i) changes from the second level to the first level. This causes the electric potential of the node MRY to return to the L level. Further, since the transistor N1 is in an OFF state, the electric potential of the node PIX drops by ΔVcs from the H level.

In the period t8, the gate line GL(i) and the refresh output control line RC(i) have their electric potentials kept at Low, and the data transfer control line DT(i) has its electric potential changed to High. This brings the transistor N2 into an ON state, thus bringing the data transfer section TS1 into a state in which to carry out the transfer operation. In this case, a charge transfer occurs between the capacitors Ca1 and Cb1, so that the electric potential of the node MRY rises. The electric potential of the node PIX drops by a slight voltage ΔVz from H−ΔVcs due to the transfer of positive charge from the capacitor Ca1 to the capacitor Cb1 via the transistor N2. Further, the electric potential of the node MRY becomes (H−ΔVcs−ΔVz), which is equal to the electric potential of the node PIX. In a case where the threshold level Vt of the transistor N3 is high, the electric potential (H−ΔVcs−ΔVz) of the node MRY falls short of the threshold level Vt of the transistor N3.

During the period t9, the gate line GL(i) and the refresh output control line RC(i) have their electric potentials kept at Low, and the data transfer control line DT(i) has its electric potential changed to Low. This brings the transistor N2 into an OFF state, thus bringing the data transfer section TS1 into a state in which to carry out the non-transfer operation, so that the nodes PIX and MRY get disconnected from each other. Both the nodes PIX and MRY retain (H−ΔVcs−ΔVz).

In the period t10, the gate line GL(i) has its electric potential changed to High, and the data transfer control line DT(i) and the refresh output control line RC(i) have their electric potentials kept at Low. This brings the transistor N1 into an ON state, thus bringing the switching circuit SW1 into a conductive state, so that the H-level electric potential is written again to the node PIX from the source line SL(j).

Further, at a time point tc3 in the period t10, the electric potential of the CS line CSL(i) changes from the first level to the second level. This causes the electric potential of the node MRY to be (H−ΔVz). It should be noted that immediately before the time point tc2 in the period t7, the potential difference between the node PIX and the node MRY is (H−L−ΔVcs), which is smaller than the potential difference (H−L) between the node PIX and the node MRY during the period t7 shown in FIG. 8. Accordingly, the voltage ΔVz by which the electric potential of the node PIX dropped due to the transfer of positive charge from the capacitor Ca1 to the capacitor Cb1 via the transistor N2 is smaller than ΔVx shown in FIG. 8. Consequently, the electric potential (H−ΔVz) of the node MRY after the time point tc3 is higher than the electric potential (H−ΔVx) of the node MRY shown in FIG. 8. Therefore, the electric potential (H−ΔVz) of the node MRY is higher than the threshold level Vt. This causes the transistor N3 to be supplied with an ON voltage via its gate terminal, so that the transistor N3 comes into an ON state. It should be noted that since the transistor N1 is in an ON state, the electric potential of the node PIX remains at the H level.

In the period t11, the gate line GL(i) has its electric potential changed to Low, and the data transfer control line DT(i) and the refresh output control line RC(i) have their electric potentials kept at Low. This brings the transistor N1 into an OFF state, thus bringing the switching circuit SW1 into a disconnected state, so that the node PIX gets disconnected from the source line SL(j) and retains the H level.

In the period t12, the gate line GL(i) and the data transfer control line DT(i) have their electric potentials kept at Low, and the refresh output control line RC(i) has its electric potential changed to High. This brings the transistor N4 into an ON state, thus bringing the refresh output control section RS1 into a state in which to carry out the first operation. Further, since the electric potential (H−ΔVz) of the node MRY is higher than the threshold level Vt of the transistor N3, the transistor N3 is in an ON state. This brings the refresh output control section RS1 into the active state, so that the Low electric potential (L level) is supplied to the node PIX from the data transfer control line DT(i) via the transistors N3 and N4.

In the period t13, the gate line GL(i) and the data transfer control line DT(i) have their electric potentials kept at Low, and the refresh output control line RC(i) has its electric potential changed to Low. This brings the transistor N4 into an OFF state, thus bringing the refresh output control section RS1 into a state in which to carry out the second operation, so that the node PIX retains the L level.

Further, at a time point tc4 in the period t13, the electric potential of the CS line CSL(i) changes from the second level to the first level. This causes the electric potential of the node MRY to drop by ΔVcs to become L−ΔVcs−ΔVz. Further, since the transistor N1 is in an OFF state, the electric potential of the node PIX falls by ΔVcs from the L level.

In the period t14, the gate line GL(i) and the refresh output control line RC(i) have their electric potentials kept at Low, and the data transfer control line DT(i) has its electric potential changed to High. This brings the transistor N2 into an ON state, thus bringing the data transfer section TS1 into a state in which to carry out the transfer operation. In this case, a charge transfer occurs between the capacitors Ca1 and Cb1, so that both the nodes PIX and MRY come to have their electric potentials at Low (substantially at the L level).

With these actions, the electric potential of the node PIX is Low during the periods t1*i* to t3 and the periods t12 to t14 and High during the periods t4 to t1*i*, and the electric potential of the node MRY is Low during the periods t1*i* to t7 and the period t14 and High during the periods t8 to t13.

In the example of operation of the present embodiment as shown in FIG. 10, the electric potential of the CS line CSL(i) changes back and forth between the first level and the second level. At least while the refresh output control line RC(i) is at High (that is, the transistor N4 is in an ON state), the CS line CSL(i) supplies an electric potential at the second level, which is higher than the first level. This causes the electric potential of the node MRY to be corrected so that it is high while the transistor N4 is in an ON state. Therefore, even in a case where the threshold level of the transistor N3 is high, the transistor N3 is supplied with an ON voltage via its gate terminal. This makes it possible to surely bring the transistor N3 into an ON state, thus allowing the pixel memory MR to normally carry out the refresh operation. Therefore, the example of operation shown in FIG. 10 of the present embodiment makes it possible to enlarge the range of thresholds of the transistor N3 (on the upper-limit side) in which the pixel memory can normally operate, thus preventing a malfunction of the circuit from occurring due to variations in transistor characteristic.

Figure 23:
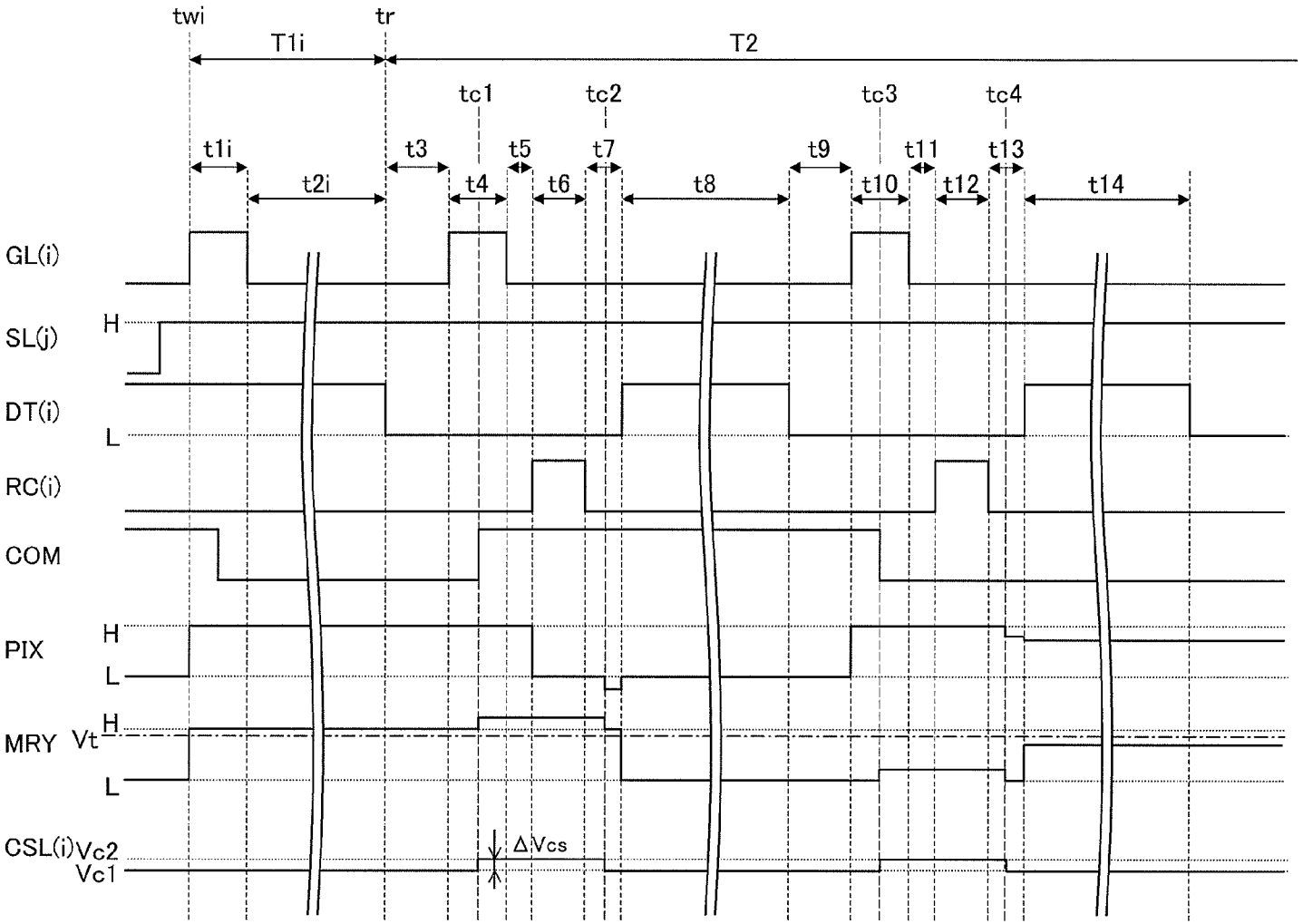
FIG. 23 is a signal chart for explaining the operation of Example 2 of Operation, which corresponds to a pixel memory of the liquid crystal display device of Embodiment 1.

It should be noted that FIG. 23 shows a case where "1"=High is written as first data in the writing period T1*i* in a case where the CS line CSL(i) carries out the operation shown in FIG. 10.

In the example shown in FIG. 23, while the electric potential of the refresh output control line RC(i) during the period t6 is High, the electric potential of the node MRY is higher than the threshold level Vt. Further, while the electric potential of the refresh output control line RC(i) during the period t12 is High, the electric potential of the node MRY is lower than the threshold level Vt. The state of the pixel during the period t14 as shown in FIG. 23 corresponds to the state of the pixel during the period t8 as shown in FIG. 10, and the refresh operation continues normally during and after the period t14 shown in FIG. 23.

In the present embodiment, as has been shown in FIGS. 9, 10, 22, and 23 above, the electric potential of the CS line CSL(i) is changed to the first level in the writing period of the memory operation mode, and image data is written to the first data retention section DS1 and the second data retention section DS2. Then, at least during that part of the refresh period of the memory operation mode during which the refresh output control line RC(i) is at High (that is, the transistor N4 is ON), the electric potential of the CS line CSL(i) is changed to the second level. This makes it possible to correct the electric potential of the node MRY, thus making it possible to enlarge the range of thresholds of the transistor N3 in which the pixel memory can normally operate.

It should be noted that the timing for changing the electric potential of the CS line CSL(i) is not limited to the operations shown in FIGS. 9 and 10, and for example, the electric potential of the CS line CSL(i) may be changed to the second level in the refresh period of the memory operation mode, and may continue to be maintained at the second level. Specifically, in FIGS. 9 and 10, the electric potential of the CS line CSL(i) may be changed from the first level to the second level at the time point tc1 in the period t4, and may then continue to be maintained at the second level until the time point tc4 in the period t13. In this case, the number of times the electric potential of the CS line CSL(i) changes is smaller (the frequency is lower) than in the case of the operations shown FIGS. 9 and 10. This makes it possible to reduce the amount of power that the CS driver consumes in driving the CS line CSL(i).

[Embodiment 2]

Another embodiment of the present invention is described below. Members and components having the same functions as those shown in the drawings described in Embodiment 1 are given the same reference signs, and as such, are not described in detail below.

Figure 11:
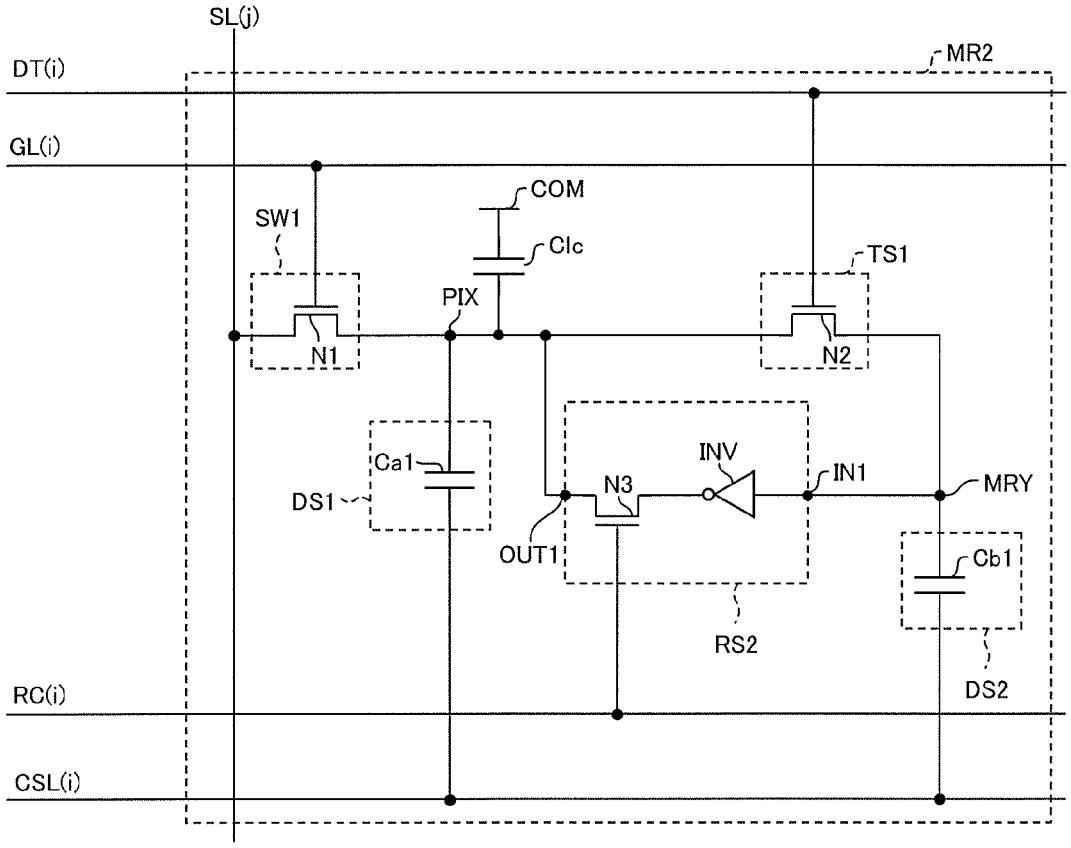
FIG. 11 is a circuit diagram showing a configuration of a pixel memory of a liquid crystal display device in Embodiment 2.

FIG. 11 shows a circuit configuration of a pixel memory MR2 (memory circuit) according to the present embodiment.

The pixel memory MR2 includes a switching circuit SW1, a first data retention section DS1, a data transfer section TS1, a second data retention section DS2, and a refresh output control section RS2. In place of the transistor N3 of the refresh output control section RS1 of Embodiment 1, the refresh output control section RS2 includes an inverter circuit INV. The inverter circuit INV has its input terminal connected to a node MRY as an input section IN1 of the refresh output control section RS2, and the inverter circuit INV has its output terminal connected to the first drain/source terminal of the transistor N3. In the memory operation mode, the pixel memory MR2 carries out the refresh operation while inverting the polarity of image data stored in the capacitor Cb1.

Example 1 of Operation of Embodiment 2

Figure 12:
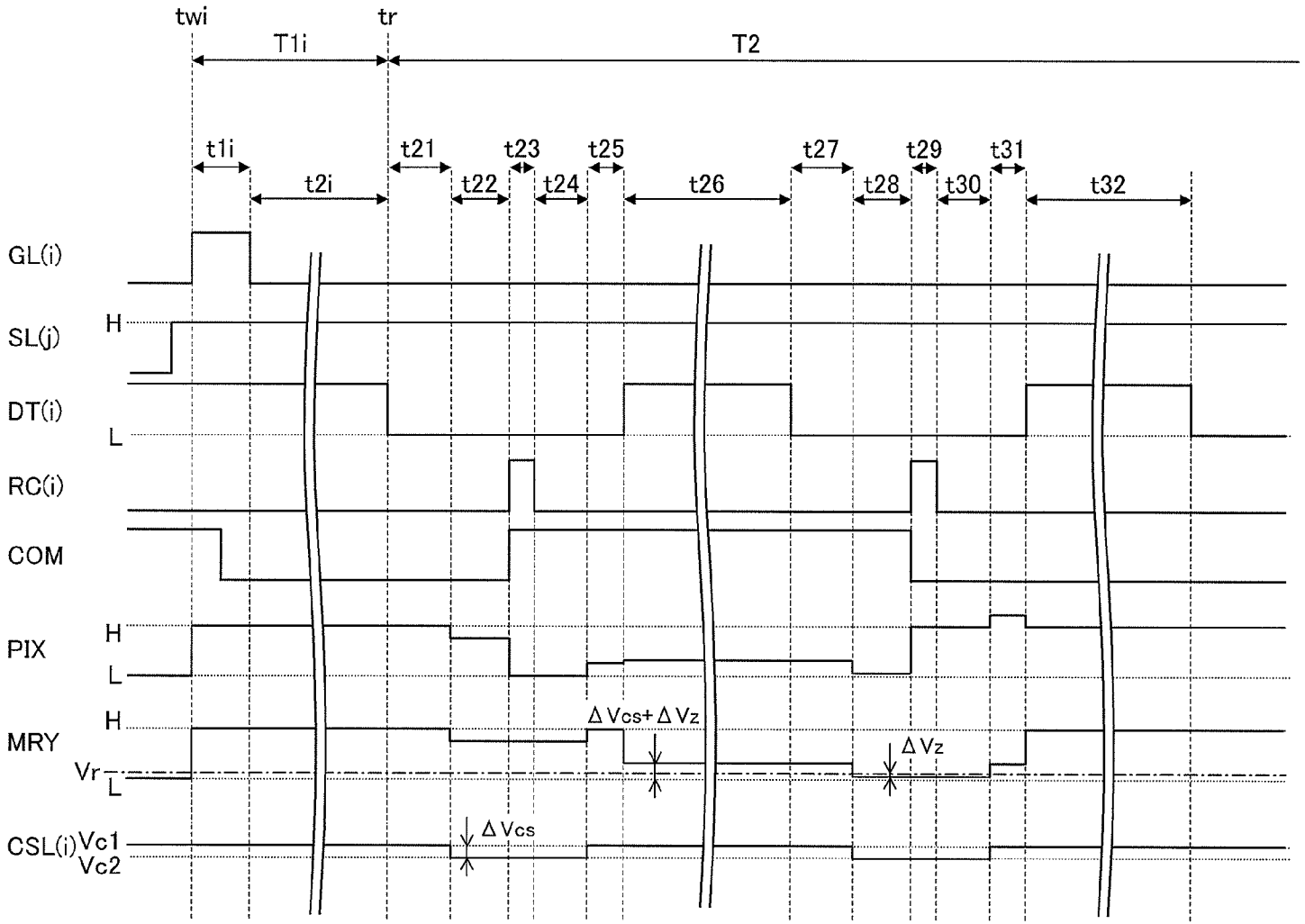
FIG. 12 is a signal chart for explaining the operation of Example 1 of Operation, which corresponds to a pixel memory of the liquid crystal display device of Embodiment 2.

FIG. 12 is a signal chart showing how the pixel memory MR2 of the present embodiment operates. FIG. 12 explains a case where the inversion electric potential is low, i.e., a case where the inverter circuit INV is constituted by a P-channel transistor having a low capability and an N-channel transistor having a high capability. FIG. 12 shows a case where "1"=High is written as first data in the writing period T1*i*. The operation during the writing period T1*i* is the same as that shown in FIG. 9, and therefore is not described here.

In the refresh period T2, the electric potential GL(i) is always Low.

In a period t21, the data transfer control line DT(i) and the refresh output control line RC(i) have their electric potentials at Low, and the CS line CSL(i) has its electric potential at the first level (Vc1; H level). This brings the transistor N2 into an OFF state, thus bringing the data transfer section TS1 into a state in which to carry out the non-transfer operation, so that the nodes PIX and MRY get disconnected from each other. Both the nodes PIX and MRY have their electric potentials retained at the H level.

In a period t22, the data transfer control line DT(i) and the refresh output control line RC(i) have their electric potentials kept at Low, and the CS line CSL(i) has its electric potential changed to the second level (Vc2; L level), which is lower than the first level. The following equality holds: |Vc1−Vc2|=ΔVcs. This causes the electric potentials of the nodes PIX and MRY to both drop by ΔVcs from the H level. It should be noted here that since the electric potential (H−ΔVcs) of the node MRY is higher than the inversion electric potential Vr, a L-level electric potential obtained through inversion is supplied to the first drain/source terminal of the transistor N3.

In a period t23 (first active period), the data transfer control line DT(i) has its electric potential kept at Low, the refresh output control line RC(i) has its electric potential changed to High, and the CS line CSL(i) has its electric potential kept at the second level. This brings the transistor N3 into an ON state, so that the refresh output control section RS2 supplies the output electric potential (L level) of the inverter circuit INV to the node PIX.

In a period t24, the data transfer control line DT(i) has its electric potential kept at Low, the refresh output control line RC(i) has its electric potential changed to Low, and the CS line CSL(i) has its electric potential kept at the second level. This brings the transistor N3 into an OFF state, so that the node PIX and the inverter circuit INV get disconnected from each other.

In a period t25, the data transfer control line DT(i) and the refresh output control line RC(i) have their electric potentials kept at Low, and the CS line CSL(i) has its electric potential changed to the first level. This causes the electric potentials of the nodes PIX and MRY to both rise by ΔVcs. The electric potential of the node PIX becomes (L+ΔVcs), and the electric potential of the node MRY is changed to the H level.

In a period t26, the data transfer control line DT(i) has its electric potential changed to High, the refresh output control line RC(i) has its electric potential kept at Low, and the CS line CSL(i) has its electric potential kept at the first level. This brings the transistor N2 into an ON state, thus bringing the data transfer section TS1 into a state in which to carry out the transfer operation. In this case, a charge transfer occurs between the capacitors Ca1 and Cb1, so that the electric potential of the node MRY drops. The electric potential of the node PIX rises by a slight voltage ΔVz from (L+ΔVcs) due to the transfer of positive charge from the capacitor Cb1 to the capacitor Ca1 via the transistor N2. Further, the electric potential of the node MRY becomes (L+ΔVcs+ΔVz), which is equal to the electric potential of the node PIX. In a case where the inversion electric potential Vr is low, the electric potential (L+ΔVcs+ΔVz) of the node MRY exceeds the inversion electric potential Vr.

In a period t27, the data transfer control line DT(i) has its electric potential changed to Low, the refresh output control line RC(i) has its electric potential kept at Low, and the CS line CSL(i) has its electric potential kept at the first level. This brings the transistor N2 into an OFF state, thus bringing the data transfer section TS1 into a state in which to carry out the non-transfer operation, so that the nodes PIX and MRY get disconnected from each other. Both the nodes PIX and MRY retain Low (L+ΔVcs+ΔVz).

In a period t28, the data transfer control line DT(i) and the refresh output control line RC(i) have their electric potentials kept at Low, and the CS line CSL(i) has its electric potential changed to the second level. This causes the electric potentials of the nodes PIX and MRY to both drop by ΔVcs. The electric potentials of the nodes PIX and MRY both become (L+ΔVz). It should be noted here that since the electric potential (L+ΔVz) of the node MRY is lower than the inversion electric potential Vr. Consequently, a H-level electric potential obtained through inversion is supplied to the first drain/source terminal of the transistor N3.

In a period t29 (second active period), the data transfer control line DT(i) has its electric potential kept at Low, the refresh output control line RC(i) has its electric potential changed to High, and the CS line CSL(i) has its electric potential kept at the second level. This brings the transistor N3 into an ON state, so that the refresh output control section RS2 supplies the output electric potential (H level) of the inverter circuit INV to the node PIX.

In a period t30, the data transfer control line DT(i) has its electric potential kept at Low, the refresh output control line RC(i) has its electric potential changed to Low, and the CS line CSL(i) has its electric potential kept at the second level. This brings the transistor N3 into an OFF state, so that the node PIX and the inverter circuit INV get disconnected from each other.

In a period t31, the data transfer control line DT(i) and the refresh output control line RC(i) have their electric potentials kept at Low, and the CS line CSL(i) has its electric potential changed to the first level. This causes the electric potentials of the nodes PIX and MRY to both rise by ΔVcs. The electric potential of the node PIX becomes (H+ΔVcs), and the electric potential of the node MRY becomes (L+ΔVcs+ΔVz).

In a period t32, the data transfer control line DT(i) has its electric potential changed to High, the refresh output control line RC(i) has its electric potential kept at Low, and the CS line CSL(i) has its electric potential kept at the first level. This brings the transistor N2 into an ON state, thus bringing the data transfer section TS1 into a state in which to carry out the transfer operation. In this case, a charge transfer occurs between the capacitors Ca1 and Cb1, so that both the nodes PIX and MRY come to have their electric potentials at High (substantially at the H level).

With these actions, the electric potential of the node PIX during the refresh period T2 is High during the periods t21 to t22 and the periods t29 to t32 and Low during the periods t23 to t28, and the electric potential of the node MRY during the refresh period T2 is High during the periods t21 to t25 and the period t32 and Low during the periods t26 to t31.

It should be noted that the driving is carried out such that the potential of the common electrode COM is inverted from High to Low or vice versa every time the transistor N3 is brought into an ON state.

In the example of operation of the present embodiment as shown in FIG. 12, the electric potential of the CS line CSL(i) changes back and forth between the first level and the second level. At least while the refresh output control line RC(i) is at High (that is, the transistor N3 is in an ON state), the CS line CSL(i) supplies an electric potential at the second level, which is lower than the first level. This causes the electric potential of the node MRY to be corrected so that it is low while the transistor N3 is in an ON state. Therefore, even in a case where the inversion electric potential of the inverter circuit INV is low, the pixel memory MR2 can normally carry out the refresh operation. Therefore, the example of operation shown in FIG. 12 of the present embodiment makes it possible to enlarge the range of inversion electric potentials Vr (on the lower-limit side) in which the pixel memory can normally operate, thus preventing a malfunction of the circuit from occurring due to variations in transistor characteristic.

Example 2 of Operation of Embodiment 2

Another example of operation of the pixel memory of the present embodiment shown in FIG. 11 is described below. It should be noted that actions that are similar to those of Example 1 of Operation are not explained here.

Figure 13:
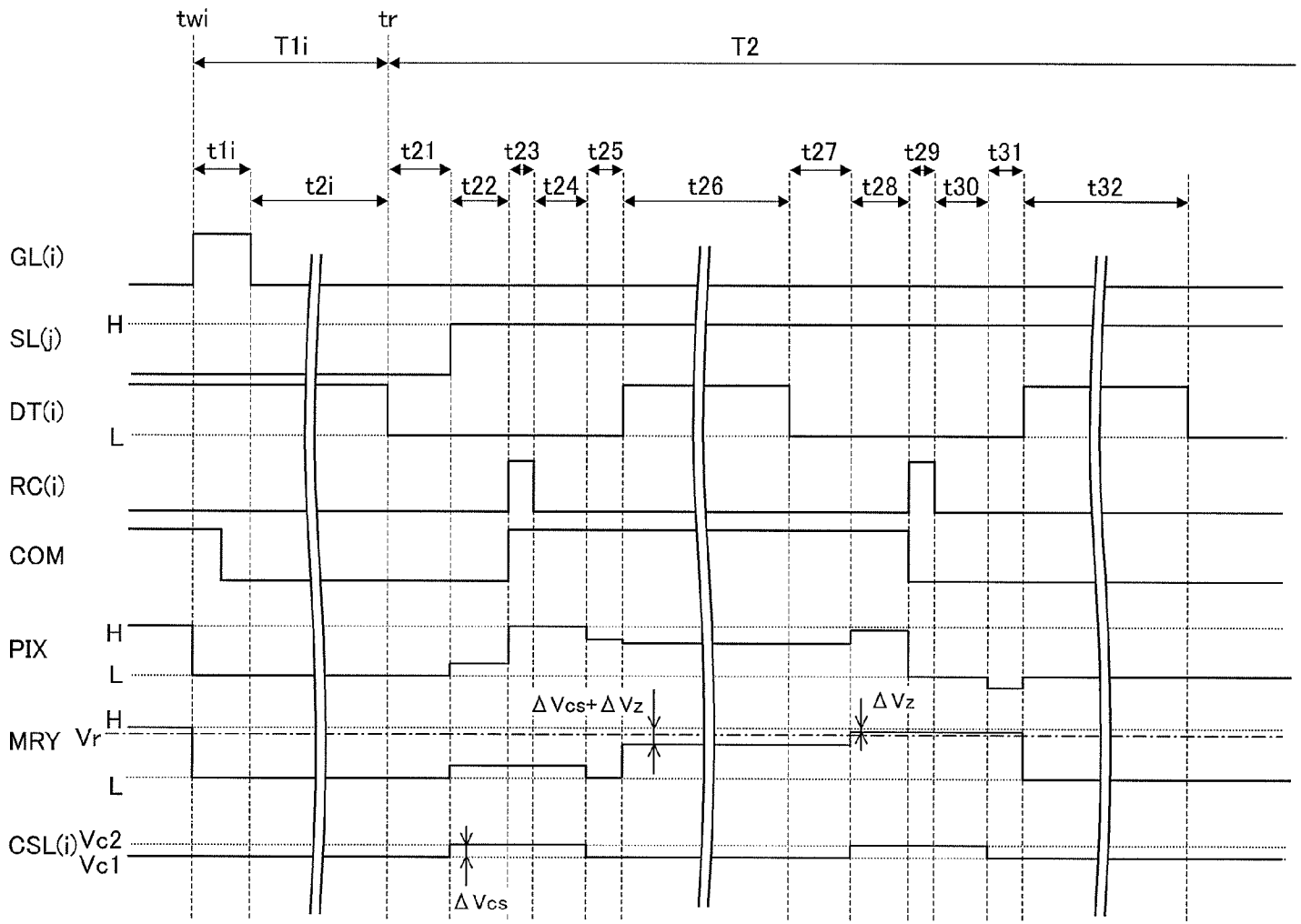
FIG. 13 is a signal chart for explaining the operation of Example 2 of Operation, which corresponds to a pixel memory of the liquid crystal display device of Embodiment 2.

FIG. 13 is a signal chart showing how the pixel memory MR2 of the present embodiment alternatively operates. FIG. 13 explains a case where the inversion electric potential is high, i.e., a case where the inverter circuit INV is constituted by a P-channel transistor having a high capability and an N-channel transistor having a low capability. FIG. 13 shows a case where "0"=Low is written as first data in the writing period T1*i*. The operation during the writing period T1*i* is the same as that shown in FIG. 10, and therefore is not described here.

In the period t21, the data transfer control line DT(i) and the refresh output control line RC(i) have their electric potentials at Low, and the CS line CSL(i) has its electric potential at the first level (Vc1; L level). This brings the transistor N2 into an OFF state, thus bringing the data transfer section TS1 into a state in which to carry out the non-transfer operation, so that the nodes PIX and MRY get disconnected from each other. Both the nodes PIX and MRY have their electric potentials retained at the L level.

In the period t22, the data transfer control line DT(i) and the refresh output control line RC(i) have their electric potentials kept at Low, and the CS line CSL(i) has its electric potential changed to the second level (Vc2; H level), which is higher than the first level. The following equality holds: $|Vc2-Vc1|=\Delta Vcs$. This causes the electric potentials of the nodes PIX and MRY to both rise by ΔVcs from the L level. It should be noted here that since the electric potential (L+ΔVcs) of the node MRY is lower than the inversion electric potential Vr, a H-level electric potential obtained through inversion is supplied to the first drain/source terminal of the transistor N3.

In the period t23 (second active period), the data transfer control line DT(i) has its electric potential kept at Low, the refresh output control line RC(i) has its electric potential changed to High, and the CS line CSL(i) has its electric potential kept at the second level. This brings the transistor N3 into an ON state, so that the refresh output control section RS2 supplies the output electric potential (H level) of the inverter circuit INV to the node PIX.

In the period t24, the data transfer control line DT(i) has its electric potential kept at Low, the refresh output control line RC(i) has its electric potential changed to Low, and the CS line CSL(i) has its electric potential kept at the second level. This brings the transistor N3 into an OFF state, so that the node PIX and the inverter circuit INV get disconnected from each other.

In the period t25, the data transfer control line DT(i) and the refresh output control line RC(i) have their electric potentials kept at Low, and the CS line CSL(i) has its electric potential changed to the first level. This causes the electric potentials of the nodes PIX and MRY to both drop by ΔVcs. The electric potential of the node PIX becomes (H−ΔVcs), and the electric potential of the node MRY is changed to the L level.

In the period t26, the data transfer control line DT(i) has its electric potential changed to High, the refresh output control line RC(i) has its electric potential kept at Low, and the CS line CSL(i) has its electric potential kept at the first level. This brings the transistor N2 into an ON state, thus bringing the data transfer section TS1 into a state in which to carry out the transfer operation. In this case, a charge transfer occurs between the capacitors Ca1 and Cb1, so that the electric potential of the node MRY rises. The electric potential of the node PIX drops by a slight voltage ΔVz from (H−ΔVcs) due to the transfer of positive charge from the capacitor Ca1 to the capacitor Cb1 via the transistor N2. Further, the electric potential of the node MRY becomes (H−ΔVcs−ΔVz), which is equal to the electric potential of the node PIX. In a case where the inversion electric potential Vr is high, the electric potential (H−ΔVcs−ΔVz) of the node MRY falls short of the inversion electric potential Vr.

In a period t27, the data transfer control line DT(i) has its electric potential changed to Low, the refresh output control line RC(i) has its electric potential kept at Low, and the CS line CSL(i) has its electric potential kept at the first level. This brings the transistor N2 into an OFF state, thus bringing the data transfer section TS1 into a state in which to carry out the non-transfer operation, so that the nodes PIX and MRY get disconnected from each other. Both the nodes PIX and MRY retain Low (H−ΔVcs−ΔVz).

In the period t28, the data transfer control line DT(i) and the refresh output control line RC(i) have their electric potentials kept at Low, and the CS line CSL(i) has its electric potential changed to the second level. This causes the electric potentials of the nodes PIX and MRY to both rise by ΔVcs. The electric potentials of the nodes PIX and MRY both become (H−ΔVz). It should be noted here that the electric potential (H−ΔVz) of the node MRY is higher than the inversion electric potential Vr. Consequently, a L-level electric potential obtained through inversion is supplied to the first drain/source terminal of the transistor N3.

In the period t29 (first active period), the data transfer control line DT(i) has its electric potential kept at Low, the refresh output control line RC(i) has its electric potential changed to High, and the CS line CSL(i) has its electric potential kept at the second level. This brings the transistor N3 into an ON state, so that the refresh output control section RS2 supplies the output electric potential (L level) of the inverter circuit INV to the node PIX.

In the period t30, the data transfer control line DT(i) has its electric potential kept at Low, the refresh output control line RC(i) has its electric potential changed to Low, and the CS line CSL(i) has its electric potential kept at the second level. This brings the transistor N3 into an OFF state, so that the node PIX and the inverter circuit INV get disconnected from each other.

In the period t31, the data transfer control line DT(i) and the refresh output control line RC(i) have their electric potentials kept at Low, and the CS line CSL(i) has its electric potential changed to the first level. This causes the electric potentials of the nodes PIX and MRY to both drop by ΔVcs. The electric potential of the node PIX becomes (L−ΔVcs), and the electric potential of the node MRY becomes (H−ΔVcs−ΔVz).

In the period t32, the data transfer control line DT(i) has its electric potential changed to High, the refresh output control line RC(i) has its electric potential kept at Low, and the CS line CSL(i) has its electric potential kept at the first level. This brings the transistor N2 into an ON state, thus bringing the data transfer section TS1 into a state in which to carry out the transfer operation. In this case, a charge transfer occurs between the capacitors Ca1 and Cb1, so that both the nodes PIX and MRY come to have their electric potentials at Low (substantially at the L level).

With these actions, the electric potential of the node PIX during the refresh period T2 is Low during the periods t21 to t22 and the periods t29 to t32 and High during the periods t23 to t28, and the electric potential of the node MRY during the refresh period T2 is Low during the periods t21 to t25 and the period t32 and High during the periods t26 to t31.

In the example of operation of the present embodiment as shown in FIG. 13, the electric potential of the CS line CSL(i) changes back and forth between the first level and the second level. At least while the refresh output control line RC(i) is at High (that is, the transistor N3 is in an ON state), the CS line CSL(i) supplies an electric potential at the second level, which is higher than the first level. This causes the electric potential of the node MRY to be corrected so that it is high while the transistor N3 is in an ON state. Therefore, even in a case where the inversion electric potential of the inverter circuit INV is high, the pixel memory MR2 can normally carry out the refresh operation. Therefore, the example of operation shown in FIG. 13 of the present embodiment makes it possible to enlarge the range of inversion electric potentials Vr (on the upper-limit side) in which the pixel memory can normally operate, thus preventing a malfunction of the circuit from occurring due to variations in transistor characteristic.

In the present embodiment, as has been shown in FIGS. 12 and 13 above, the electric potential of the CS line CSL(i) is changed to the first level in the writing period of the memory operation mode, and image data is written to the first data retention section DS1 and the second data retention section DS2. Then, at least during that part of the refresh period of the memory operation mode during which the refresh output control line RC(i) is at High (that is, the transistor N3 is ON), the electric potential of the CS line CSL(i) is changed to the second level. This makes it possible to correct the electric potential of the node MRY, thus making it possible to enlarge the range of thresholds of the inverter circuit INV in which the pixel memory can normally operate.

It should be noted that in the present embodiment, as in Embodiment 2, the electric potential of the CS line CSL(i) may be changed to the second level in the refresh period of the memory operation mode, and may continue to be maintained at the second level.

[Embodiment 3]

Still another embodiment of the present invention is described below. Members and components having the same functions as those shown in the drawings described in Embodiment 1 are given the same reference signs, and as such, are not described in detail below.

Figure 14:
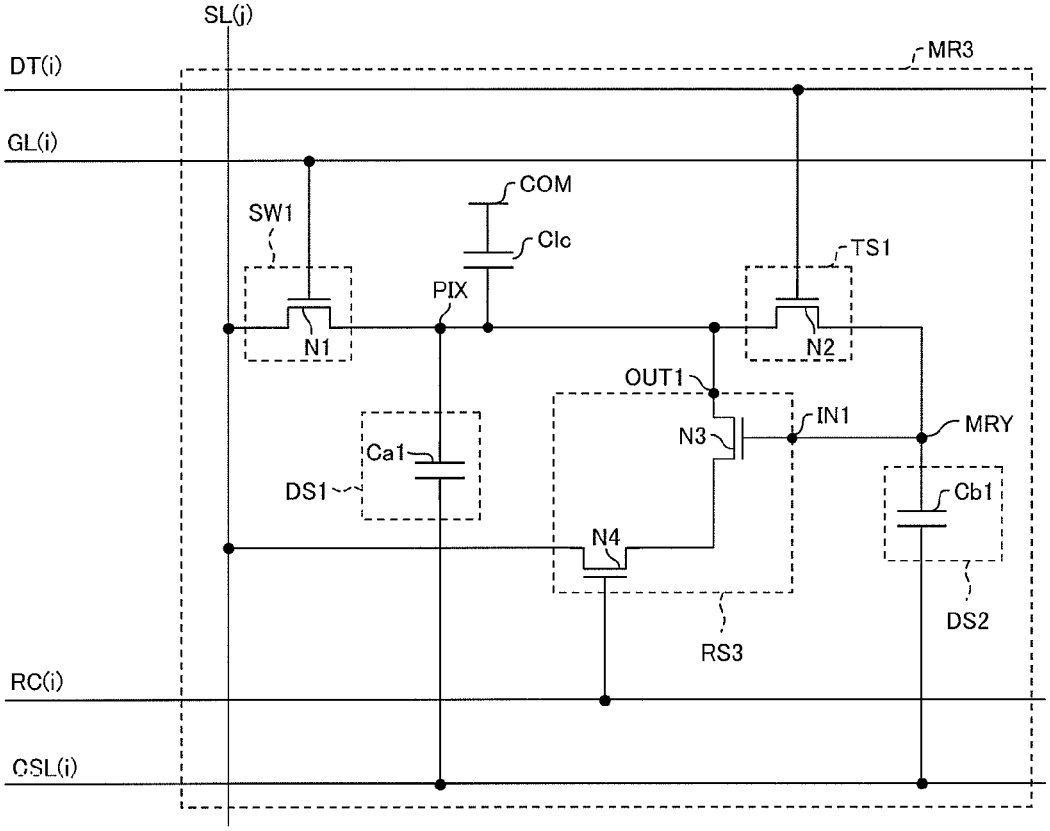
FIG. 14 is a circuit diagram showing a configuration of a pixel memory of a liquid crystal display device in Embodiment 3.

FIG. 14 shows a circuit configuration of a pixel memory MR3 (memory circuit) according to the present embodiment.

The pixel memory MR3 includes a switching circuit SW1, a first data retention section DS1, a data transfer section TS1, a second data retention section DS2, and a refresh output control section RS3. The refresh output control section RS3 includes a transistor N3 and a transistor N4. The present embodiment differs from Embodiment 1 in term of how the transistors N3 and N4 are connected to other wires.

The transistor N3 has its gate terminal connected to the node MRY as an input section IN1 of the refresh output control section RS3, its first source/drain terminal connected to the node PIX as an output section OUT1 of the refresh output control section RS3, and its second source/drain terminal connected to the first drain/source terminal of the transistor N4. The transistor N4 has its gate terminal connected to a refresh output control line RC(i) and its second source/drain terminal connected to the source line SL(j). It should be noted that the transistors N3 and N4 may swap their connecting locations with each other, and need only be connected in series to each other between the source line SL(i) and the output of the refresh output control section RS3. In the memory operation mode, the pixel memory MR3 carries out the refresh operation while inverting the polarity of image data stored in the capacitor Cb1.

Example 1 of Operation of Embodiment 3

Figure 15:
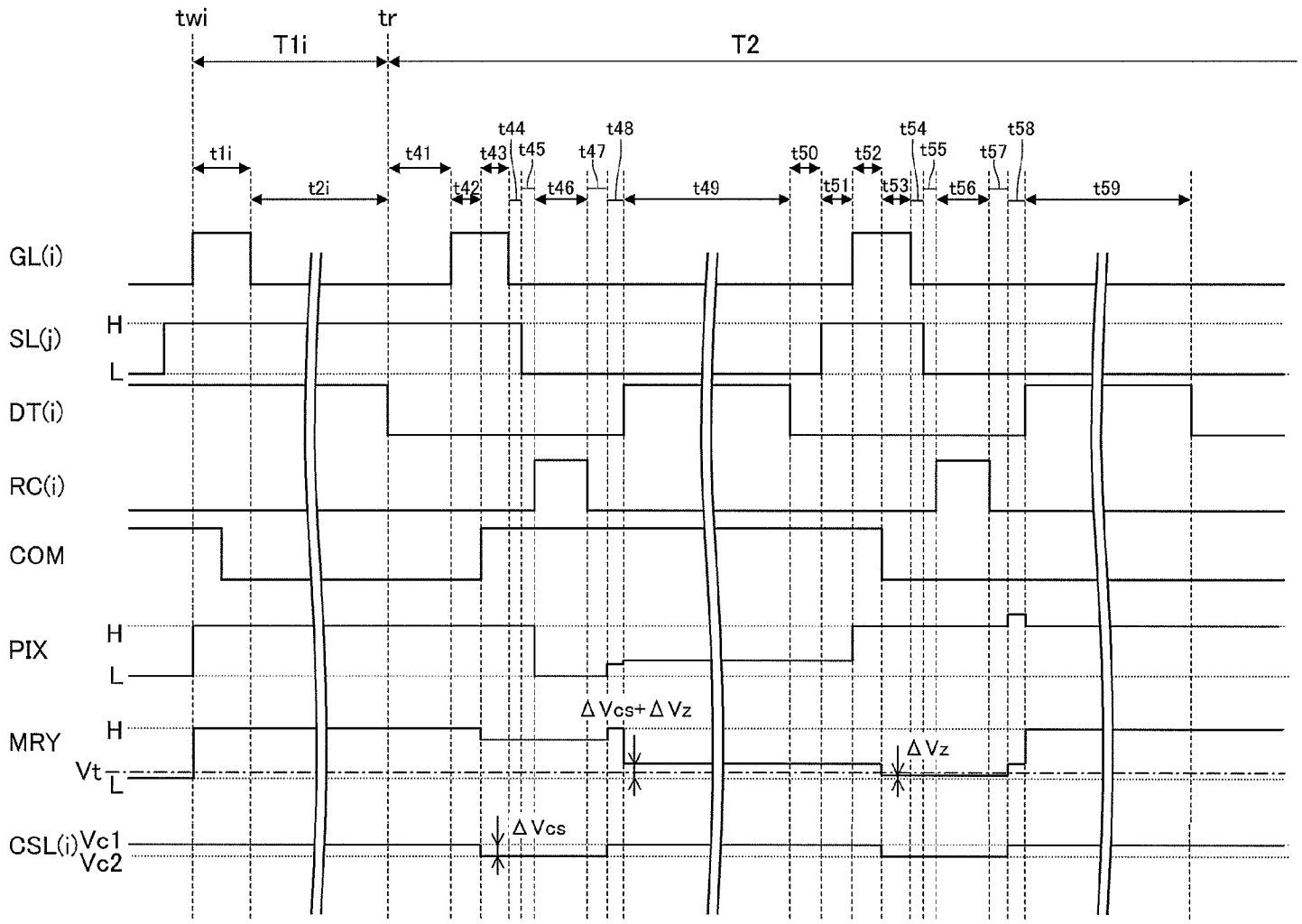
FIG. 15 is a signal chart for explaining the operation of Example 1 of Operation, which corresponds to a pixel memory of the liquid crystal display device of Embodiment 3.

FIG. 15 is a signal chart showing how the pixel memory MR3 of the present embodiment operates. FIG. 15 explains a case where a threshold level Vt at which the transistor N3 is turned on is lower than an electric potential that falls in the center of the range from the H level to the L level. FIG. 15 shows a case where "1"=High is written as first data in the writing period T11. The operation during the writing period T11 is the same as that shown in FIG. 9, and therefore is not described here.

In a period t41 of the refresh period, the gate line GL(i), the data transfer control line DT(i), and the refresh output control line RC(i) have their electric potentials at Low, the source line SL(j) has its electric potential at High, and the CS line CSL(i) has its electric potential changed to the first level (Vc1; H level). This brings the transistor N2 into an OFF state, thus bringing the data transfer section TS1 into a state in which to carry out the non-transfer operation, so that the nodes PIX and MRY get disconnected from each other. Both the nodes PIX and MRY have their electric potentials retained at the H level.

In a period t42, the gate line GL(i) has its electric potential changed to High, the source line SL(j) has its electric potential kept at High, the data transfer control line DT(i) and the refresh output control line RC(i) have their electric potentials kept at Low, and the CS line CSL(i) has its electric potential kept at the first level. This brings the transistor N1 into an ON state, thus bringing the switching circuit SW1 into a conductive state, so that the High electric potential (H level) is written again to the node PIX from the source line SL(j).

In a period t43, the gate line GL(i) and the source line SL(j) have their electric potentials kept at High, the data transfer control line DT(i) and the refresh output control line RC(i) have their electric potentials kept at Low, and the CS line CSL(i) has its electric potential changed to the second level (Vc2; L level), which is lower than the first level. The following equality holds: $|Vc1-Vc2|=\Delta Vcs$. This causes the electric potential of the node MRY to drop by $\Delta Vcs$ from the H level. However, the electric potential ($H-\Delta Vcs$) of the node MRY is higher than the threshold level Vt of the transistor N3. It should be noted that since the transistor N1 is in an ON state, the electric potential of the node PIX remains at the H level.

In a period t44, the gate line GL(i) has its electric potential changed to Low, the source line SL(j) has its electric potential kept at High, the data transfer control line DT(i) and the refresh output control line RC(i) have their electric potentials kept at Low, and the CS line CSL(i) has its electric potential kept at the second level. This brings the transistor N1 into an OFF state, thus bringing the switching circuit SW1 into a disconnected state, so that the node PIX gets disconnected from the source line SL(j) and retains the High level.

In a period t45, the gate line GL(i), the data transfer control line DT(i), and the refresh output control line RC(i) have their electric potentials kept at Low, the source line SL(j) has its electric potential changed to Low, and the CS line CSL(i) has its electric potential kept at the second level.

In a period t46 (first active period), the gate line GL(i), the source line SL(j), and the data transfer control line DT(i) have their electric potentials kept at Low, the refresh output control line RC(i) has its electric potential changed to High, and the CS line CSL(i) has its electric potential kept at the second level. This brings the transistor N4 into an ON state, so that the refresh output control section RS3 carries out the first operation. Further, since the electric potential (H−ΔVcs) of the node MRY is higher than the threshold level Vt of the transistor N3, the transistor N3 is in an ON state. This brings the refresh output control section RS3 into the active state, so that the Low electric potential (L level) is supplied to the node PIX from source line SL(j) via the transistors N3 and N4. The source line SL(j) also serves as the supply source VS1 in FIG. 2.

In a period t47, the gate line GL(i), the source line SL(j), and the data transfer control line DT(i) have their electric potentials kept at Low, the refresh output control line RC(i) has its electric potential changed to Low, and the CS line CSL(i) has its electric potential kept at the second level. This brings the transistor N4 into an OFF state, thus bringing the refresh output control section RS3 into a state in which to carry out the second operation, so that the node PIX gets disconnected from the source line SL(j) and retains the L level.

In a period t48, the gate line GL(i), the source line SL(j), the data transfer control line DT(i), and the refresh output control line RC(i) have their electric potentials kept at Low, and the CS line CSL(i) has its electric potential changed to the first level. This causes the electric potential of the node MRY to return to the H level. Further, since the transistor N1 is in an OFF state, the electric potential of the node PIX rises by ΔVcs from the L level.

In a period t49, the gate line GL(i), the source line SL(j), and the refresh output control line RC(i) have their electric potentials kept at Low, the data transfer control line DT(i) has its electric potential changed to High, and the CS line CSL(i) has its electric potential kept at the first level. This brings the transistor N2 into an ON state, thus bringing the data transfer section TS1 into a state in which to carry out the transfer operation. In this case, a charge transfer occurs between the capacitors Ca1 and Cb1, so that the electric potential of the node MRY drops. The electric potential of the node PIX rises by a slight voltage ΔVz from L+ΔVcs due to the transfer of positive charge from the capacitor Cb1 to the capacitor Ca1 via the transistor N2. Further, the electric potential of the node MRY becomes (L+ΔVcs+ΔVz), which is equal to the electric potential of the node PIX. In a case where the threshold level Vt of the transistor N3 is low, the electric potential (L+ΔVcs+ΔVz) of the node MRY exceeds the threshold level Vt of the transistor N3.

In a period t50, the gate line GL(i), the source line SL(j), and the refresh output control line RC(i) have their electric potentials kept at Low, the data transfer control line DT(i) has its electric potential changed to Low, and the CS line CSL(i) has its electric potential kept at the first level. This brings the transistor N2 into an OFF state, thus bringing the data transfer section TS1 into a state in which to carry out the non-transfer operation, so that the nodes PIX and MRY get disconnected from each other. Both the nodes PIX and MRY retain Low (L+ΔVcs+ΔVz).

In a period t51, the gate line GL(i), the data transfer control line DT(i), and the refresh output control line RC(i) have their electric potentials kept at Low, the source line SL(j) has its electric potential changed to High, and the CS line CSL(i) has its electric potential kept at the first level.

In a period t52, the gate line GL(i) has its electric potential changed to High, the source line SL(j) has its electric potential kept at High, the data transfer control line DT(i) and the refresh output control line RC(i) have their electric potentials kept at Low, and the CS line CSL(i) has its electric potential kept at the first level. This brings the transistor N1 into an ON state, thus bringing the switching circuit SW1 into a conductive state, so that the H-level electric potential is written again to the node PIX from the source line SL(j).

In a period t53, the gate line GL(i) and the source line SL(j) have their electric potentials kept at High, the data transfer control line DT(i) and the refresh output control line RC(i) have their electric potentials kept at Low, and the CS line CSL(i) has its electric potential changed to the second level. This causes the electric potential of the node MRY to be (L+ΔVz). It should be noted that the electric potential (L+ΔVz) of the node MRY during the period t53 is lower than the electric potential (L+ΔVx) of the node MRY shown in FIG. 7. Therefore, the electric potential (L+ΔVz) of the node MRY during the period t53 is lower than the threshold level Vt. This causes the transistor N3 to be supplied with an OFF voltage via its gate terminal, so that the transistor N3 comes into an OFF state. It should be noted that since the transistor N1 is in an ON state, the electric potential of the node PIX remains at the H level.

In a period t54, the gate line GL(i) has its electric potential changed to Low, the source line SL(j) has its electric potential kept at High, the data transfer control line DT(i) and the refresh output control line RC(i) have their electric potentials kept at Low, and the CS line CSL(i) has its electric potential kept at the second level. This brings the transistor N1 into an OFF state, thus bringing the switching circuit SW1 into a disconnected state, so that the node PIX gets disconnected from the source line SL(j) and retains the H level.

In a period t55, the gate line GL(i), the data transfer control line DT(i), and the refresh output control line RC(i) have their electric potentials kept at Low, the source line SL(j) has its electric potential changed to Low, and the CS line CSL(i) has its electric potential kept at the second level.

In a period t56 (second active period), the gate line GL(i), the source line SL(j), and the data transfer control line DT(i) have their electric potentials kept at Low, the refresh output control line RC(i) has its electric potential changed to High, and the CS line CSL(i) has its electric potential kept at the second level. This brings the transistor N4 into an ON state, thus bringing the refresh output control section RS3 into a state in which to carry out the first operation. Further, since the electric potential (L+ΔVz) of the node MRY is lower than the threshold level Vt of the transistor N3, the transistor N3 is in an OFF state. This brings the refresh output control section RS3 into the non-active state, in which the refresh output control section RS3 stops producing an output. Therefore, the node PIX keeps retaining the H level.

In a period t57, the gate line GL(i), the source line SL(j), and the data transfer control line DT(i) have their electric potentials kept at Low, the refresh output control line RC(i) has its electric potential changed to Low, and the CS line CSL(i) has its electric potential kept at the second level. This brings the transistor N4 into an OFF state, thus bringing the refresh output control section RS3 into a state in which to carry out the second operation, so that the node PIX gets disconnected from the source line SL(j) and retains the H level.

In a period t58, the gate line GL(i), the source line SL(j), the data transfer control line DT(i), and the refresh output control line RC(i) have their electric potentials kept at Low, and the CS line CSL(i) has its electric potential changed to the first level. This causes the electric potential of the node MRY to rise by ΔVcs to become (L+ΔVcs+ΔVz). Further, since the transistor N1 is in an OFF state, the electric potential of the node PIX rises by ΔVcs from the H level.

In a period t59, the gate line GL(i), the source line SL(j), and the refresh output control line RC(i) have their electric potentials kept at Low, the data transfer control line DT(i) has its electric potential changed to High, and the CS line CSL(i) has its electric potential kept at the first level. This brings the transistor N2 into an ON state, thus bringing the data transfer section TS1 into a state in which to carry out the transfer operation. In this case, a charge transfer occurs between the capacitors Ca1 and Cb1, so that both the nodes PIX and MRY come to have their electric potentials at High (substantially at the H level).

With these actions, the electric potential of the node PIX during the refresh period T2 is High during the periods t41 to t45 and the periods t52 to t59 and Low during the periods t46 to t51, and the electric potential of the node MRY during the refresh period T2 is High during the periods t41 to t48 and the period t59 and Low during the periods t49 to t58.

Example 2 of Operation of Embodiment 3

Figure 16:
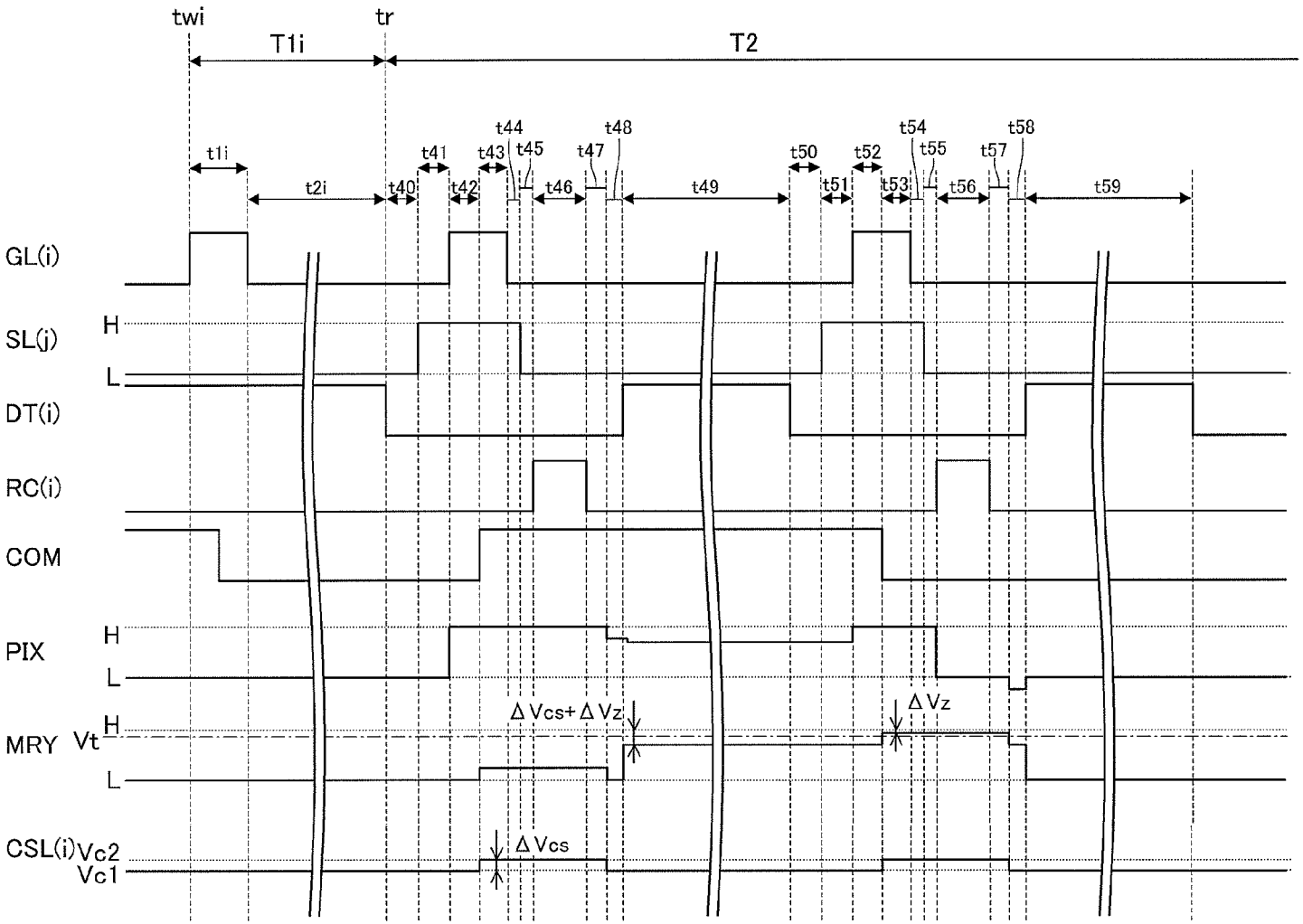
FIG. 16 is a signal chart for explaining the operation of Example 2 of Operation, which corresponds to a pixel memory of the liquid crystal display device of Embodiment 3.
Figure 17:
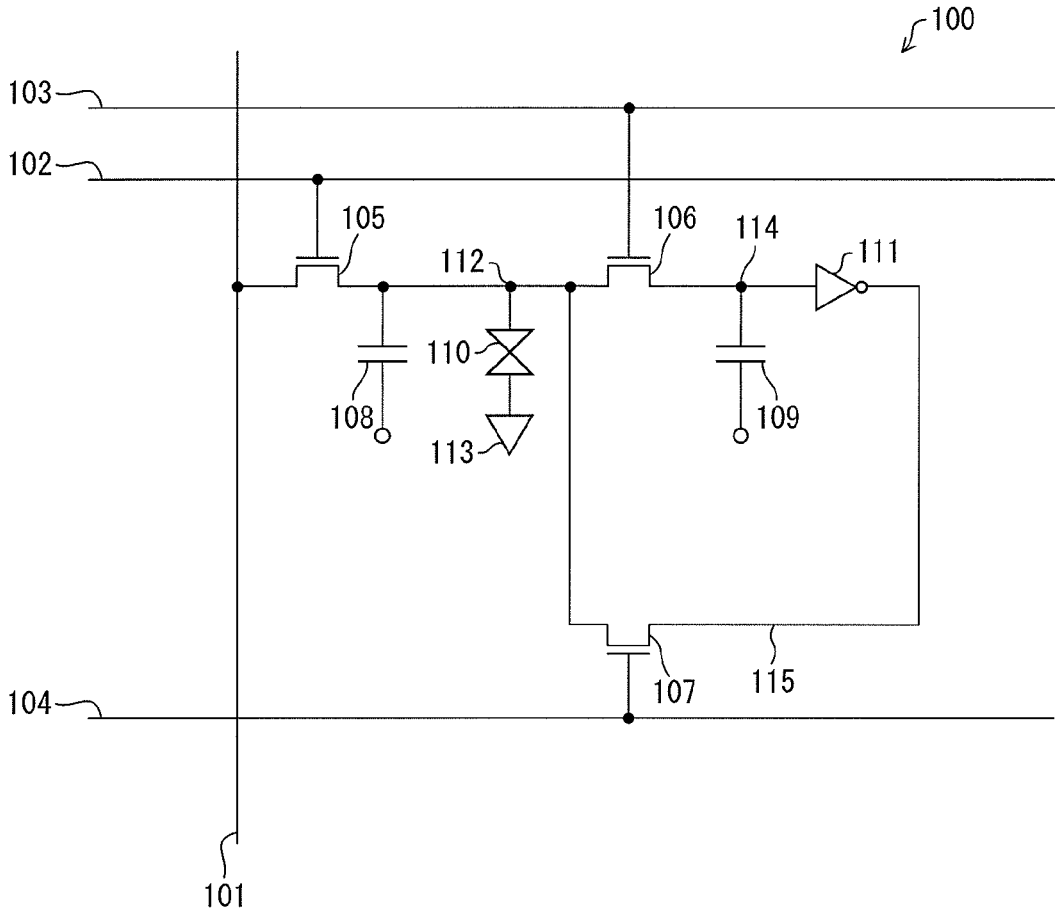
FIG. 17 is a circuit diagram showing a configuration of a pixel in a conventional liquid crystal display device.
Figure 18:
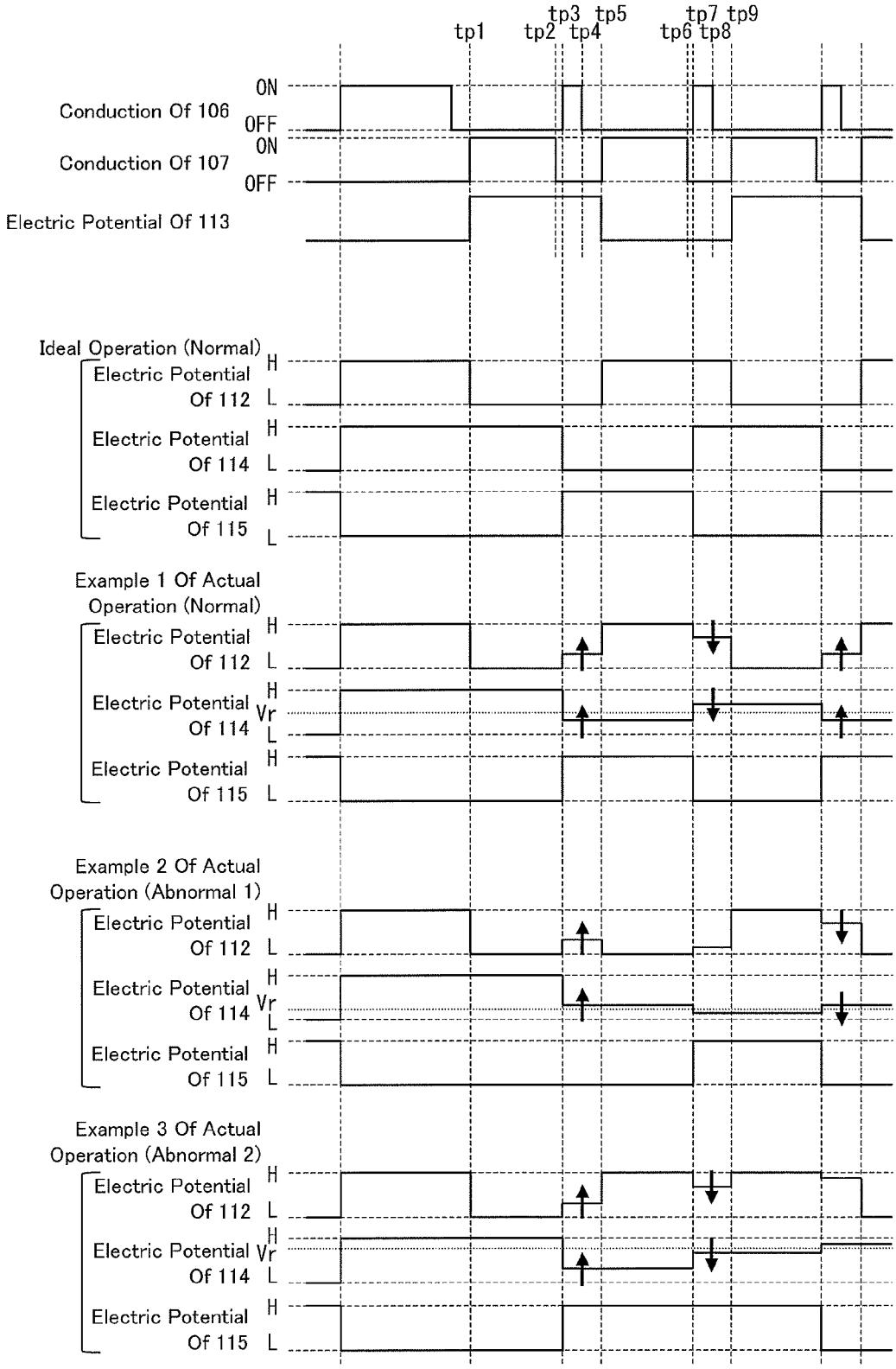
FIG. 18 is a signal chart for explaining the operation of a conventional liquid crystal display device.
Figure 19:
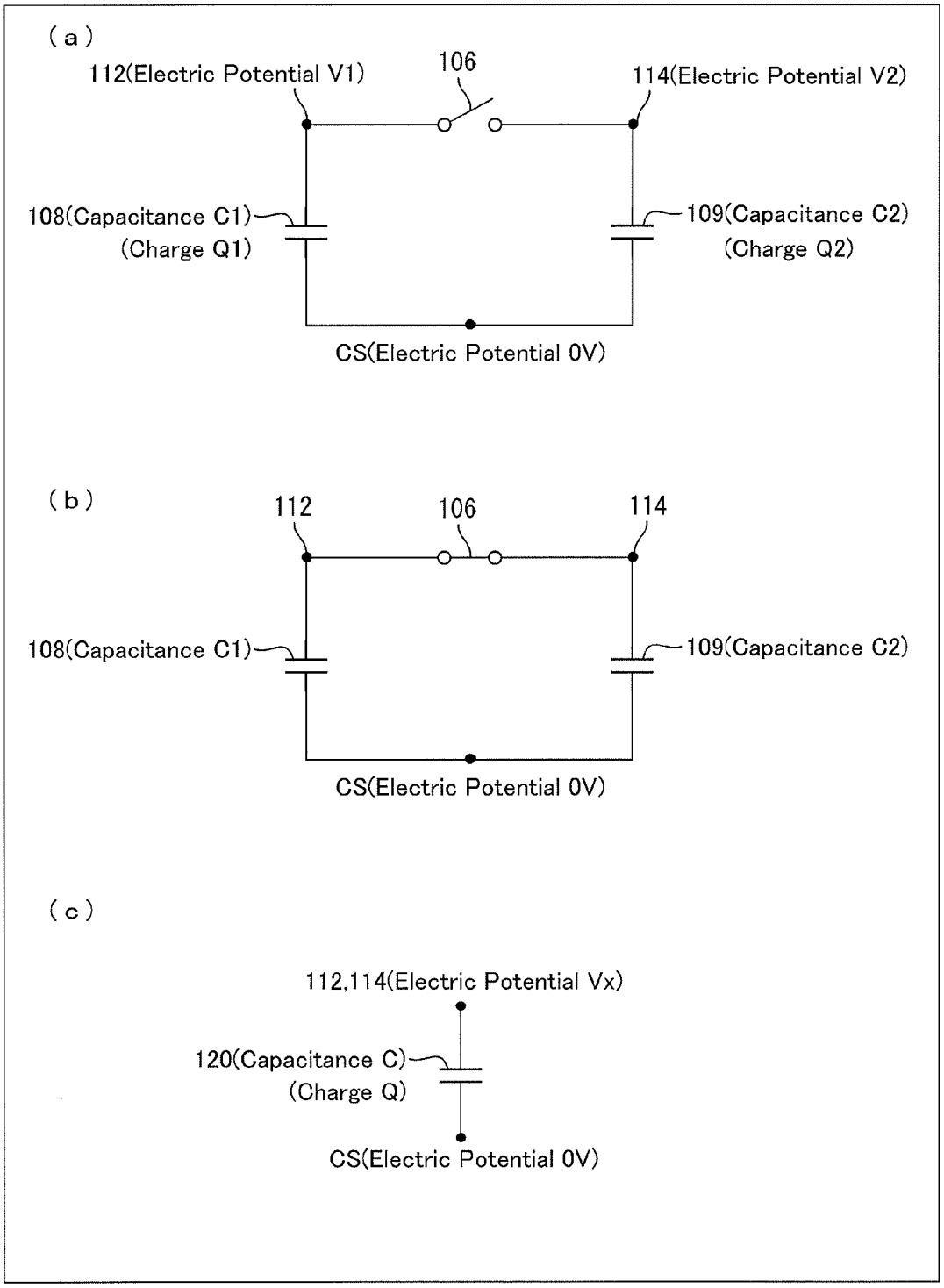
FIG. 19 is a set of schematic views (a) to (c) showing capacitor elements in simple form.
Figure 20:
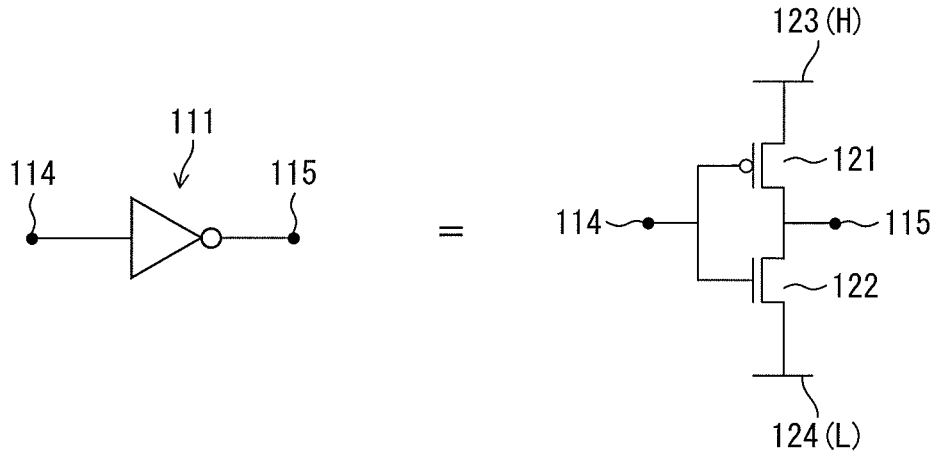
FIG. 20 is a circuit diagram showing a circuit equivalent to the inverter circuit of FIG. 17.

FIG. 16 is a signal chart showing how the pixel memory MR3 of the present embodiment operates. FIG. 16 explains a case where a threshold level Vt at which the transistor N3 is turned on is higher than an electric potential that falls in the center of the range from the H level to the L level. FIG. 16 shows a case where "0"=Low is written as first data in the writing period T1*i*. The operation during the writing period T1*i* is the same as that shown in FIG. 10, and therefore is not described here.

In a period t40 of the refresh period, the gate line GL(i), the source line SL(j), the data transfer control line DT(i), and the refresh output control line RC(i) have their electric potentials at Low, and the CS line CSL(i) has its electric potential at the first level (Vc1; L level). This brings the transistor N2 into an OFF state, thus bringing the data transfer section TS1 into a state in which to carry out the non-transfer operation, so that the nodes PIX and MRY get disconnected from each other. Both the nodes PIX and MRY have their electric potentials retained at the L level.

In the period t41, the gate line GL(i), the data transfer control line DT(i), and the refresh output control line RC(i) have their electric potentials kept at Low, the source line SL(j) has its electric potential changed to High, and the CS line CSL(i) has its electric potential kept at the first level.

In the period t42, the gate line GL(i) has its electric potential changed to High, the source line SL(j) has its electric potential kept at High, the data transfer control line DT(i) and the refresh output control line RC(i) have their electric potentials kept at Low, and the CS line CSL(i) has its electric potential kept at the first level. This brings the transistor N1 into an ON state, thus bringing the switching circuit SW1 into a conductive state, so that the High electric potential (H level) is written to the node PIX from the source line SL(j).

In the period t43, the gate line GL(i) and the source line SL(j) have their electric potentials kept at High, the data transfer control line DT(i) and the refresh output control line RC(i) have their electric potentials kept at Low, and the CS line CSL(i) has its electric potential changed to the second level (Vc2; H level), which is higher than the first level. The following equality holds: |Vc2−Vc1|=ΔVcs. This causes the electric potential of the node MRY to rise by ΔVcs from the L level. However, the electric potential (L+ΔVcs) of the node MRY is lower than the threshold level Vt of the transistor N3. It should be noted that since the transistor N1 is in an ON state, the electric potential of the node PIX remains at the H level.

In the period t44, the gate line GL(i) has its electric potential changed to Low, the source line SL(j) has its electric potential kept at High, the data transfer control line DT(i) and the refresh output control line RC(i) have their electric potentials kept at Low, and the CS line CSL(i) has its electric potential kept at the second level. This brings the transistor N1 into an OFF state, thus bringing the switching circuit SW1 into a disconnected state, so that the node PIX gets disconnected from the source line SL(j) and retains the High level.

In the period t45, the gate line GL(i), the data transfer control line DT(i), and the refresh output control line RC(i) have their electric potentials kept at Low, the source line SL(j) has its electric potential changed to Low, and the CS line CSL(i) has its electric potential kept at the second level.

In the period t46 (second active period), the gate line GL(i), the source line SL(j), and the data transfer control line DT(i) have their electric potentials kept at Low, the refresh output control line RC(i) has its electric potential changed to High, and the CS line CSL(i) has its electric potential kept at the second level. This brings the transistor N4 into an ON state, so that the refresh output control section RS3 carries out the first operation. Further, since the electric potential (L+ΔVcs) of the node MRY is lower than the threshold level Vt of the transistor N3, the transistor N3 is in an OFF state. This brings the refresh output control section RS3 into the non-active state, so that the node PIX and the source line SL(j) get disconnected from each other.

In the period t47, the gate line GL(i), the source line SL(j), and the data transfer control line DT(i) have their electric potentials kept at Low, the refresh output control line RC(i) has its electric potential changed to Low, and the CS line CSL(i) has its electric potential kept at the second level. This brings the transistor N4 into an OFF state, thus bringing the refresh output control section RS3 into a state in which to carry out the second operation, so that the node PIX gets disconnected from the source line SL(j) and retains the H level.

In the period t48, the gate line GL(i), the source line SL(j), the data transfer control line DT(i), and the refresh output control line RC(i) have their electric potentials kept at Low, and the CS line CSL(i) has its electric potential changed to the first level. This causes the electric potential of the node MRY to return to the L level. Further, since the transistor N1 is in an OFF state, the electric potential of the node PIX drops by ΔVcs from the H level.

In the period t49, the gate line GL(i), the source line SL(j), and the refresh output control line RC(i) have their electric potentials kept at Low, the data transfer control line DT(i) has its electric potential changed to High, and the CS line CSL(i) has its electric potential kept at the first level. This brings the transistor N2 into an ON state, thus bringing the data transfer section TS1 into a state in which to carry out the transfer operation. In this case, a charge transfer occurs between the capacitors Ca1 and Cb1, so that the electric potential of the node MRY rises. The electric potential of the node PIX drops by a slight voltage ΔVz from H−ΔVcs due to the transfer of positive charge from the capacitor Ca1 to the capacitor Cb1 via the transistor N2. Further, the electric potential of the node MRY becomes (H−ΔVcs−ΔVz), which is equal to the electric potential of the node PIX. In a case where the threshold level Vt of the transistor N3 is high, the electric potential (H−ΔVcs−ΔVz) of the node MRY falls short of the threshold level Vt of the transistor N3.

In the period t50, the gate line GL(i), the source line SL(j), and the refresh output control line RC(i) have their electric potentials kept at Low, the data transfer control line DT(i) has its electric potential changed to Low, and the CS line CSL(i) has its electric potential kept at the first level. This brings the transistor N2 into an OFF state, thus bringing the data transfer section TS1 into a state in which to carry out the non-transfer operation, so that the nodes PIX and MRY get disconnected from each other. Both the nodes PIX and MRY retain (H−ΔVcs−ΔVz).

In the period t51, the gate line GL(i), the data transfer control line DT(i), and the refresh output control line RC(i) have their electric potentials kept at Low, the source line SL(j) has its electric potential changed to High, and the CS line CSL(i) has its electric potential kept at the first level.

In the period t52, the gate line GL(i) has its electric potential changed to High, the source line SL(j) has its electric potential kept at High, the data transfer control line DT(i) and the refresh output control line RC(i) have their electric potentials kept at Low, and the CS line CSL(i) has its electric potential kept at the first level. This brings the transistor N1 into an ON state, thus bringing the switching circuit SW1 into a conductive state, so that the H-level electric potential is written again to the node PIX from the source line SL(j).

In the period t53, the gate line GL(i) and the source line SL(j) have their electric potentials kept at High, the data transfer control line DT(i) and the refresh output control line RC(i) have their electric potentials kept at Low, and the CS line CSL(i) has its electric potential changed to the second level. This causes the electric potential of the node MRY to be H−ΔVz. It should be noted that ΔVz is smaller than ΔVx shown in FIG. 8; therefore, the electric potential (H−ΔVz) of the node MRY during the period t53 is higher than the electric potential (H−ΔVx) of the node MRY shown in FIG. 8. Therefore, the electric potential (H−ΔVz) of the node MRY during the period t53 is higher than the threshold level Vt. This causes the transistor N3 to be supplied with an ON voltage via its gate terminal, so that the transistor N3 comes into an ON state. It should be noted that since the transistor N1 is in an ON state, the electric potential of the node PIX remains at the H level.

In the period t54, the gate line GL(i) has its electric potential changed to Low, the source line SL(j) has its electric potential kept at High, the data transfer control line DT(i) and the refresh output control line RC(i) have their electric potentials kept at Low, and the CS line CSL(i) has its electric potential kept at the second level. This brings the transistor N1 into an OFF state, thus bringing the switching circuit SW1 into a disconnected state, so that the node PIX gets disconnected from the source line SL(j) and retains the H level.

In the period t55, the gate line GL(i), the data transfer control line DT(i), and the refresh output control line RC(i) have their electric potentials kept at Low, the source line SL(j) has its electric potential changed to Low, and the CS line CSL(i) has its electric potential kept at the second level.

In the period t56 (first active period), the gate line GL(i), the source line SL(j), and the data transfer control line DT(i) have their electric potentials kept at Low, the refresh output control line RC(i) has its electric potential changed to High, and the CS line CSL(i) has its electric potential kept at the second level. This brings the transistor N4 into an ON state, thus bringing the refresh output control section RS3 into a state in which to carry out the first operation. Further, since the electric potential (H−ΔVz) of the node MRY is higher than the threshold level Vt of the transistor N3, the transistor N3 is in an ON state. This brings the refresh output control section RS3 into the active state, the Low electric potential (L level) is supplied to the node PIX from the source line SL(j) via the transistors N3 and N4.

In the period t57, the gate line GL(i), the source line SL(j), and the data transfer control line DT(i) have their electric potentials kept at Low, the refresh output control line RC(i) has its electric potential changed to Low, and the CS line CSL(i) has its electric potential kept at the second level. This brings the transistor N4 into an OFF state, thus bringing the refresh output control section RS3 into a state in which to carry out the second operation, so that the node PIX gets disconnected from the source line SL(j) and retains the L level.

In the period t58, the gate line GL(i), the source line SL(j), the data transfer control line DT(i), and the refresh output control line RC(i) have their electric potentials kept at Low, and the CS line CSL(i) has its electric potential changed to the first level. This causes the electric potential of the node MRY to drop by ΔVcs to become (H−ΔVcs−ΔVz). Further, since the transistor N1 is in an OFF state, the electric potential of the node PIX drops by ΔVcs from the L level.

In the period t59, the gate line GL(i), the source line SL(j), and the refresh output control line RC(i) have their electric potentials kept at Low, the data transfer control line DT(i) has its electric potential changed to High, and the CS line CSL(i) has its electric potential kept at the first level. This brings the transistor N2 into an ON state, thus bringing the data transfer section TS1 into a state in which to carry out the transfer operation. In this case, a charge transfer occurs between the capacitors Ca1 and Cb1, so that both the nodes PIX and MRY come to have their electric potentials at Low (substantially at the L level).

With these actions, the electric potential of the node PIX during the refresh period T2 is Low during the periods t40 to t41 and the periods t56 to t59 and High during the periods t42 to t55, and the electric potential of the node MRY during the refresh period T2 is Low during the periods t40 to t48 and the period t59 and High during the periods t49 to t58.

In the examples of operation of the present embodiment as shown in FIGS. 15 and 16, an operation that is similar to that of Embodiment 1 can be carried out. Therefore, the examples of operation of the present embodiment as shown in FIGS. 15 and 16 makes it possible to enlarge the range of thresholds of the transistor N3 in which the pixel memory can normally operate, thus preventing a malfunction of the circuit from occurring due to variations in transistor characteristic.

[Other Modifications]

A liquid crystal display device according to an aspect of the present invention is a liquid crystal display device including data signal lines, scanning signal lines, retention capacitor wires, data transfer lines, and pixel electrodes, the liquid crystal display device being a memory-type liquid crystal display device that carries out a refresh operation during a data retention period after writing of a data signal potential, the liquid crystal display device including: first transistors each having its control terminal connected to a corresponding one of the scanning signal lines, having one conducting terminal connected to a corresponding one of the data signal lines, and having the other conducting terminal connected to a corresponding one of the pixel electrodes; second transistors each having its control terminal connected to a corresponding one of the data transfer lines and having one conducting terminal connected to a corresponding one of the pixel electrodes; retention electrodes each connected to the other conducting terminal of a corresponding one of the second transistors; refresh output control sections each having its input section connected to a corresponding one of the retention electrodes and having its output section connected to a corresponding one of the pixel electrodes; and retention capacitors each formed between a corresponding one of the retention electrodes and a corresponding one of the retention capacitor wires, in the data retention period, an electric potential of each of the retention electrodes being changed via a corresponding one of the retention capacitors by changing an electric potential level of a retention capacitor wire signal that is supplied to a corresponding one of the retention capacitor wires, the refresh output control sections each receiving the electric potential thus changed of a corresponding one of the retention electrodes via the input section and controlling an electric potential of a corresponding one of the pixel electrodes in accordance with the electric potential thus changed.

The foregoing configuration makes it possible to, in the data retention period, raise (or drop) the electric potential of the retention electrode by changing the electric potential level of the retention capacitor wire signal. This allows the refresh output control section to supply the pixel electrode with an output signal adjusted to an appropriate electric potential level, thus making it possible to prevent a malfunction of the pixel memory from occurring due to variations in transistor characteristic.

The liquid crystal display device can also be configured to further include refresh lines connected to the refresh output control sections, wherein: each of the refresh output control sections outputs an output signal to a corresponding one of the pixel electrodes via the output section when a corresponding one of the refresh lines is active; during a period of writing of the data signal potential, the retention capacitor wire signal has its electric potential at a first level; and at least during that part of the data retention period during which the refresh line is active, the retention capacitor wire signal has its electric potential at a second level.

The liquid crystal display device can also be configured such that in the data retention period, (a) the refresh line is made active after the electric potential of the retention capacitor wire signal has been changed from the first level to the second level and (b) the electric potential of the retention capacitor wire signal is changed from the second level to the first level after the refresh line has been made non-active.

The liquid crystal display device can also be configured such that in the data retention period, (a) the electric potential of the retention capacitor wire signal is changed from the first level to the second level within a period of time between a point in time where the data transfer line was made non-active and a point in time where the refresh line is made active and (b) the electric potential of the retention capacitor wire signal is changed from the second level to the first level within a period of time between a point in time where the refresh line was made non-active and a point in time where the data transfer line is made active.

The liquid crystal display device can also be configured such that each of the refresh output control sections includes: a third transistor having its control terminal connected to the input section and having one conducting terminal connected to a corresponding one of the data transfer lines; and a fourth transistor having its control terminal connected to a corresponding one of the refresh lines, having one conducting terminal connected to the other conducting terminal of the third transistor, and having the other conducting terminal connected to the output section.

Let it be assumed here, for example, that with the first level set as a high level (H) and the second level set as a low level (L), a data signal potential of a high level is written to the pixel electrode in the period of writing of the data signal potential, and the electric potential of the retention capacitor wire signal is changed from the first level (H) to the second level (L) within a period of time between a point in time where the data transfer line was made non-active and a point in time where the refresh line is made active, while the electric potential of the retention capacitor wire signal is changed from the second level (L) to the first level (H) within a period of time between a point in time where the refresh line was made non-active and a point in time where the data transfer line is made active (see FIG. 9).

In this case, the foregoing configuration makes it possible to, by changing the electric potential of the retention capacitor wire signal from the first level (H) to the second level (L), cause an electric potential (node MRY) of a retention electrode connected to the input section to drop to a voltage at which the third transistor is turned off (see the period t10 of FIG. 9). This prevents the pixel electrode from being electrically connected to the data transfer line via the third transistor even if, at a subsequent time, the refresh line becomes active and the fourth transistor comes into an ON state, thus making it possible to maintain the electric potential (H) of the pixel electrode. This makes it possible to prevent a malfunction of the pixel memory.

The liquid crystal display device can also be configured such that each of the refresh output control sections includes: an inverter circuit having its input terminal connected to the input section; and a third transistor having its control terminal connected to a corresponding one of the refresh lines, having one conducting terminal connected to an output terminal of the inverter circuit, and having the other conducting terminal connected to the output section.

The liquid crystal display device can also be configured such that each of the refresh output control sections outputs an electric potential to a corresponding one of the pixel electrodes via the output section when a corresponding one of the refresh lines is active, the electric potential that is outputted by the refresh output control section having been obtained by inverting an electric potential level of a corresponding one of the retention electrodes, the electric potential level having been inputted to the refresh output control section via the input section.

The liquid crystal display device can also be configured such that each of the refresh output control sections includes: a third transistor having its control terminal connected to the input section and having one conducting terminal connected to the output section; and a fourth transistor having its control terminal connected to a corresponding one of the refresh lines, having one conducting terminal connected to the other conducting terminal of the third transistor, and having the other conducting terminal connected to a corresponding one of the data signal lines.

The liquid crystal display device can also be configured such that first and second active periods are provided alternately for the refresh line, with a non-active period provided between each of the active periods and another; when the refresh line is in the first active period, a corresponding one of the retention electrodes is supplied with an ON voltage for turning on the third transistor; and when the refresh line is in the second active period, the retention electrode is supplied with an OFF voltage for turning off the third transistor.

The liquid crystal display device can also be configured such that: in a case where a data signal potential of a high level is written to the pixel electrode in the period of writing of the data signal potential, the retention capacitor wire signal has its first level set as a high level and has its second level set as a low level; and when an electric potential of the pixel electrode before the refresh line becomes active is at a low level, by changing the retention capacitor wire signal from the first level to the second level, the electric potential of the retention electrode is dropped so as to be lower than an inversion electric potential of the inverter circuit.

The liquid crystal display device can also be configured such that: in a case where a data signal potential of a low level is written to the pixel electrode in the period of writing of the data signal potential, the retention capacitor wire signal has its first level set as a low level and has its second level set as a high level; and when an electric potential of the pixel electrode before the refresh line becomes active is at a high level, by changing the retention capacitor wire signal from the first level to the second level, the electric potential of the retention electrode is raised so as to be higher than an inversion electric potential of the inverter circuit.

The liquid crystal display device can also be configured such that each of the retention capacitors each formed between a corresponding one of the retention electrodes and a corresponding one of the retention capacitor wires serves as a first retention capacitor, the liquid crystal display device further including: second retention capacitors each formed between a corresponding one of the pixel electrodes and a corresponding one of the retention capacitor wires.

A method according to an aspect of the present invention for driving a liquid crystal display device is a method for driving a liquid crystal display device including data signal lines, scanning signal lines, retention capacitor wires, data transfer lines, refresh lines, and pixel electrodes, the liquid crystal display device being a memory-type liquid crystal display device that carries out a refresh operation during a data retention period after writing of a data signal potential, the liquid crystal display device including: first transistors each having its control terminal connected to a corresponding one of the scanning signal lines, having one conducting terminal connected to a corresponding one of the data signal lines, and having the other conducting terminal connected to a corresponding one of the pixel electrodes; second transistors each having its control terminal connected to a corresponding one of the data transfer lines and having one conducting terminal connected to a corresponding one of the pixel electrodes; retention electrodes each connected to the other conducting terminal of a corresponding one of the second transistors; refresh output control sections each having its input section connected to a corresponding one of the retention electrodes and having its output section connected to a corresponding one of the pixel electrodes; and retention capacitors each formed between a corresponding one of the retention electrodes and a corresponding one of the retention capacitor wires, the method including the steps of: (a) in a period of writing of a data signal potential, selecting the scanning signal lines in sequence while outputting a data signal potential to each of the data signal lines, with the data transfer lines made active in advance; (b) in the data retention period, changing an electric potential of each of the retention electrodes via a corresponding one of the retention capacitors by changing an electric potential level of a retention capacitor wire signal that is supplied to a corresponding one of the retention capacitor wires; and (c) carrying out the refresh operation by the refresh output control sections each receiving the electric potential thus changed of a corresponding one of the retention electrodes via the input section and controlling an electric potential of a corresponding one of the pixel electrodes in accordance with the electric potential thus changed.

The foregoing method brings about effects that are similar to those brought about by the foregoing liquid crystal display device.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The present invention is suitably applicable, for example, to displays of mobile phones.

REFERENCE SIGNS LIST

1 Liquid crystal display device
2 Gate driver/CS driver (scanning signal line driving circuit/retention capacitor wire driving circuit)
3 Control signal buffer circuit
4 Driving signal generating circuit/picture signal generating circuit (display control circuit)
5 Demultiplexer
6 Pixel array
40 Pixel
COM Counter electrode (common electrode)
GL Gate line (scanning signal line)
CSL CS line (retention capacitor wire)
DT Data transfer control line (data transfer line)
RC Refresh output control line (refresh line)
SL Source line (data signal line)
MR Pixel memory (memory circuit)
SW1 Switching circuit
DS1 First data retention section
TS1 Data transfer section
DS2 Second data retention section
RS1, RS2, RS3 Refresh output control section
VS1 Supply source
N1 to N4 Transistor (N-channel field-effect transistor)
N1 Transistor (first transistor)
N2 Transistor (second transistor)
N3 Transistor (third transistor)
N4 Transistor (fourth transistor)
Ca1 Capacitor (second retention capacitor)
Cb1 Capacitor (first retention capacitor)
PIX Pixel electrode
MRY Retention electrode
INV Inverter circuit

The invention claimed is:

1. A liquid crystal display device including data signal lines, scanning signal lines, retention capacitor wires, data transfer lines, and pixel electrodes, the liquid crystal display device being a memory-type liquid crystal display device that carries out a refresh operation during a data retention period after writing of a data signal potential, the liquid crystal display device comprising:

first transistors each having its control terminal connected to a corresponding one of the scanning signal lines, having one conducting terminal connected to a corresponding one of the data signal lines, and having the other conducting terminal connected to a corresponding one of the pixel electrodes;

second transistors each having its control terminal connected to a corresponding one of the data transfer lines and having one conducting terminal connected to a corresponding one of the pixel electrodes;

retention electrodes each connected to the other conducting terminal of a corresponding one of the second transistors;

refresh output control sections each having its input section connected to a corresponding one of the retention electrodes and having its output section connected to a corresponding one of the pixel electrodes; and retention capacitors each formed between a corresponding one of the retention electrodes and a corresponding one of the retention capacitor wires, in the data retention period, an electric potential of each of the retention electrodes being changed via a corresponding one of the retention capacitors by changing an electric potential level of a retention capacitor wire signal that is supplied to a corresponding one of the retention capacitor wires, the refresh output control sections each receiving the electric potential thus changed of a corresponding one of the retention electrodes via the input section and controlling an electric potential of a corresponding one of the pixel electrodes in accordance with the electric potential thus changed.

2. The liquid crystal display device as set forth in claim 1, further comprising refresh lines connected to the refresh output control sections, wherein:

each of the refresh output control sections outputs an output signal to a corresponding one of the pixel electrodes via the output section when a corresponding one of the refresh lines is active;

during a period of writing of the data signal potential, the retention capacitor wire signal has its electric potential at a first level; and at least during that part of the data retention period during which the refresh line is active, the retention capacitor wire signal has its electric potential at a second level.

3. The liquid crystal display device as set forth in claim 2, wherein in the data retention period, (a) the refresh line is made active after the electric potential of the retention capacitor wire signal has been changed from the first level to the second level and (b) the electric potential of the retention capacitor wire signal is changed from the second level to the first level after the refresh line has been made non-active.

4. The liquid crystal display device as set forth in claim 3, wherein in the data retention period, (a) the electric potential of the retention capacitor wire signal is changed from the first level to the second level within a period of time between a point in time where the data transfer line was made non-active and a point in time where the refresh line is made active and (b) the electric potential of the retention capacitor wire signal is changed from the second level to the first level within a period of time between a point in time where the refresh line was made non-active and a point in time where the data transfer line is made active.

5. The liquid crystal display device as set forth in claim 2, wherein each of the refresh output control sections comprises:

a third transistor having its control terminal connected to the input section and having one conducting terminal connected to a corresponding one of the data transfer lines; and a fourth transistor having its control terminal connected to a corresponding one of the refresh lines, having one conducting terminal connected to the other conducting terminal of the third transistor, and having the other conducting terminal connected to the output section.

6. The liquid crystal display device as set forth in claim 5, wherein:

first and second active periods are provided alternately for the refresh line, with a non-active period provided between each of the active periods and another;

when the refresh line is in the first active period, a corresponding one of the retention electrodes is supplied with an ON voltage for turning on the third transistor; and when the refresh line is in the second active period, the retention electrode is supplied with an OFF voltage for turning off the third transistor.

7. The liquid crystal display device as set forth in claim 2, wherein each of the refresh output control sections comprises:

an inverter circuit having its input terminal connected to the input section; and a third transistor having its control terminal connected to a corresponding one of the refresh lines, having one conducting terminal connected to an output terminal of the inverter circuit, and having the other conducting terminal connected to the output section.

8. The liquid crystal display device as set forth in claim 7, wherein each of the refresh output control sections outputs an electric potential to a corresponding one of the pixel electrodes via the output section when a corresponding one of the refresh lines is active, the electric potential that is outputted by the the refresh output control section having been obtained by inverting an electric potential level of a corresponding one of the retention electrodes, the electric potential level having been inputted to the refresh output control section via the input section.

9. The liquid crystal display device as set forth in claim 8, wherein:

in a case where a data signal potential of a high level is written to the pixel electrode in the period of writing of the data signal potential, the retention capacitor wire signal has its first level set as a high level and has its second level set as a low level; and when an electric potential of the pixel electrode before the refresh line becomes active is at a low level, by changing the retention capacitor wire signal from the first level to the second level, the electric potential of the retention electrode is dropped so as to be lower than an inversion electric potential of the inverter circuit.

10. The liquid crystal display device as set forth in claim 8, wherein:

in a case where a data signal potential of a low level is written to the pixel electrode in the period of writing of the data signal potential, the retention capacitor wire signal has its first level set as a low level and has its second level set as a high level; and when an electric potential of the pixel electrode before the refresh line becomes active is at a high level, by changing the retention capacitor wire signal from the first level to the second level, the electric potential of the retention electrode is raised so as to be higher than an inversion electric potential of the inverter circuit.

11. The liquid crystal display device as set forth in claim 2, wherein each of the refresh output control sections comprises:

a third transistor having its control terminal connected to the input section and having one conducting terminal connected to the output section; and a fourth transistor having its control terminal connected to a corresponding one of the refresh lines, having one conducting terminal connected to the other conducting terminal of the third transistor, and having the other conducting terminal connected to a corresponding one of the data signal lines.

12. The liquid crystal display device as set forth in claim 1, wherein each of the retention capacitors each formed between a corresponding one of the retention electrodes and a corresponding one of the retention capacitor wires serves as a first retention capacitor, the liquid crystal display device further comprising:

second retention capacitors each formed between a corresponding one of the pixel electrodes and a corresponding one of the retention capacitor wires.

13. A method for driving a liquid crystal display device including data signal lines, scanning signal lines, retention capacitor wires, data transfer lines, refresh lines, and pixel electrodes, the liquid crystal display device being a memory-type liquid crystal display device that carries out a refresh operation during a data retention period after writing of a data signal potential, the liquid crystal display device including:

first transistors each having its control terminal connected to a corresponding one of the scanning signal lines, having one conducting terminal connected to a corresponding one of the data signal lines, and having the other conducting terminal connected to a corresponding one of the pixel electrodes;

second transistors each having its control terminal connected to a corresponding one of the data transfer lines and having one conducting terminal connected to a corresponding one of the pixel electrodes;

retention electrodes each connected to the other conducting terminal of a corresponding one of the second transistors;

refresh output control sections each having its input section connected to a corresponding one of the retention electrodes and having its output section connected to a corresponding one of the pixel electrodes; and retention capacitors each formed between a corresponding one of the retention electrodes and a corresponding one of the retention capacitor wires, the method comprising the steps of:

(a) in a period of writing of a data signal potential, selecting the scanning signal lines in sequence while outputting a data signal potential to each of the data signal lines, with the data transfer lines made active in advance;

(b) in the data retention period, changing an electric potential of each of the retention electrodes via a corresponding one of the retention capacitors by changing an electric potential level of a retention capacitor wire signal that is supplied to a corresponding one of the retention capacitor wires; and (c) carrying out the refresh operation by the refresh output control sections each receiving the electric potential thus changed of a corresponding one of the retention electrodes via the input section and controlling an electric potential of a corresponding one of the pixel electrodes in accordance with the electric potential thus changed.

* * * * *